US011293625B2

(12) United States Patent
Moore

(10) Patent No.: US 11,293,625 B2
(45) **Date of Patent: *Apr. 5, 2022**

(54) REMOVABLE MOUNTING DEVICE AND PACKAGING SYSTEM FOR LIGHTING PRODUCT

(71) Applicant: Scott David Moore, Franklin, FL (US)

(72) Inventor: Scott David Moore, Franklin, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/778,633

(22) Filed: Jan. 31, 2020

(65) Prior Publication Data

US 2020/0166199 A1 May 28, 2020

Related U.S. Application Data

(63) Continuation of application No. 15/885,304, filed on Jan. 31, 2018, now Pat. No. 10,551,039.

(60) Provisional application No. 62/452,640, filed on Jan. 31, 2017.

(51) Int. Cl.

| | |
|---|---|
| ***F21V 17/06*** | (2006.01) |
| ***F21V 21/005*** | (2006.01) |
| ***F21V 21/02*** | (2006.01) |
| ***F21V 23/00*** | (2015.01) |
| ***F21S 2/00*** | (2016.01) |
| ***F21S 4/26*** | (2016.01) |
| ***F21V 17/10*** | (2006.01) |
| ***F21V 21/088*** | (2006.01) |
| ***F21V 23/06*** | (2006.01) |
| *F21Y 115/10* | (2016.01) |
| *F21Y 103/10* | (2016.01) |
| *F21W 131/406* | (2006.01) |

(52) U.S. Cl.

CPC ..... *F21V 17/06* (2013.01); *F21S 2/005* (2013.01); *F21S 4/26* (2016.01); *F21V 17/108* (2013.01); *F21V 21/005* (2013.01); *F21V 21/025* (2013.01); *F21V 21/088* (2013.01); *F21V 23/002* (2013.01); *F21V 23/06* (2013.01); *F21W 2131/406* (2013.01); *F21Y 2103/10* (2016.08); *F21Y 2115/10* (2016.08)

(58) Field of Classification Search

CPC ..... F21V 21/025; F21V 17/06; F21V 17/108; F21V 21/088; F21S 4/26; F21S 2/005; F21S 4/20; F21S 4/22; F21W 2131/406; F21Y 2103/10

USPC ..... 362/146

See application file for complete search history.

(56) References Cited

U.S. PATENT DOCUMENTS

| | | | | |
|---|---|---|---|---|
| 5,430,627 A * | 7/1995 | Nagano | F21V 15/013 | 362/146 |
| 5,918,962 A * | 7/1999 | Nagano | F21V 15/013 | 362/146 |
| 6,076,936 A * | 6/2000 | George | F21S 8/032 | 362/146 |

(Continued)

*Primary Examiner* — Rajarshi Chakraborty
*Assistant Examiner* — Michael Chiang
(74) *Attorney, Agent, or Firm* — Daniel S. Polley, P.A.

(57) ABSTRACT

A modular lighting strip mounting system provides for modular linear and curved lighting solutions. The system can generally comprise a bracket that is designed/configured to hold an LED lighting product and allows a user to mount the bracket with LED product to entertainment stages, platforms, risers, etc. relatively quickly and easily. Several different mounting embodiments are provided allowing lighting strips to be quickly secured to stages as well as to truss structures.

17 Claims, 41 Drawing Sheets

(56) References Cited

U.S. PATENT DOCUMENTS

| | | | | |
|---|---|---|---|---|
| 6,361,186 | B1 * | 3/2002 | Slayden | F21V 3/02 362/241 |
| 7,048,413 | B2 * | 5/2006 | Fan | G09F 13/22 362/224 |
| 7,213,941 | B2 * | 5/2007 | Sloan | F21V 21/005 362/20 |
| 7,506,997 | B1 * | 3/2009 | Eriksson | H05K 1/0274 362/235 |
| 7,857,482 | B2 * | 12/2010 | Reo | F21S 4/28 362/225 |
| 7,931,385 | B1 * | 4/2011 | Smith | F21V 33/006 362/145 |
| 9,388,969 | B2 * | 7/2016 | Doubek | F21V 21/04 |
| 2011/0310604 | A1 * | 12/2011 | Shimizu | F21K 9/27 362/235 |
| 2012/0147610 | A1 * | 6/2012 | Ransvi | F21V 21/0808 362/382 |
| 2014/0109447 | A1 * | 4/2014 | Kirschner | G09F 7/18 40/606.01 |
| 2017/0292663 | A1 * | 10/2017 | Pearson | F21V 5/04 |
| 2018/0156400 | A1 * | 6/2018 | Lomenzo | F21S 8/033 |
| 2018/0306413 | A1 * | 10/2018 | Tremaine | F21S 4/22 |

* cited by examiner

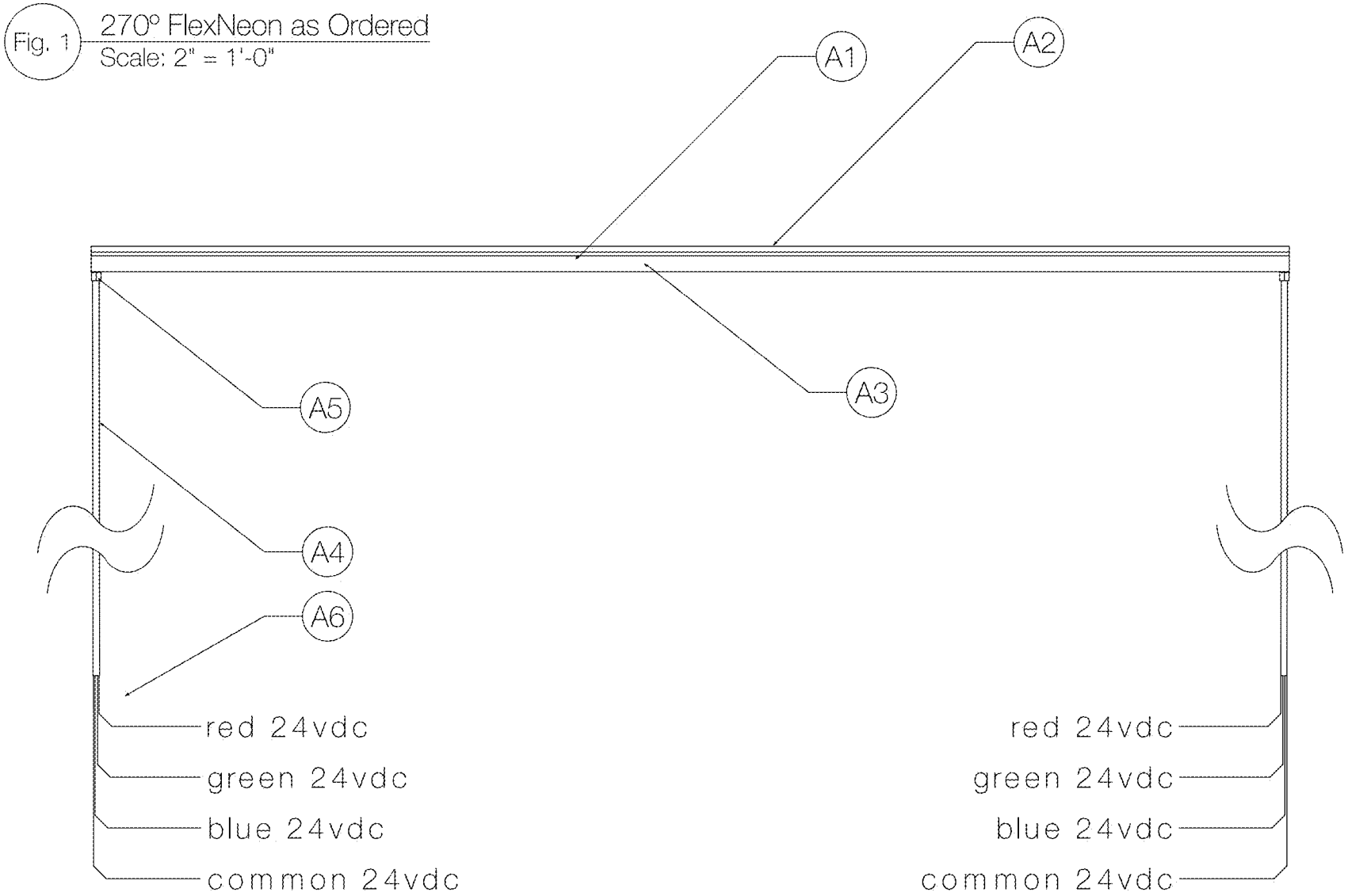
Fig. 1 270° FlexNeon as Ordered
Scale: 2" = 1'-0"

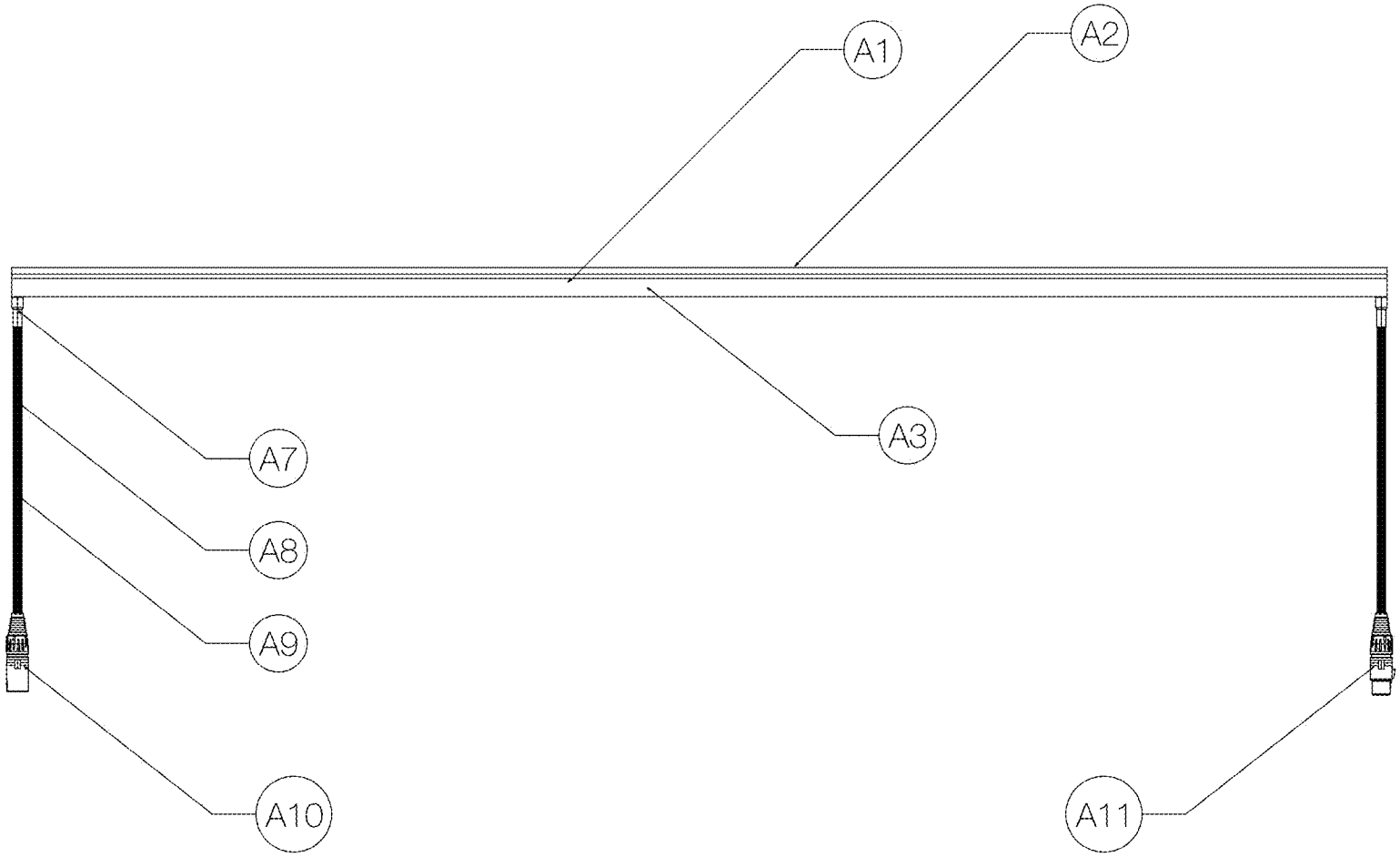
Fig. 2 270° FlexNeon Prepared
Scale: 2" = 1'-0"

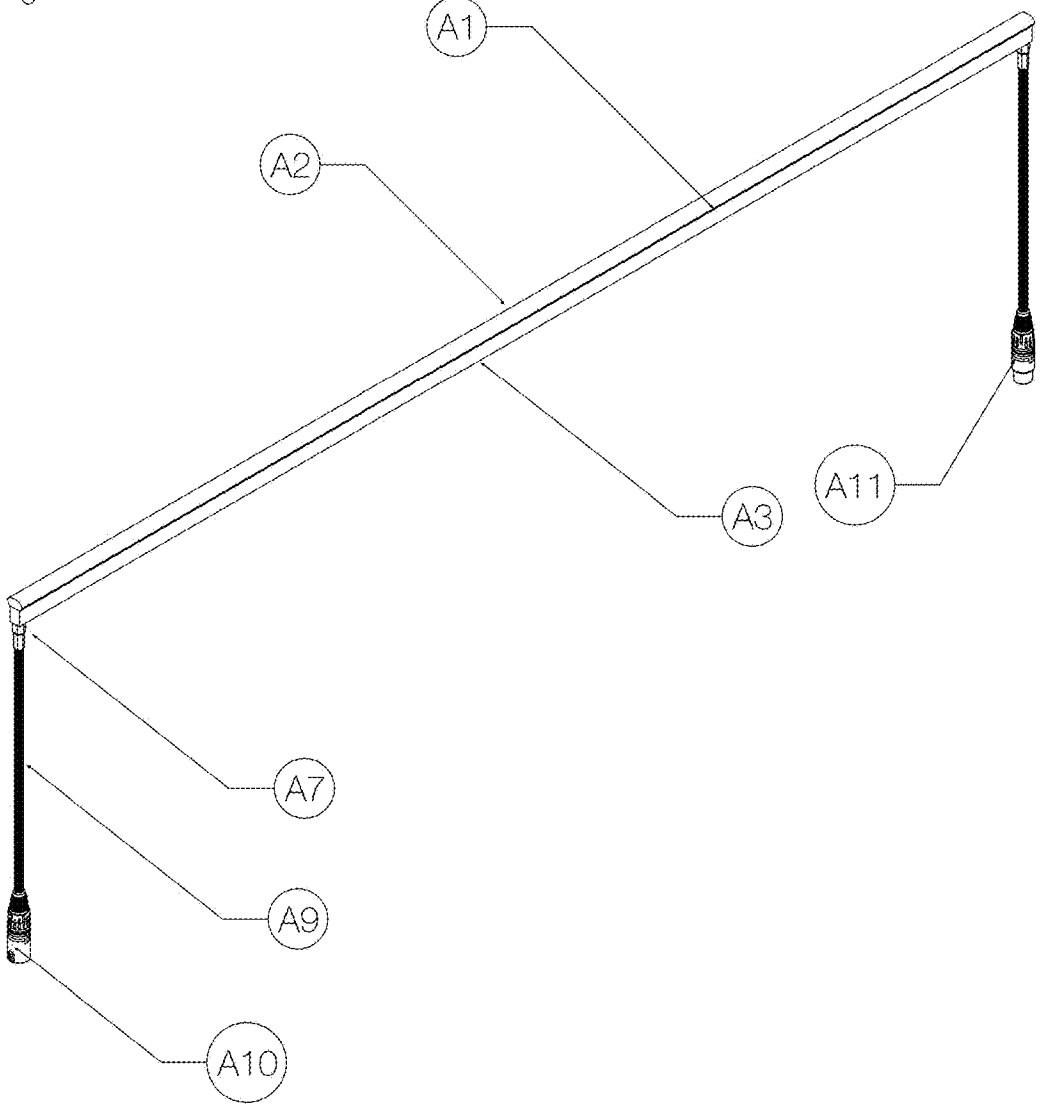
Fig. 3 270° FlexNeon Prepared Isometric View
Scale: 2" = 1'-0"

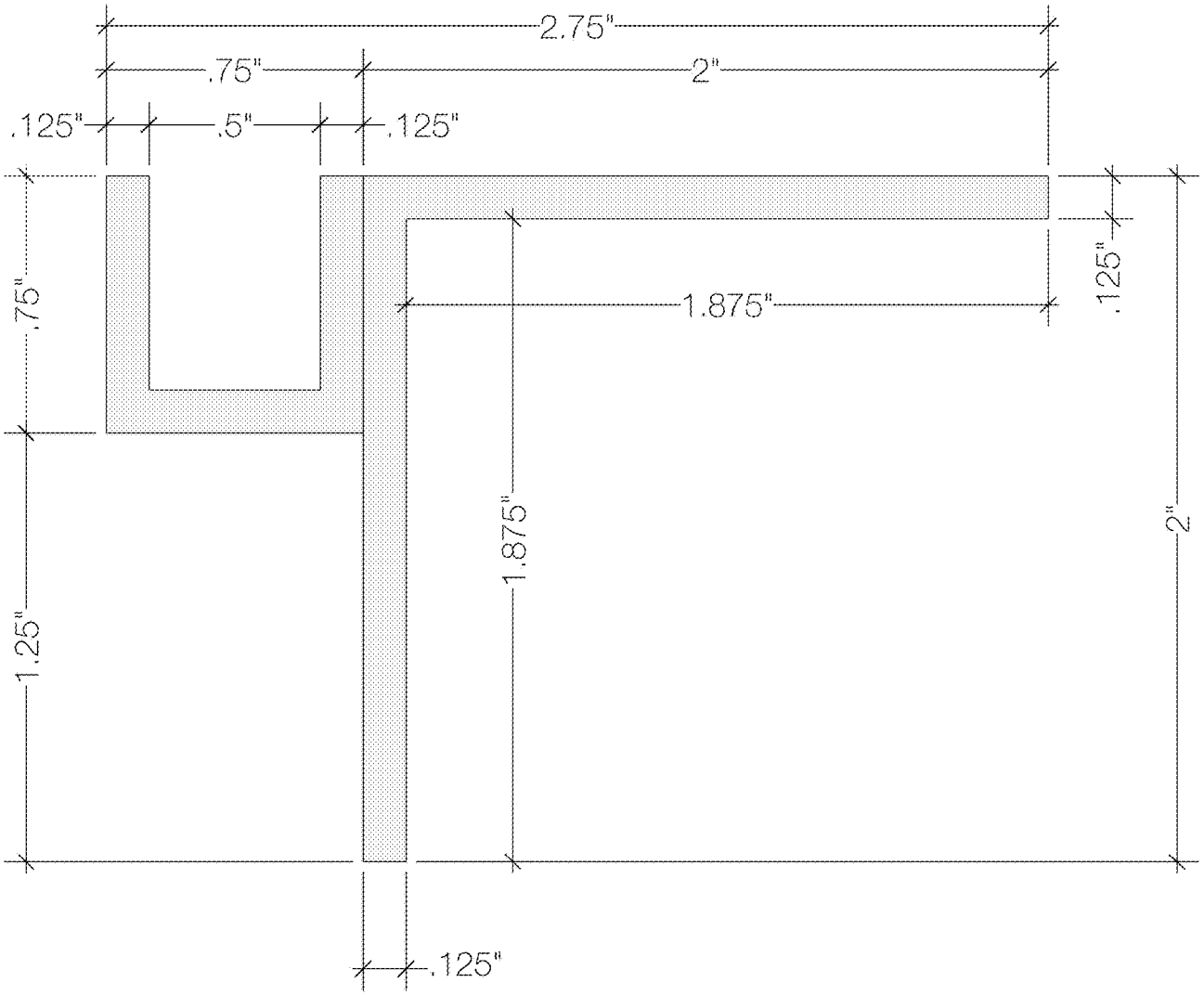
Fig. 4 Stage Mount Prototype Extrusion
Scale: 2X

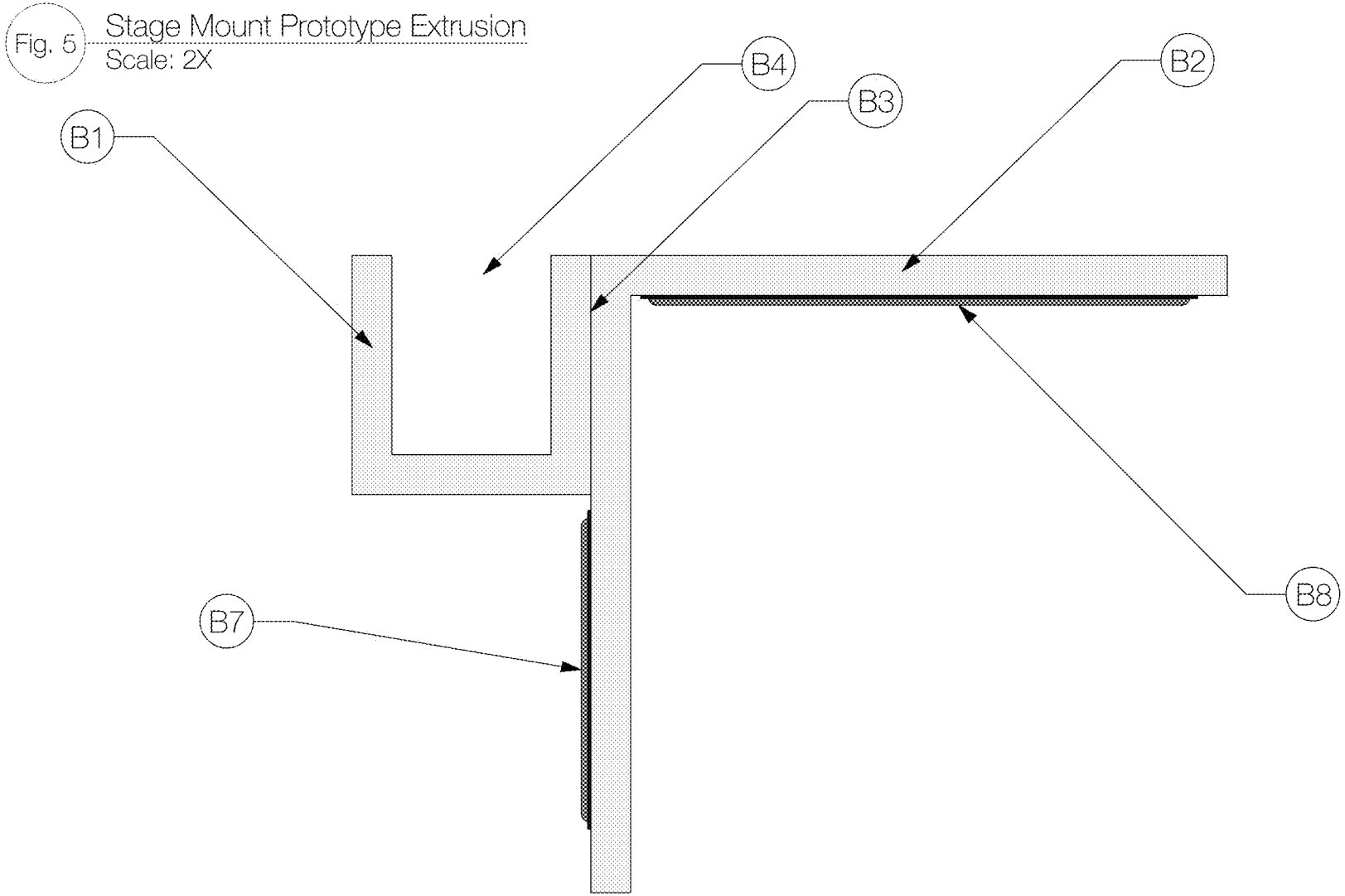
Fig. 5 Stage Mount Prototype Extrusion
Scale: 2X

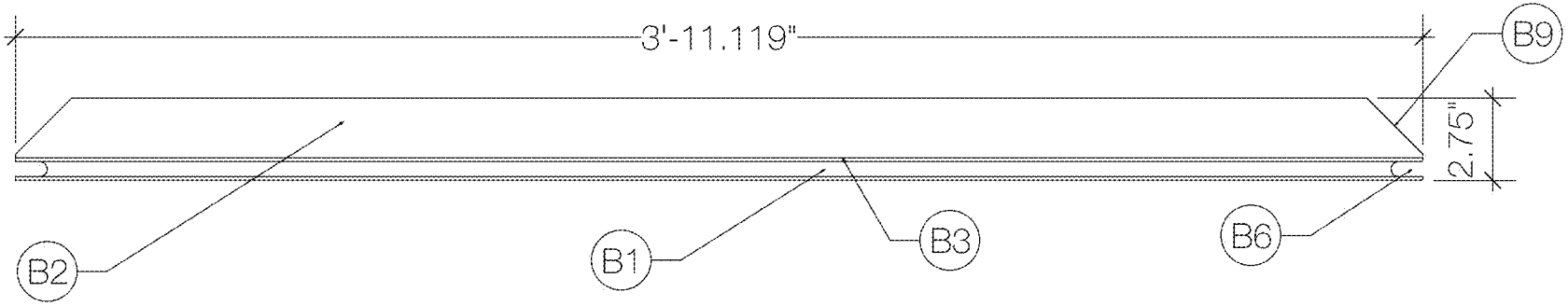
Fig. 6 Stage Mount Prototype Extrusion Top View
Scale: 2" = 1'-0"
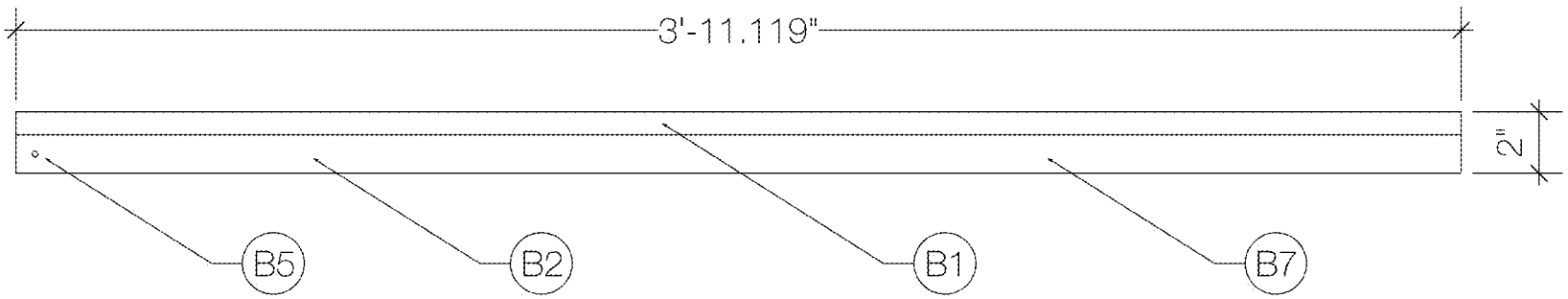
Fig. 7 Stage Mount Prototype Extrusion Front View
Scale: 2" = 1'-0"

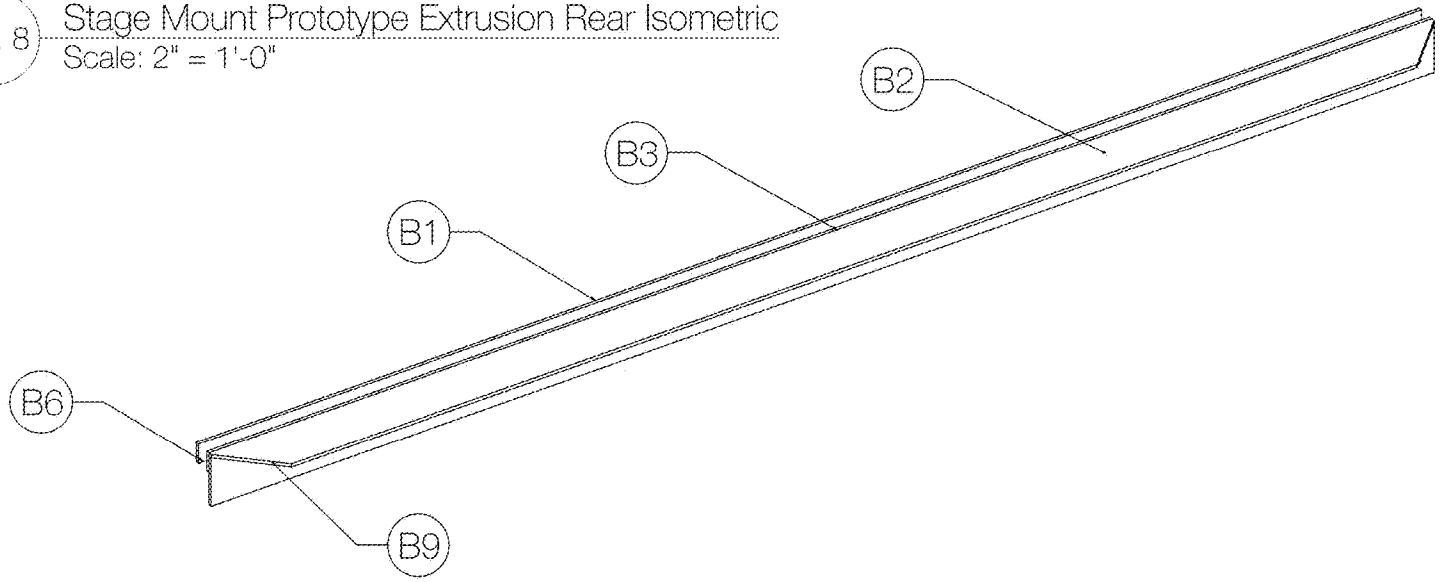
Fig. 8 Stage Mount Prototype Extrusion Rear Isometric
Scale: 2" = 1'-0"
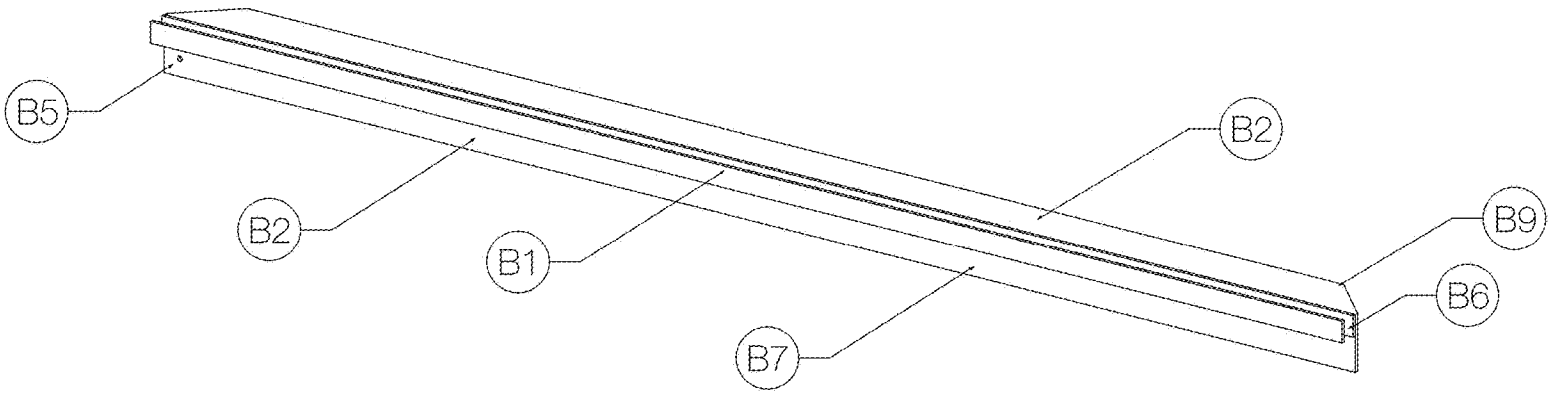
Fig. 9 Stage Mount Prototype Extrusion Front Isometric
Scale: 2" = 1'-0"

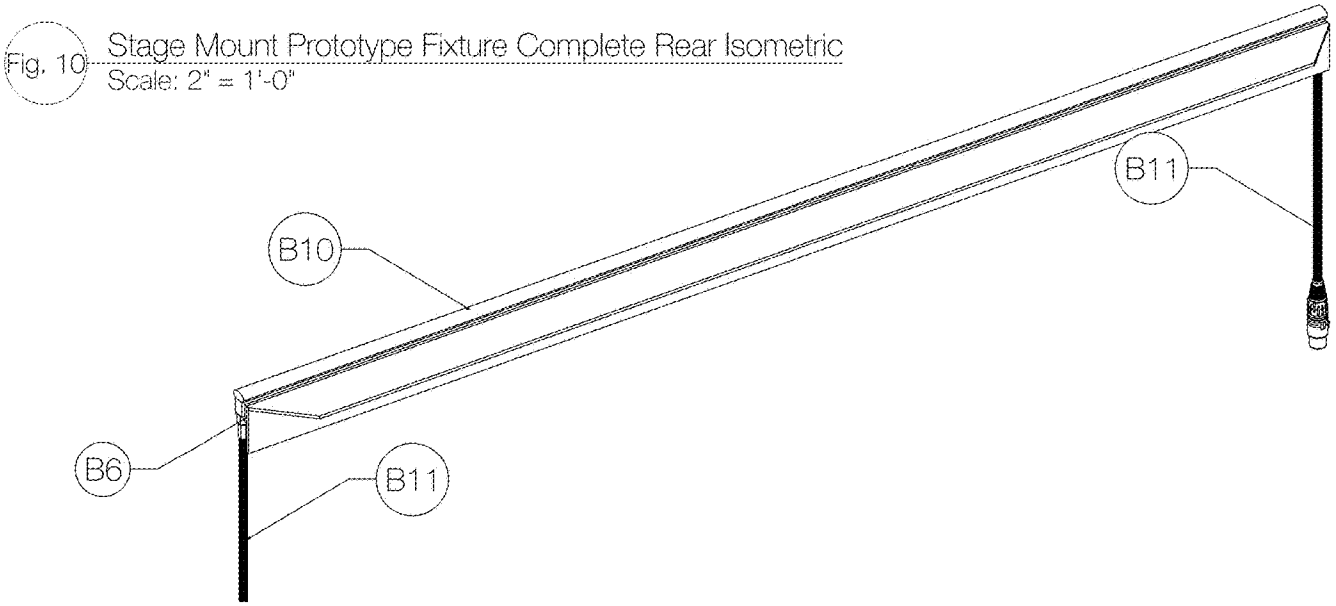
Fig. 10 Stage Mount Prototype Fixture Complete Rear Isometric
Scale: 2" = 1'-0"
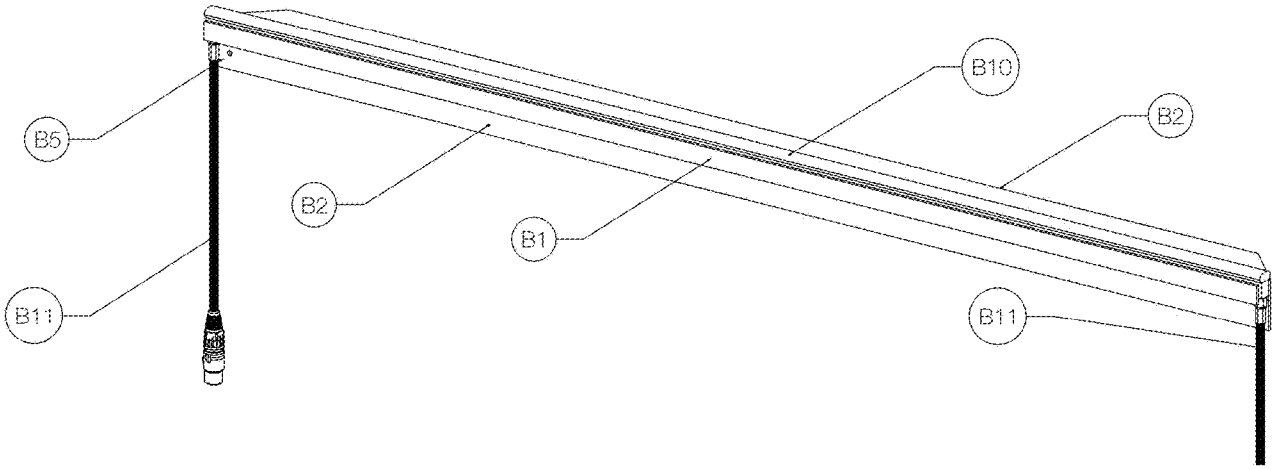
Fig. 11 Stage Mount Prototype Fixture Complete Front Isometric
Scale: 2" = 1'-0"

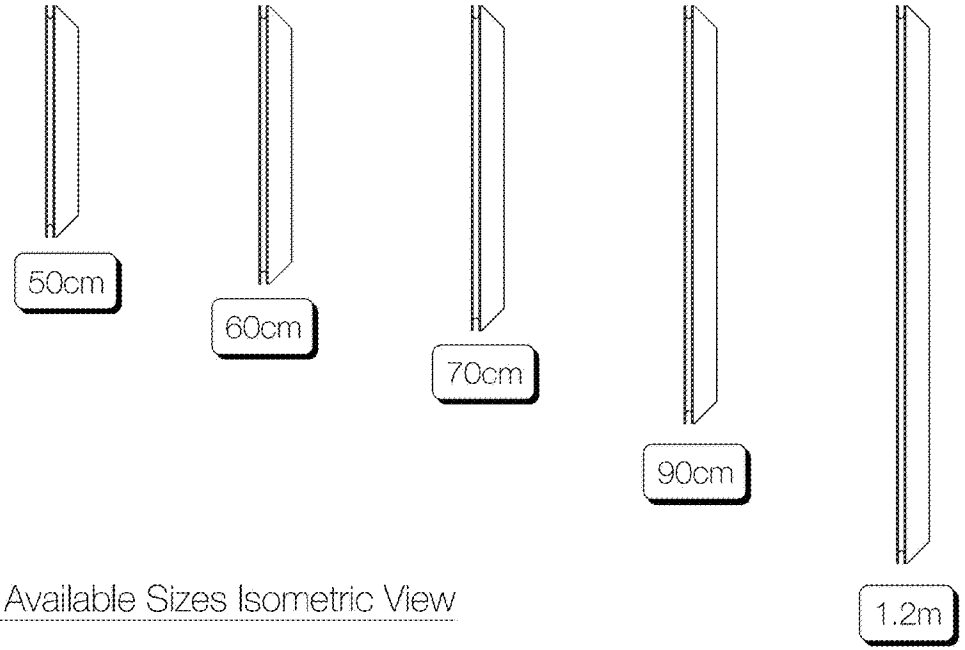
Fig. 12 Stage Mount Prototype Fixture Available Sizes Top View
Scale: 3/4" = 1'-0"
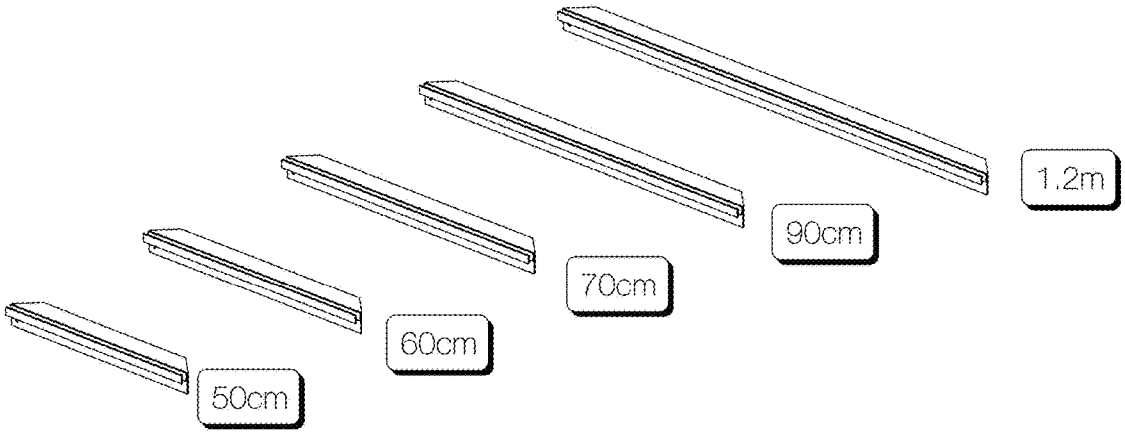
Fig. 13 Stage Mount Prototype Fixture Available Sizes Isometric View
Scale: 3/4" = 1'-0"

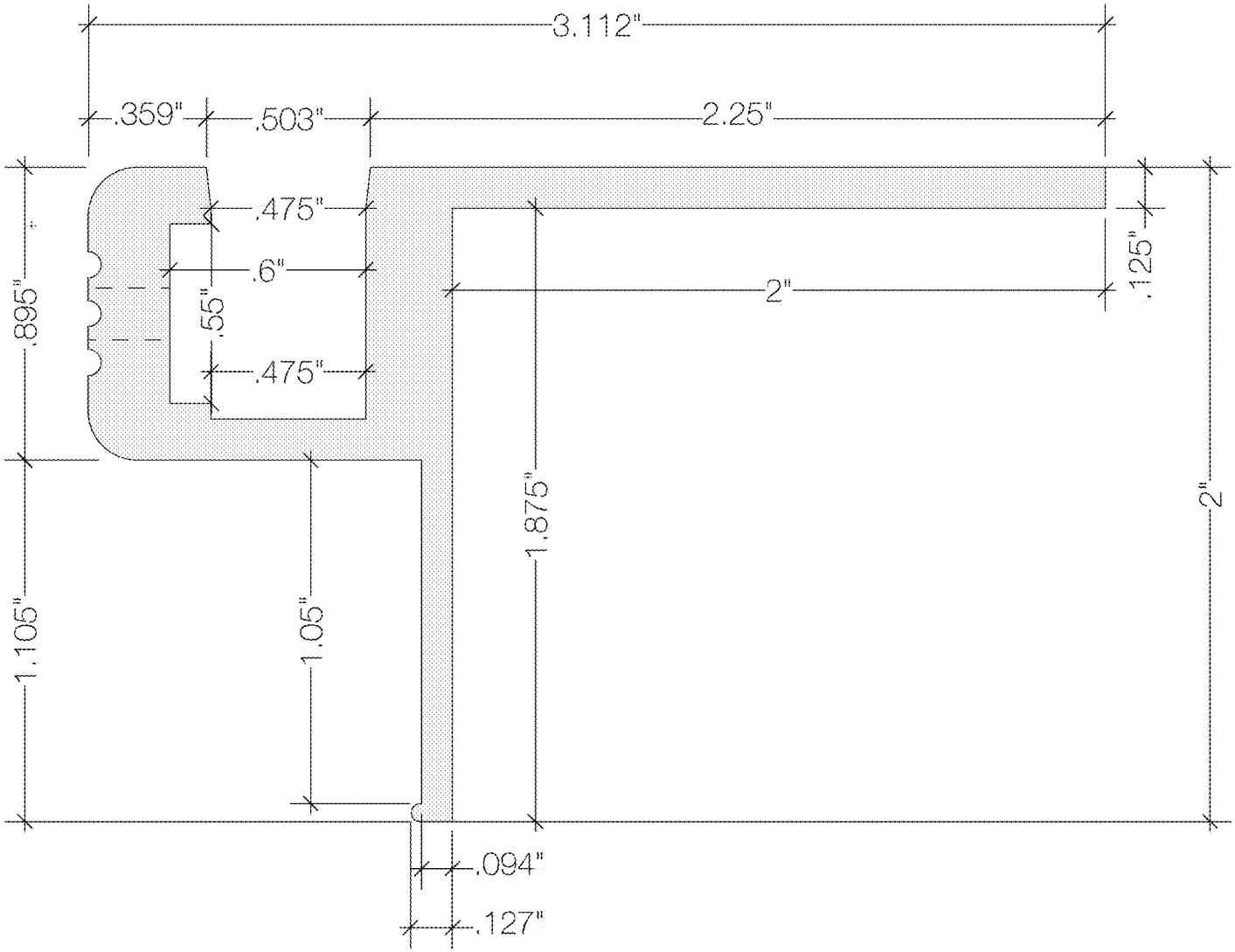
Fig. 14 Stage Mount Custom Extrusion
Scale: 2X

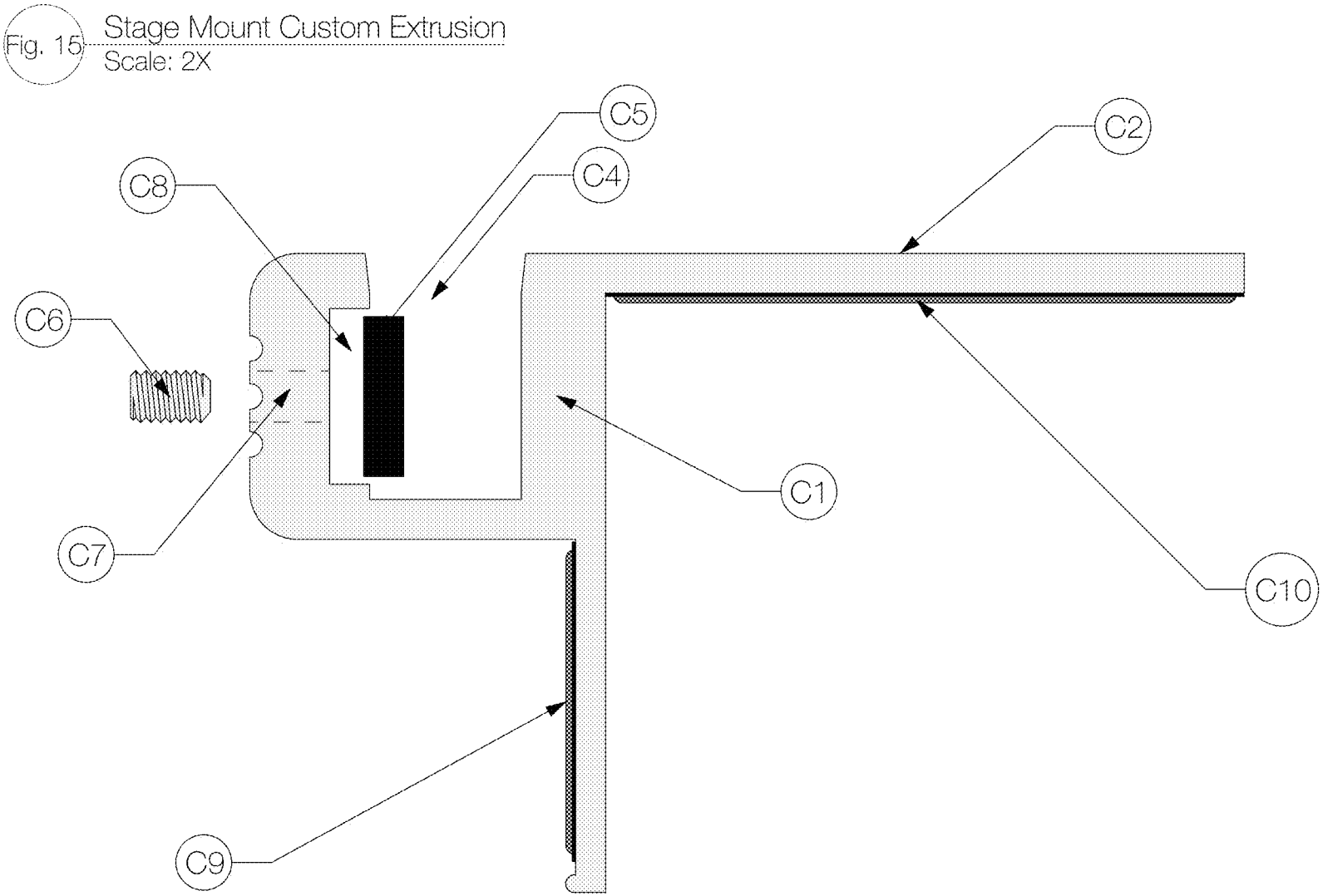
Fig. 15 Stage Mount Custom Extrusion
Scale: 2X

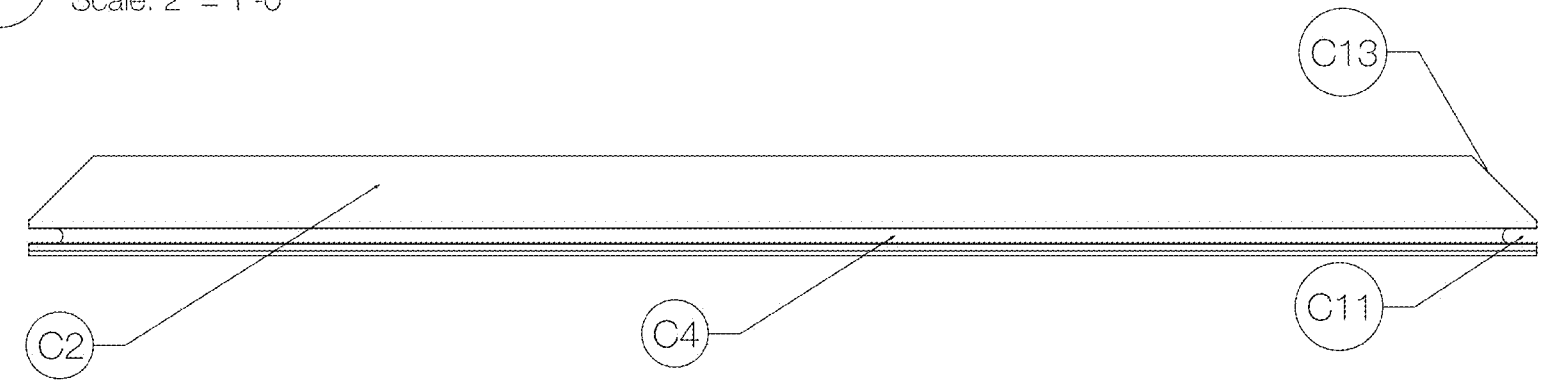
Fig. 16 Stage Mount Custom Extrusion Top View
Scale: 2" = 1'-0"
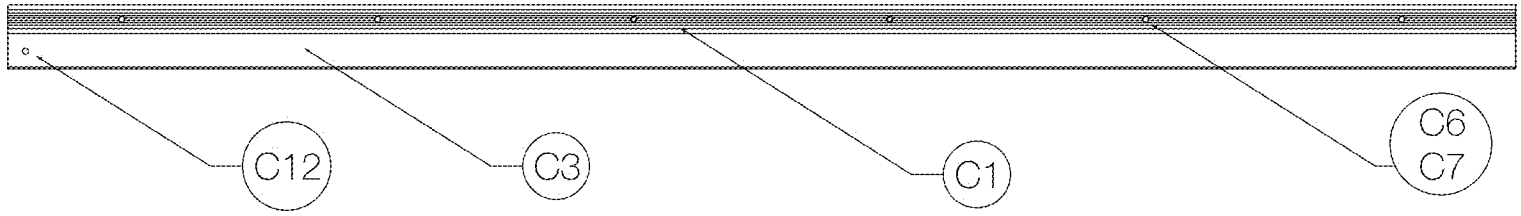
Fig. 17 Stage Mount Custom Extrusion Front View
Scale: 2" = 1'-0"

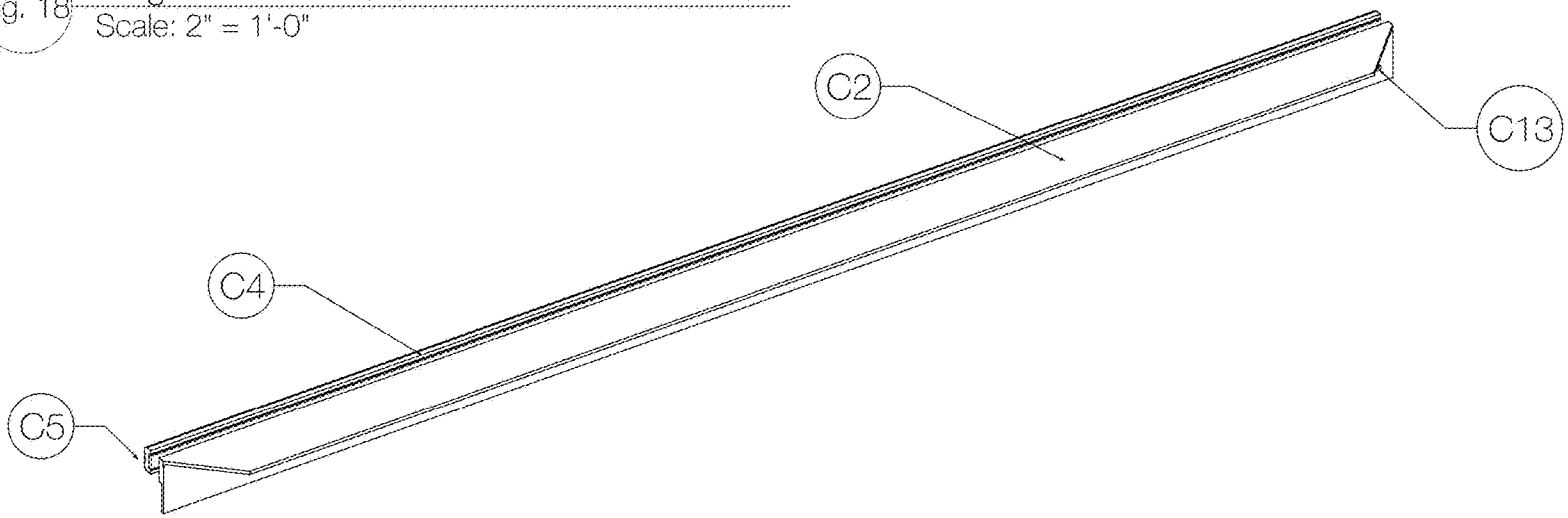
Fig. 18 Stage Mount Custom Extrusion Rear Isometric
Scale: 2" = 1'-0"
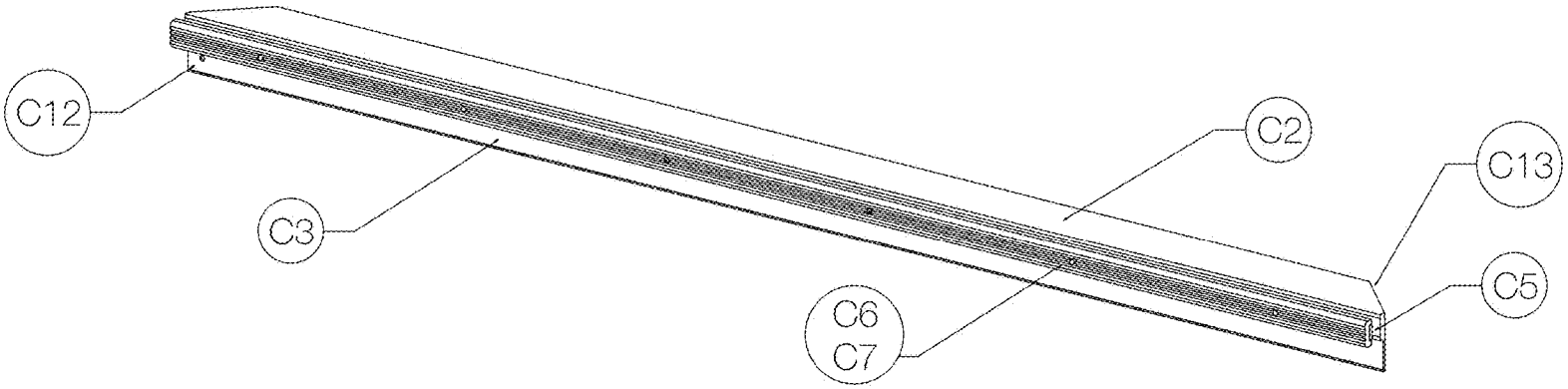
Fig. 19 Stage Mount Custom Extrusion Front Isometric
Scale: 2" = 1'-0"

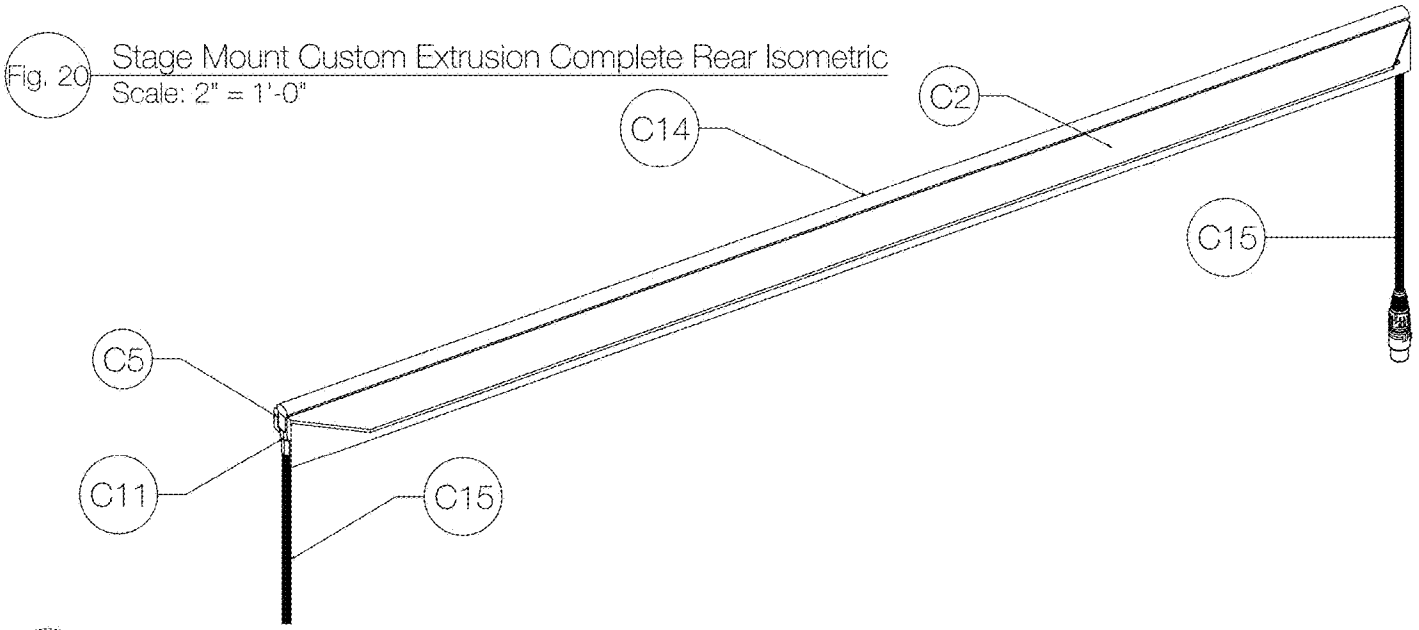
Fig. 20 Stage Mount Custom Extrusion Complete Rear Isometric
Scale: 2" = 1'-0"
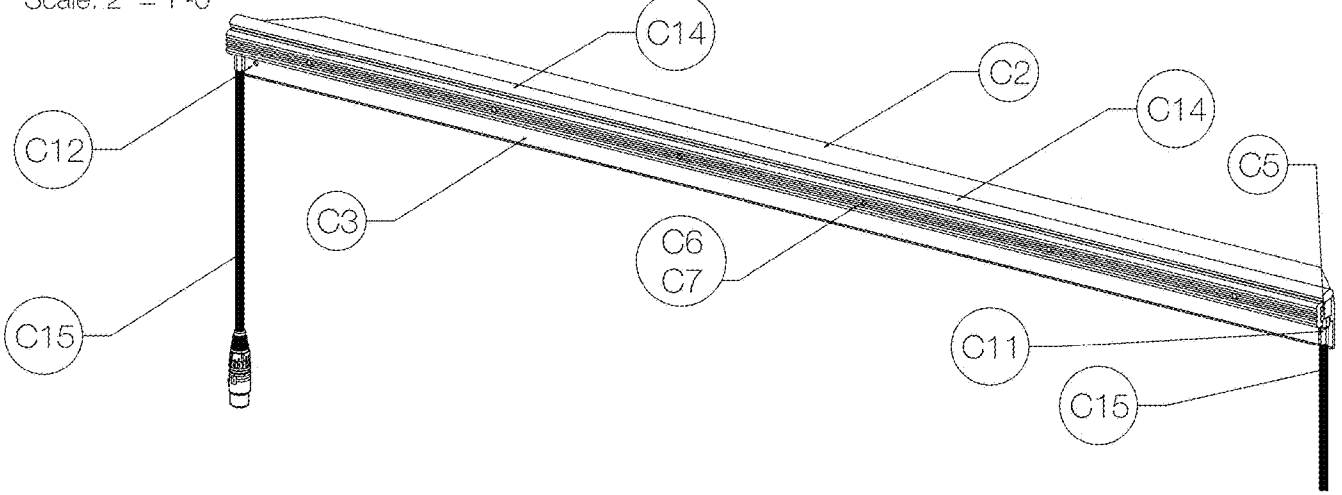
Fig. 21 Stage Mount Prototype Fixture Complete Front Isometric
Scale: 2" = 1'-0"

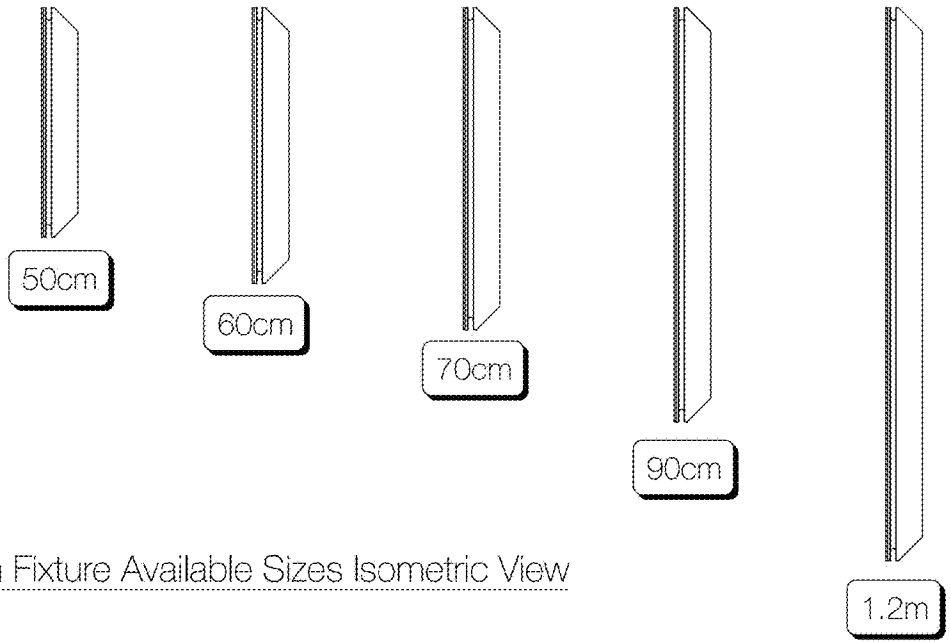
Fig. 22 Stage Mount Custom Fixture Available Sizes Top View
Scale: 3/4" = 1'-0"
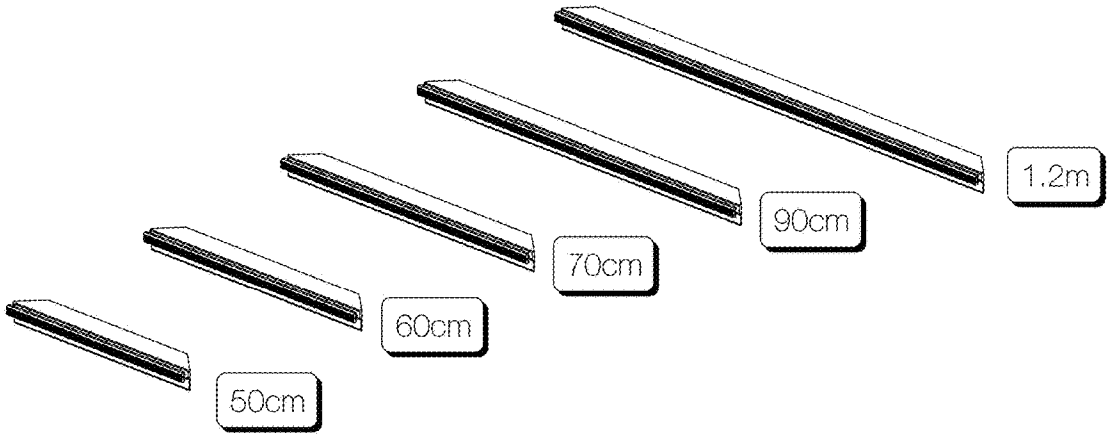
Fig. 23 Stage Mount Custom Fixture Available Sizes Isometric View
Scale: 3/4" = 1'-0"

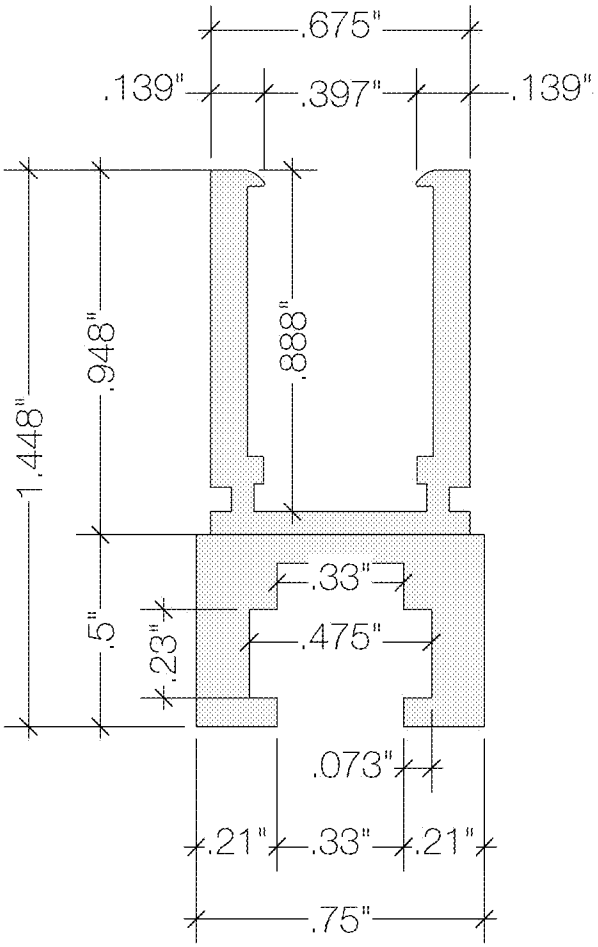
Fig. 24 Truss Mount Prototype Extrusion
Scale: 2X

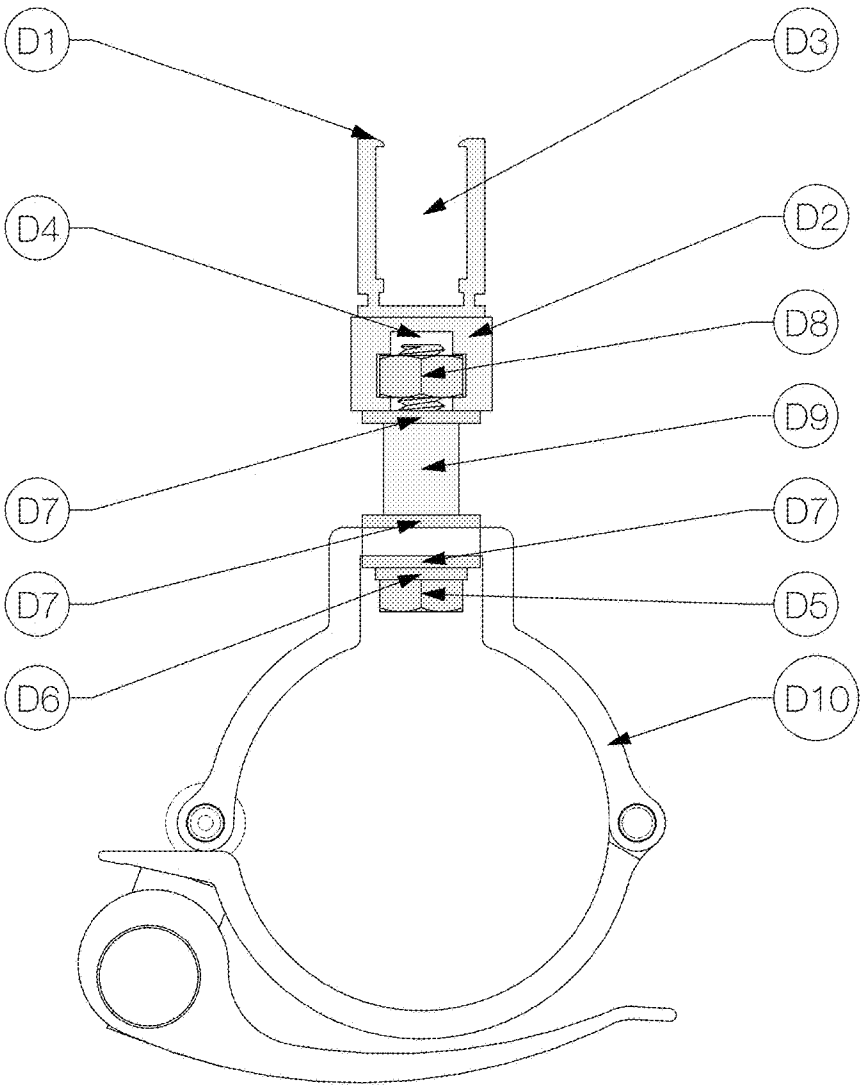
Fig. 25 Truss Mount Prototype Extrusion
Scale: Actual Size

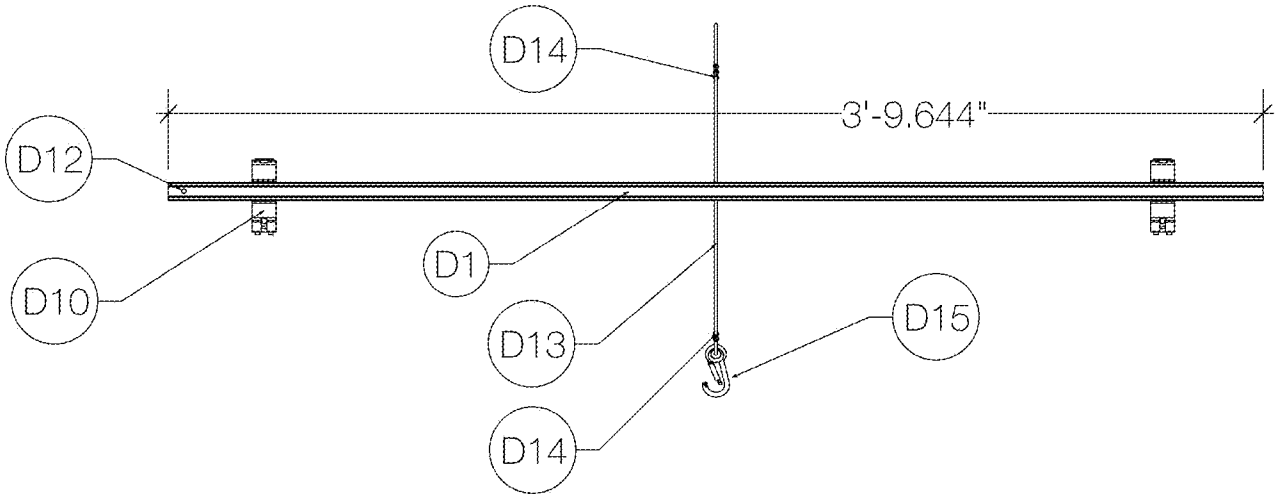
Fig. 26 Truss Mount Prototype Extrusion Top View
Scale: 1 1/2" = 1'-0"
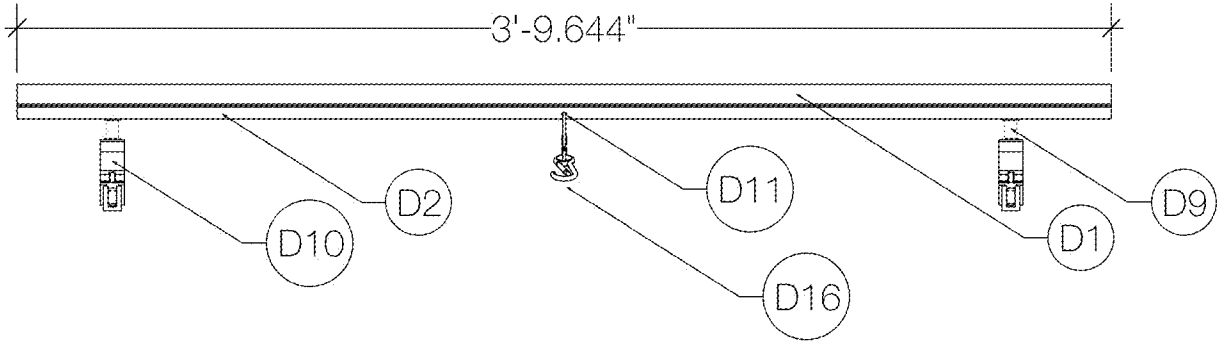
Fig. 27 Truss Mount Prototype Extrusion Front View
Scale: 1 1/2" = 1'-0"

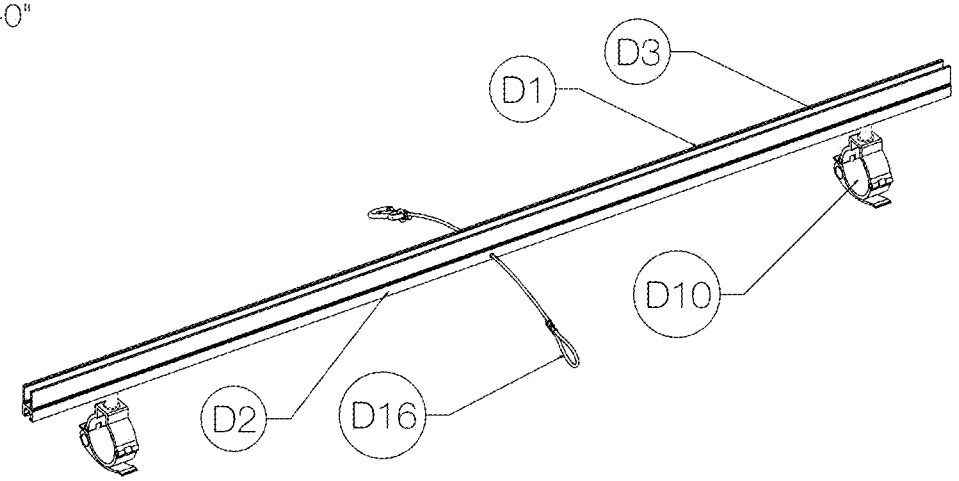
Fig. 28 Truss Mount Prototype Extrusion Rear Isometric
Scale: 1 1/2" = 1'-0"
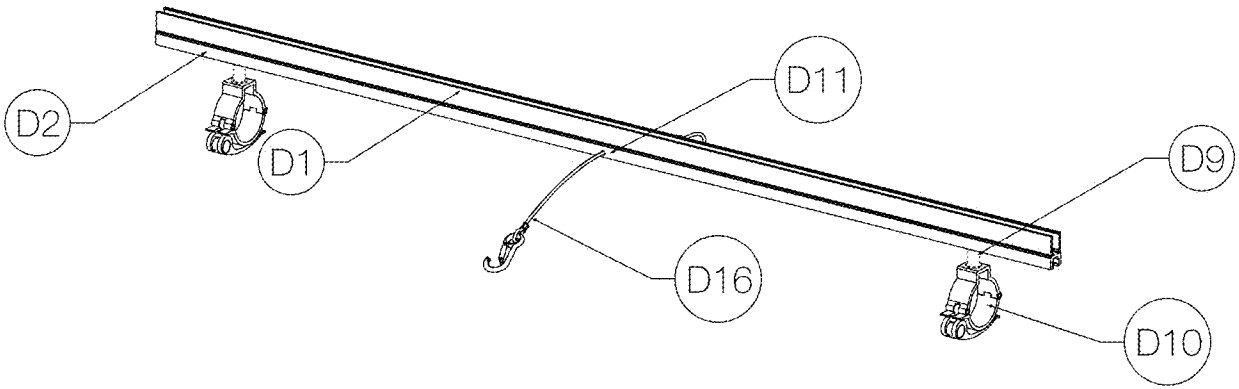
Fig. 29 Truss Mount Prototype Extrusion Front Isometric
Scale: 1 1/2" = 1'-0"

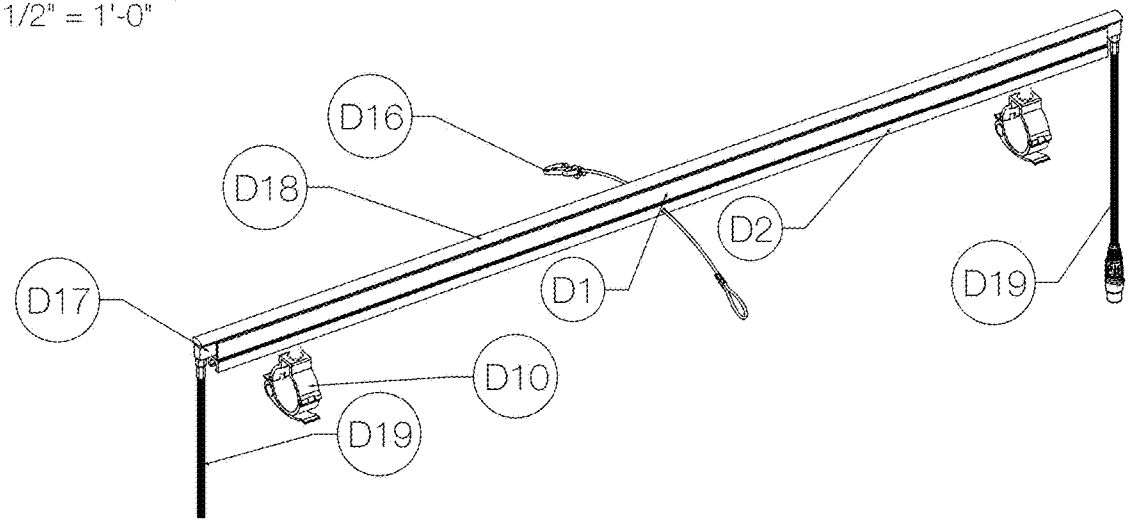
Fig. 30 Truss Mount Prototype Fixture Complete Rear Isometric
Scale: 1 1/2" = 1'-0"
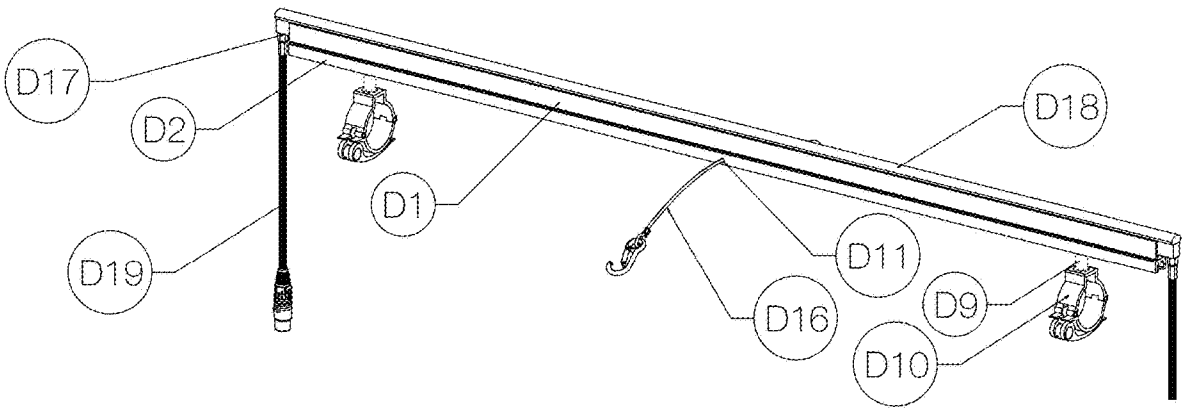
Fig. 31 Truss Mount Prototype Fixture Complete Front Isometric
Scale: 1 1/2" = 1'-0"

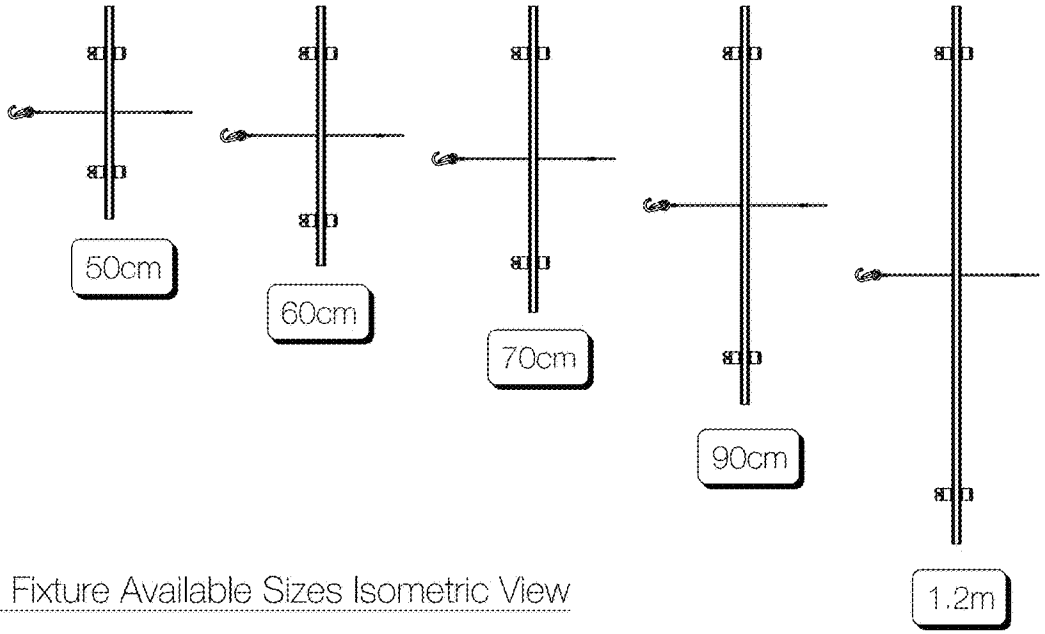
Fig. 32 Truss Mount Prototype Fixture Available Sizes Top View
Scale: 3/4" = 1'-0"
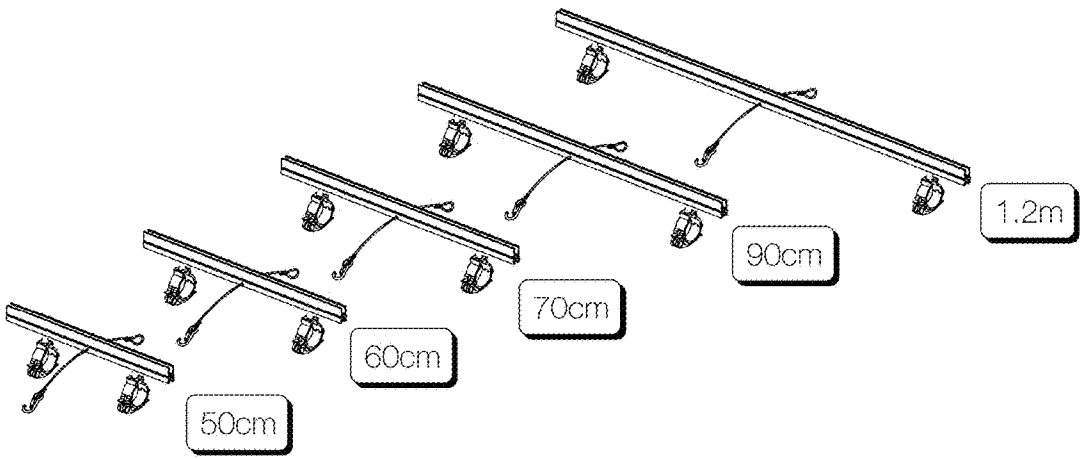
Fig. 33 Truss Mount Prototype Fixture Available Sizes Isometric View
Scale: 3/4" = 1'-0"

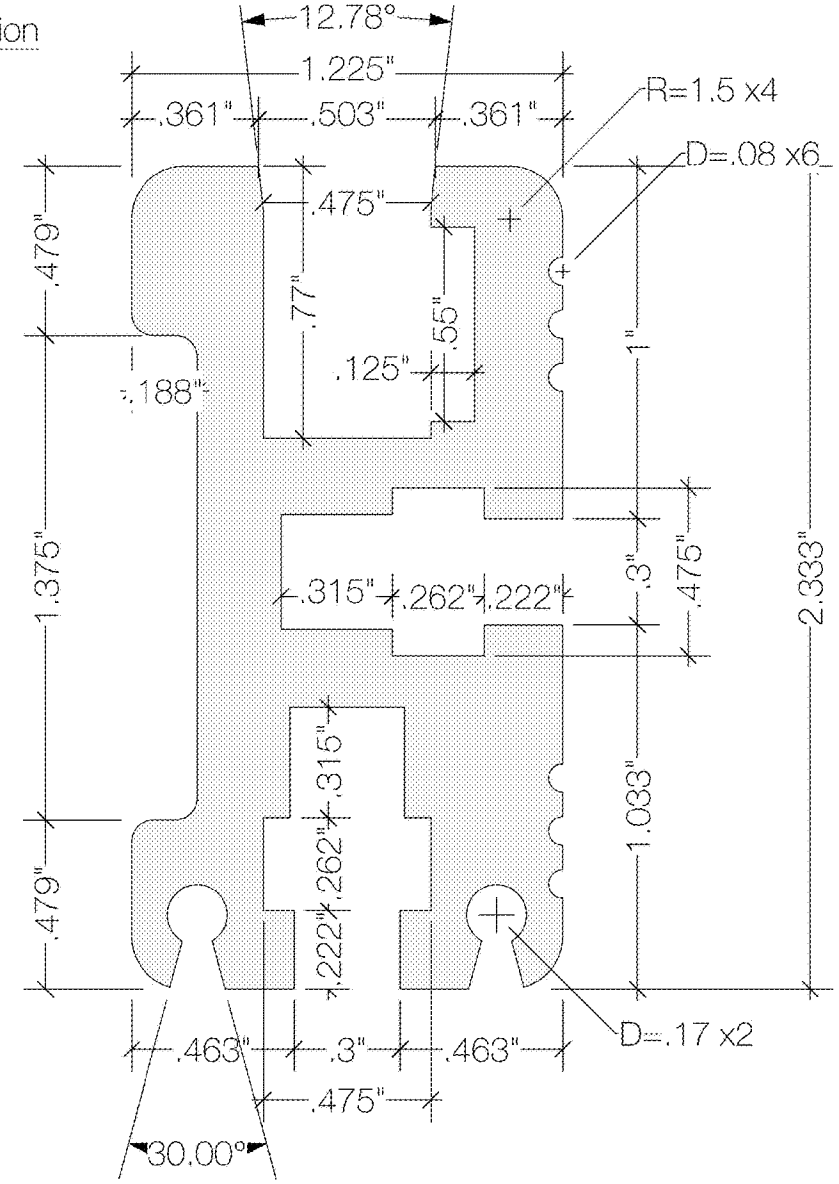
Fig. 34 Truss Mount Custom Extrusion
Scale: 2X

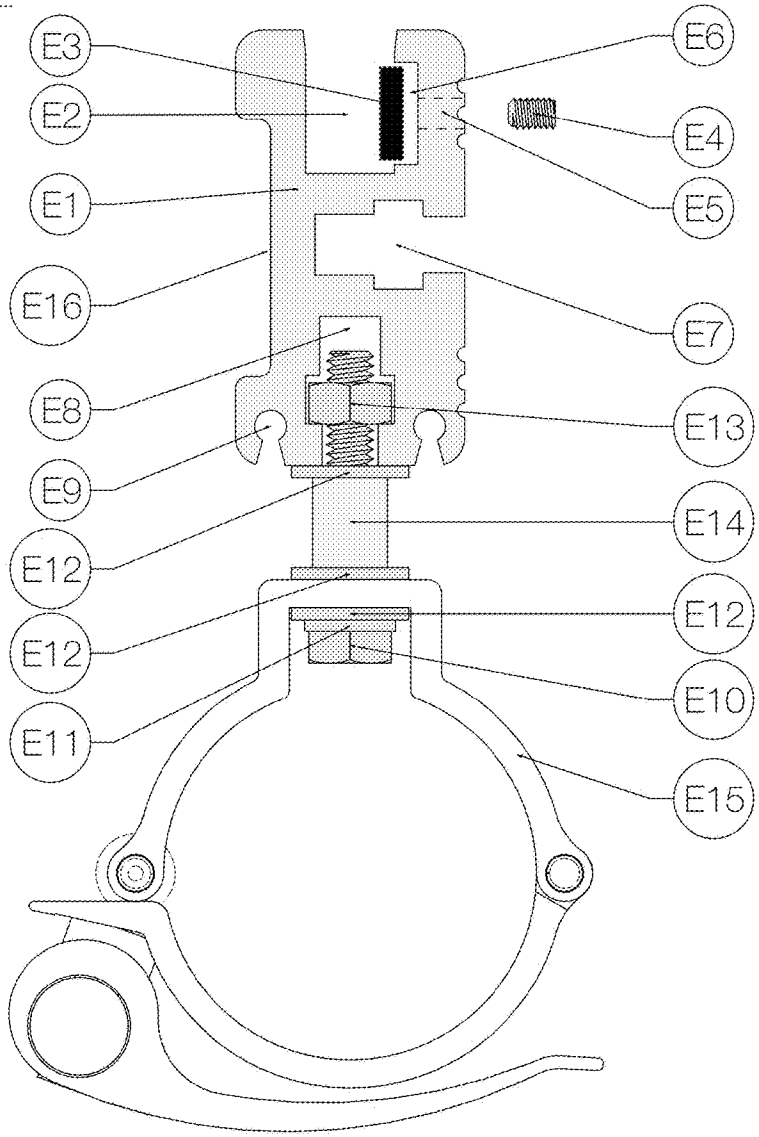
Fig. 35 Truss Mount Prototype Extrusion
Scale: Actual Size

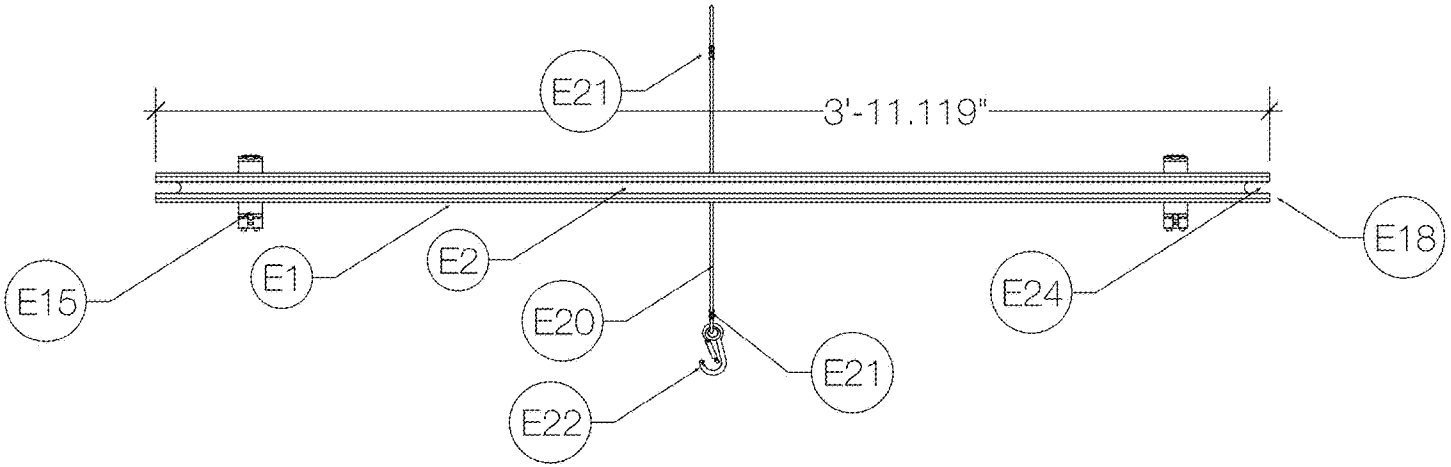
Fig. 36 Truss Mount Custom Extrusion Top View
Scale: 1 1/2" = 1'-0"
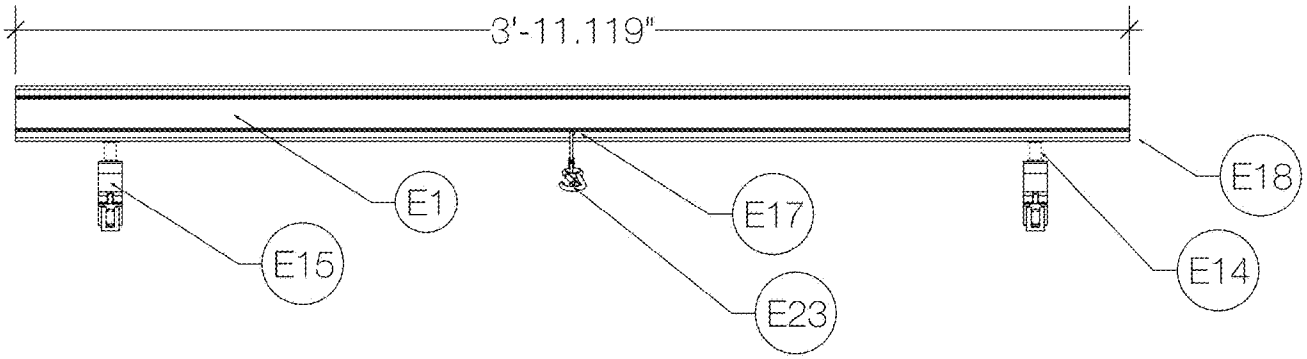
Fig. 37 Truss Mount Custom Extrusion Front View
Scale: 1 1/2" = 1'-0"

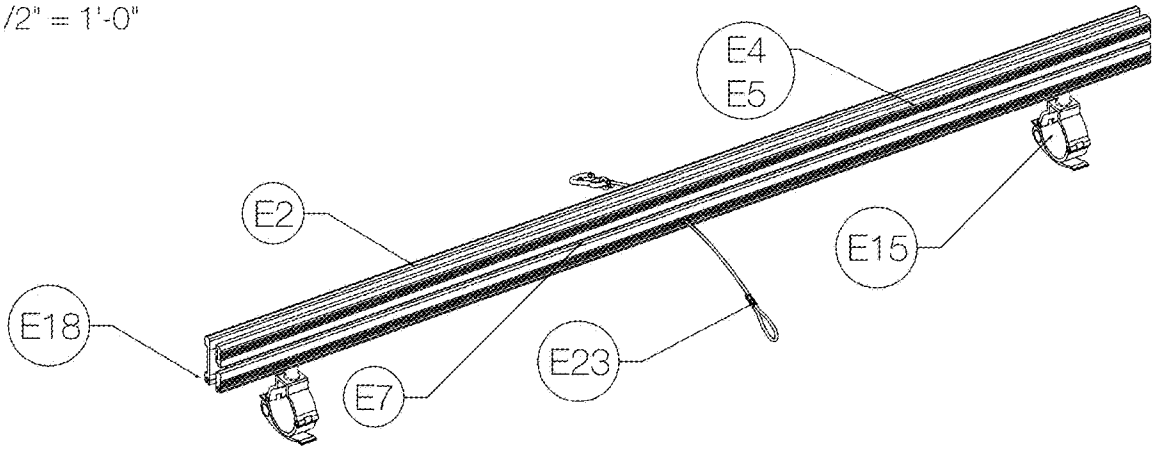
Fig. 38 Truss Mount Prototype Extrusion Rear Isometric
Scale: 1 1/2" = 1'-0"
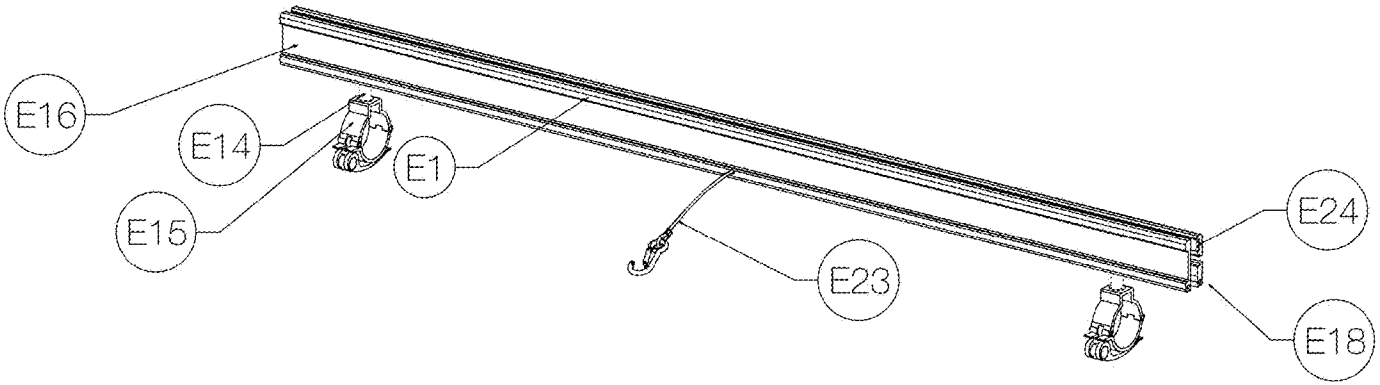
Fig. 39 Truss Mount Prototype Extrusion Front Isometric
Scale: 1 1/2" = 1'-0"

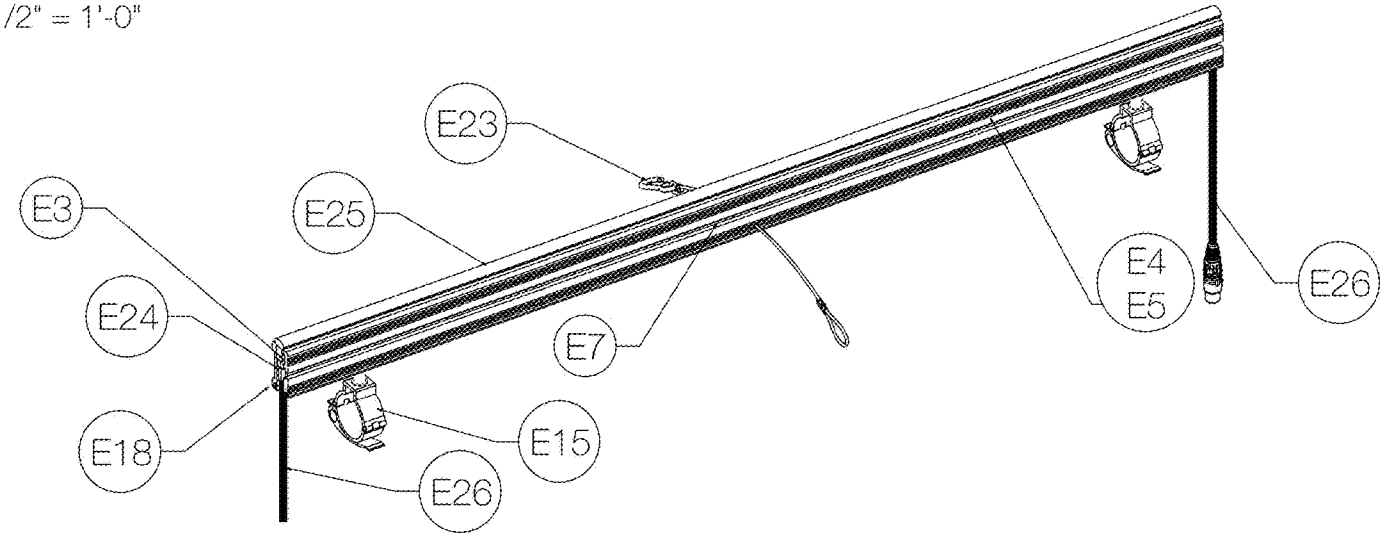
Fig. 40 Truss Mount Custom Fixture Complete Rear Isometric
Scale: 1 1/2" = 1'-0"
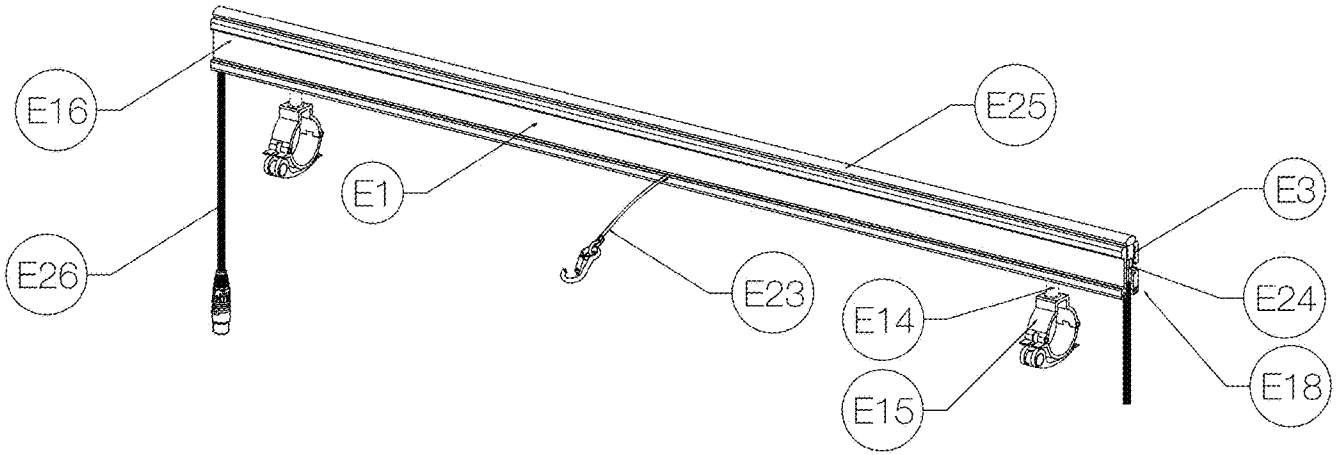
Fig. 41 Truss Mount Custom Fixture Complete Front Isometric
Scale: 1 1/2" = 1'-0"

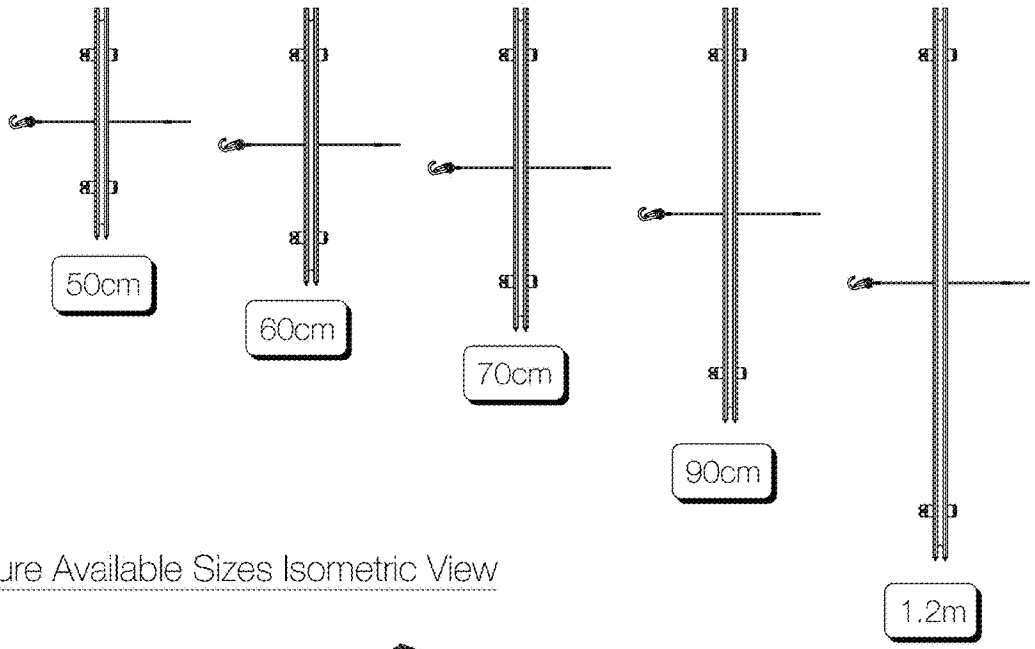
Fig. 42 Truss Mount Custom Fixture Available Sizes Top View
Scale: 3/4" = 1'-0"
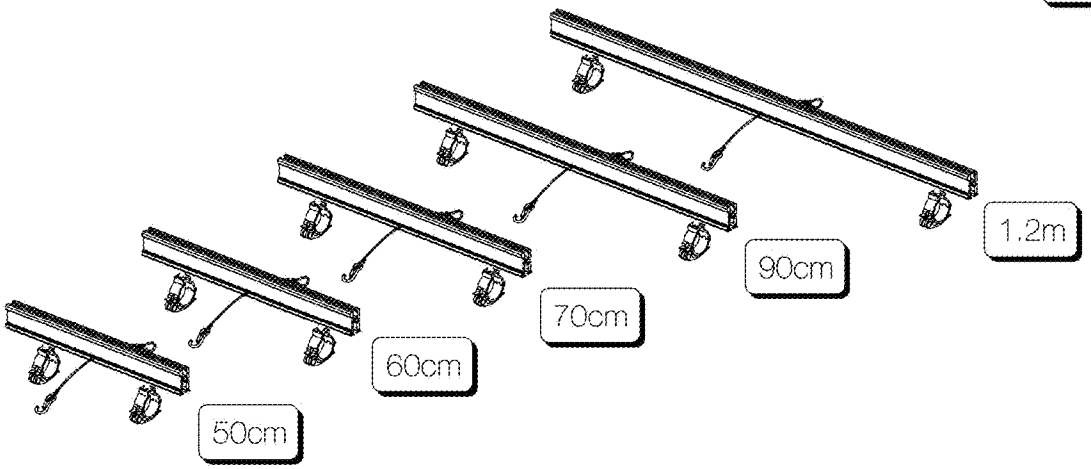
Fig. 43 Truss Mount Custom Fixture Available Sizes Isometric View
Scale: 3/4" = 1'-0"

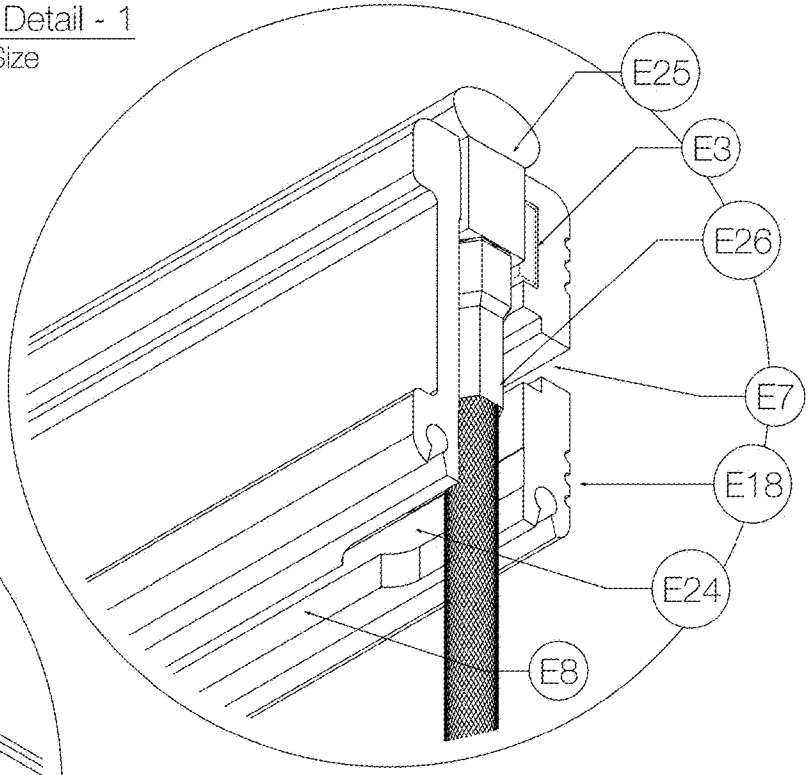
Fig. 44 Locating Pin Detail - 1
Scale: Actual Size
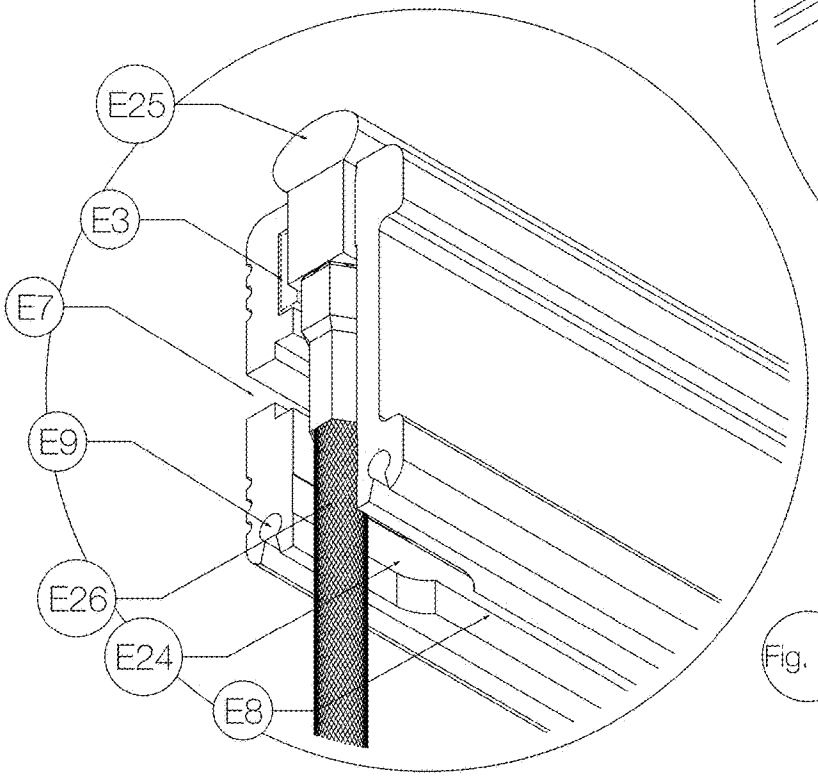
Fig. 45 Locating Pin Detail -2
Scale: Actual Size

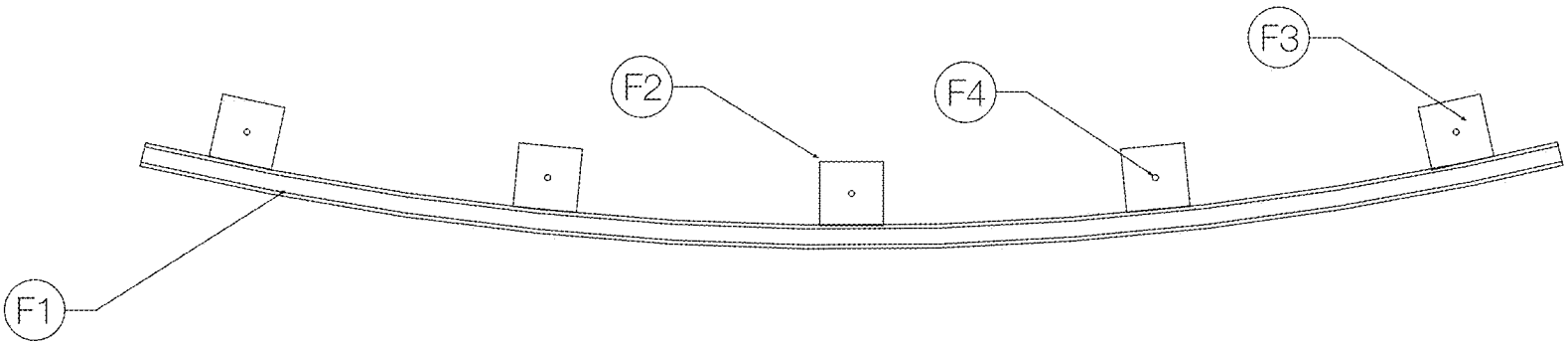
Fig. 46 Curved Extrusion Top View
Scale: 2" = 1'-0"
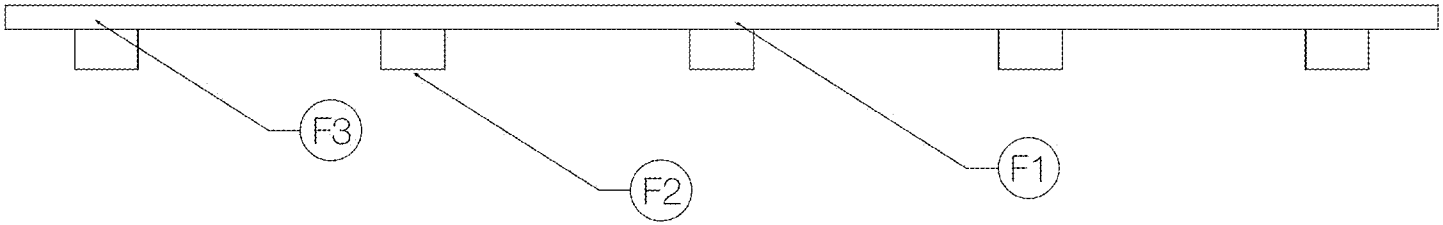
Fig. 47 Curved Extrusion Front View
Scale: 2" = 1'-0"

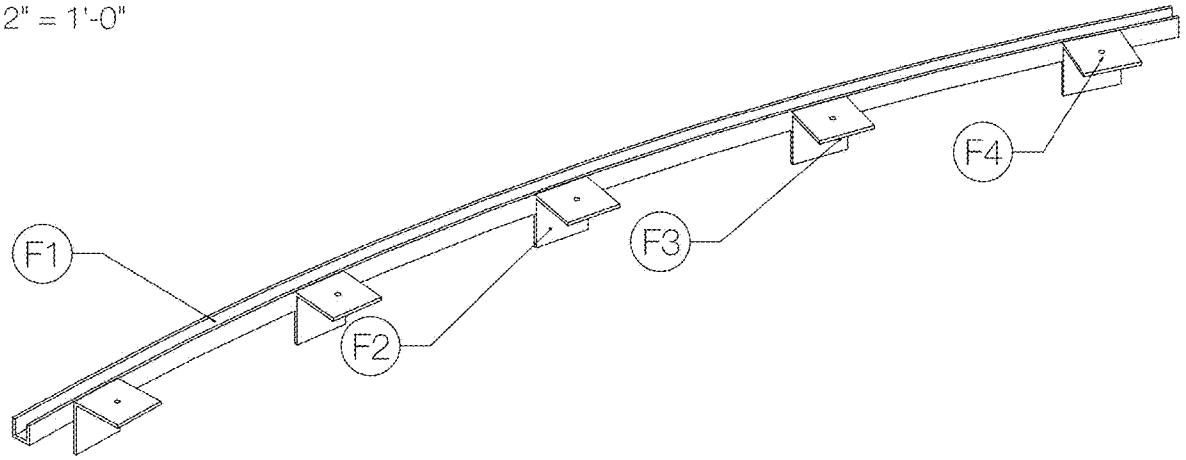
Fig. 48 Curved Extrusion Rear Isometric
Scale: 2" = 1'-0"
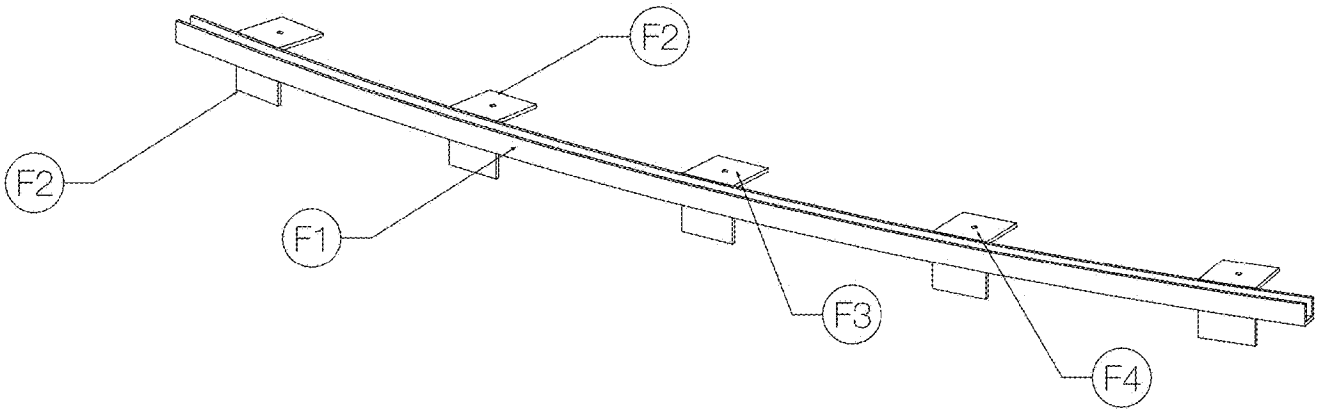
Fig. 49 Curved Extrusion Front Isometric
Scale: 2" = 1'-0"

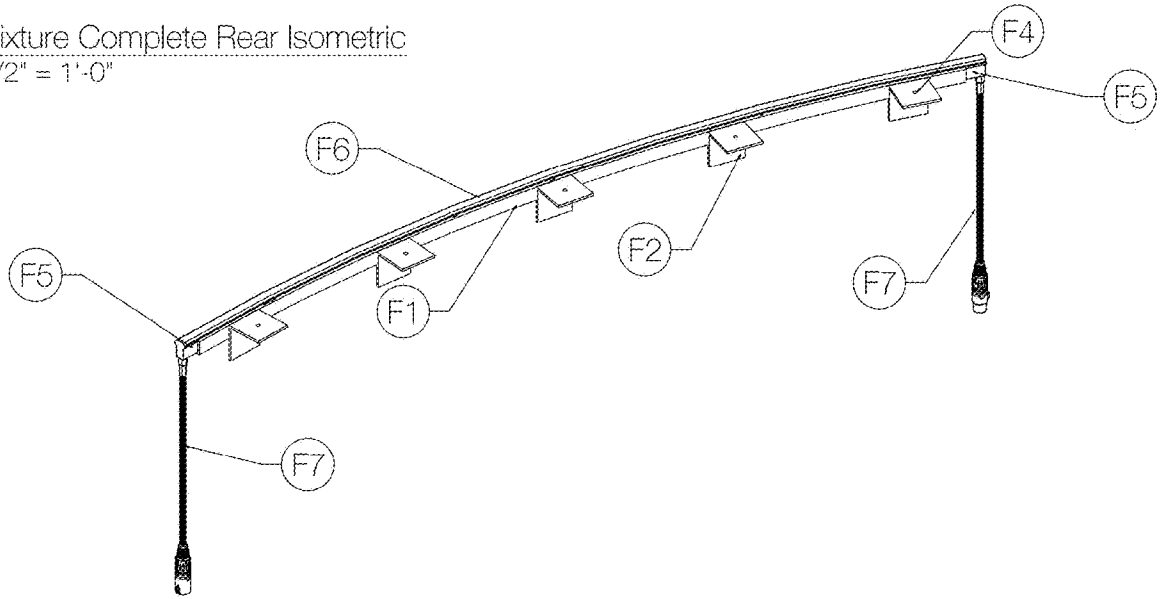
Fig. 50 Curved Fixture Complete Rear Isometric
Scale: 1 1/2" = 1'-0"
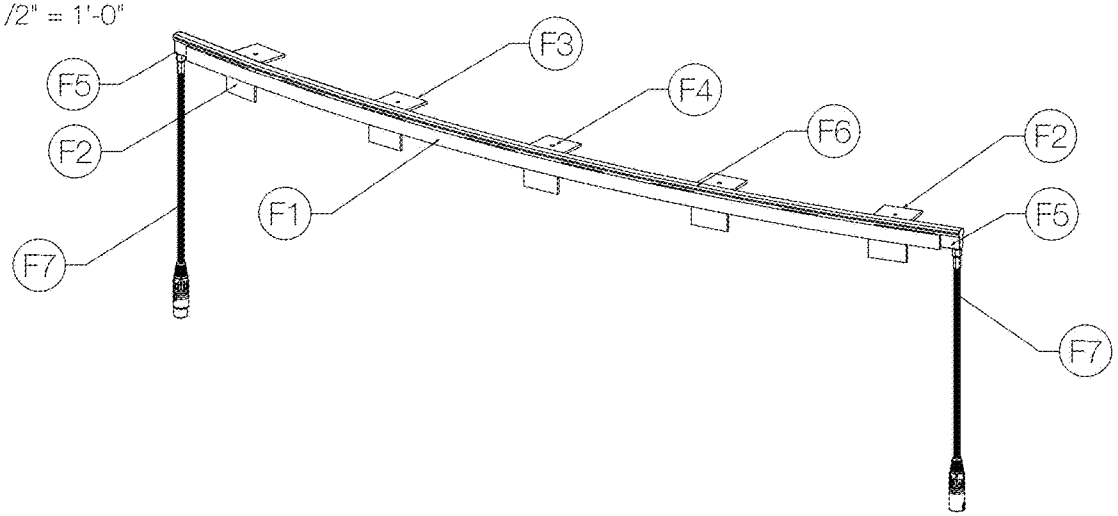
Fig. 51 Curved Fixture Complete Front Isometric
Scale: 1 1/2" = 1'-0"

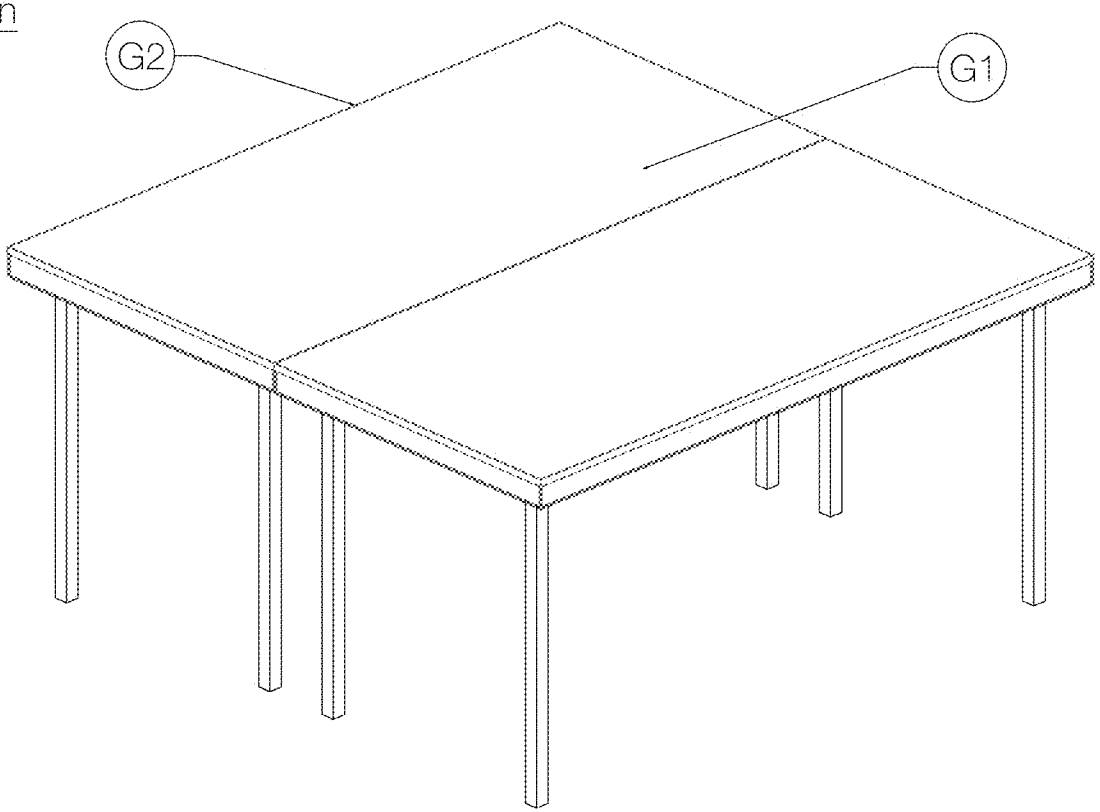
Fig. 52 Staging Installation Preparation
Scale: 1/2" = 1'-0"

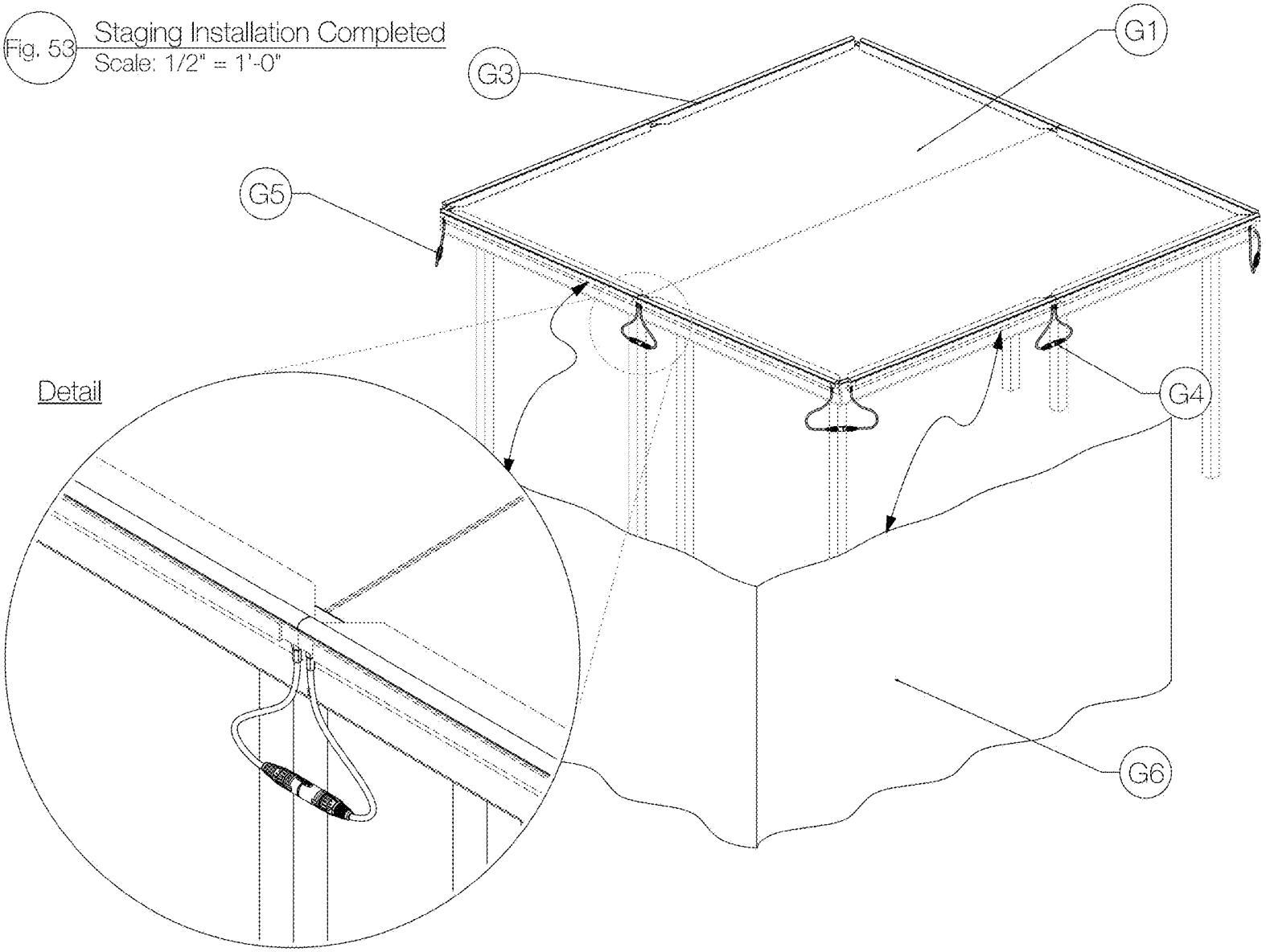
Fig. 53 Staging Installation Completed
Scale: 1/2" = 1'-0"

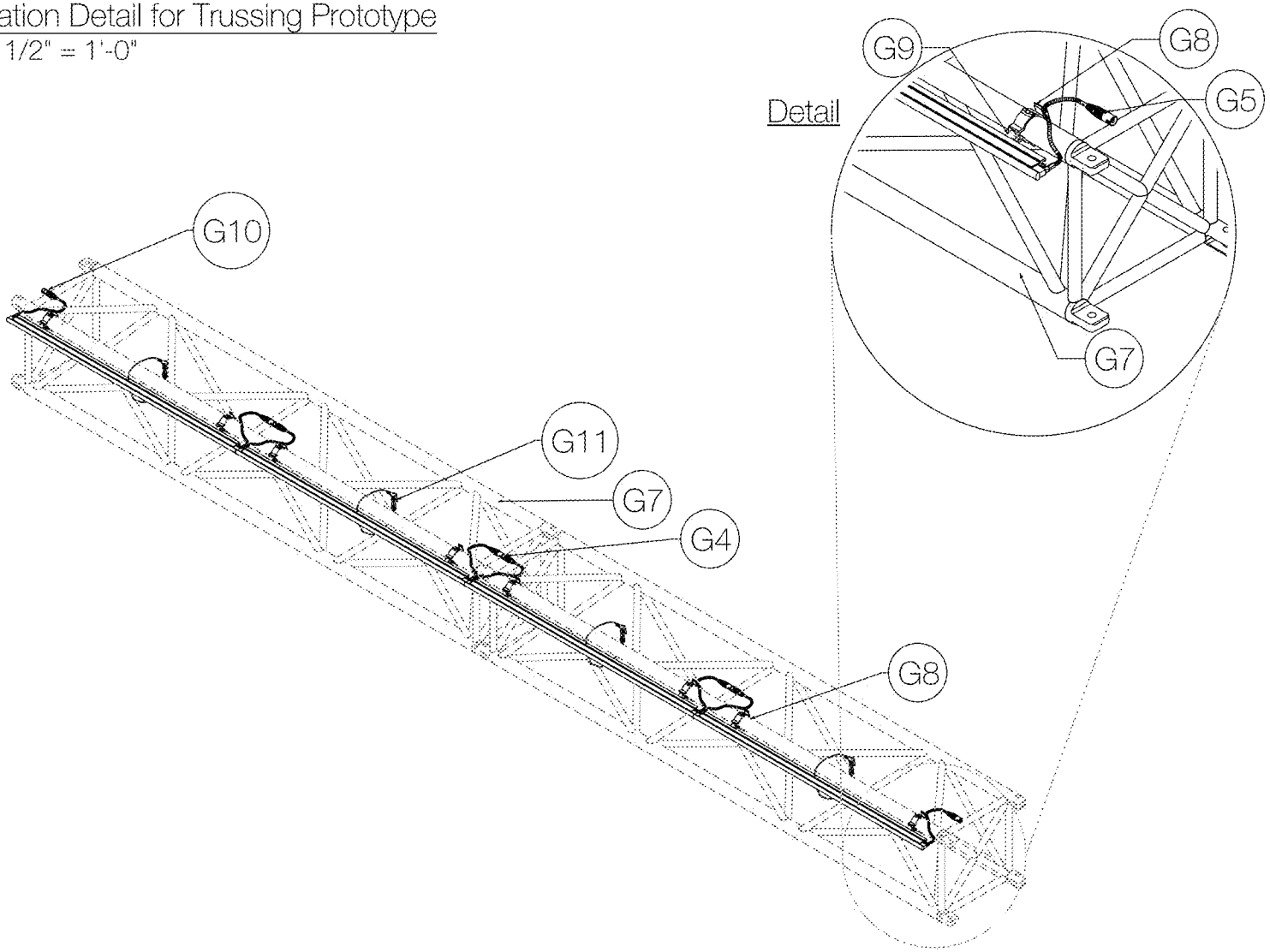
Fig. 54 Installation Detail for Trussing Prototype
Scale: 1/2" = 1'-0"

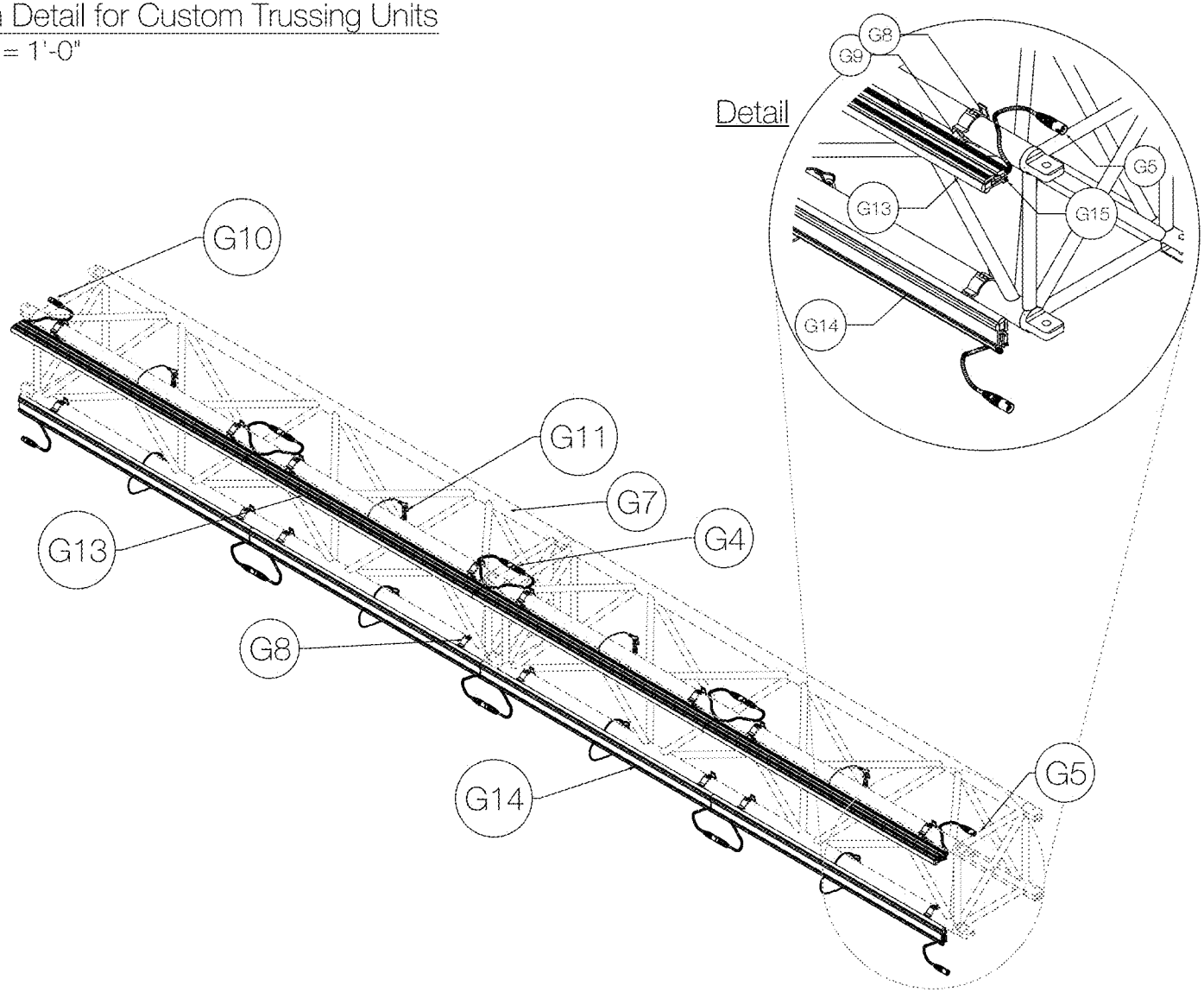
Fig. 55 Installation Detail for Custom Trussing Units
Scale: 1/2" = 1'-0"

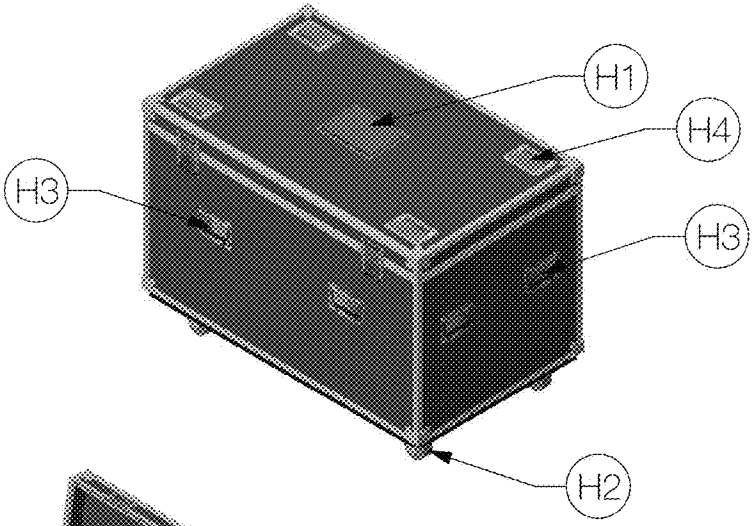
Fig. 56 Custom Transport Case - Closed
Scale: 1/2" = 1'-0"
Overall Exterior Case Size:
50" wide x 30" deep x 36" tall
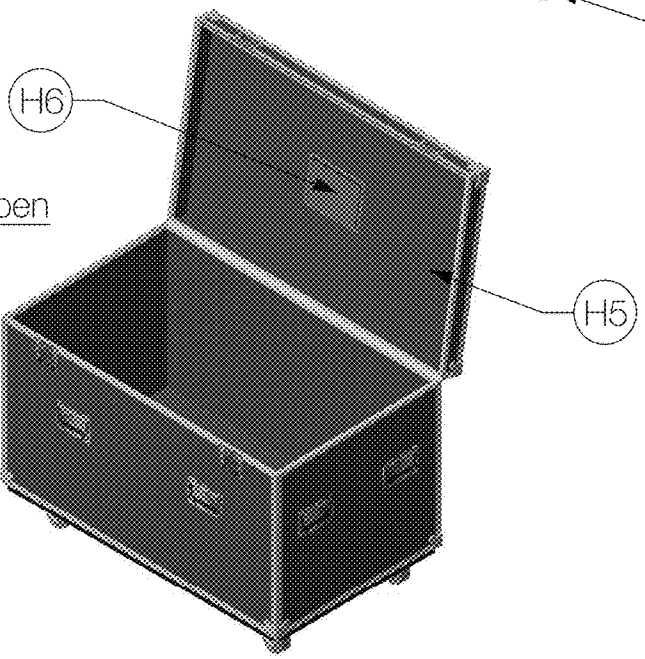
Fig. 57 Custom Transport Case = Open
Scale: 1/2" = 1'-0"

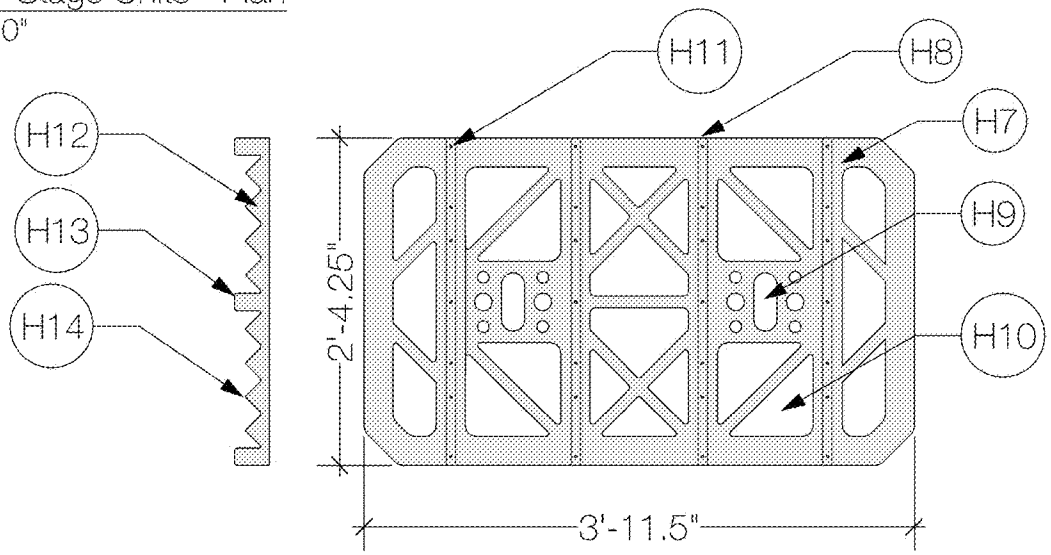
Fig. 58 Case Insert for Stage Units - Plan
Scale: 3/4" = 1'-0"
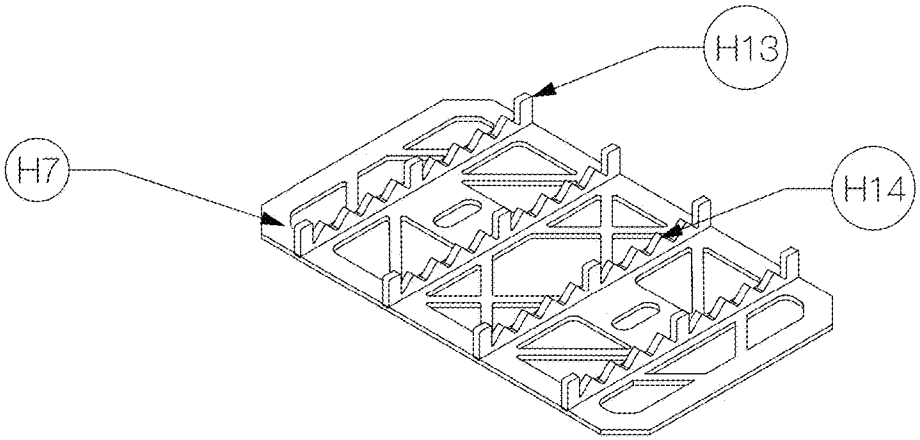
Fig. 59 Case Insert for Stage Units - Assembled
Scale: 3/4" = 1'-0"

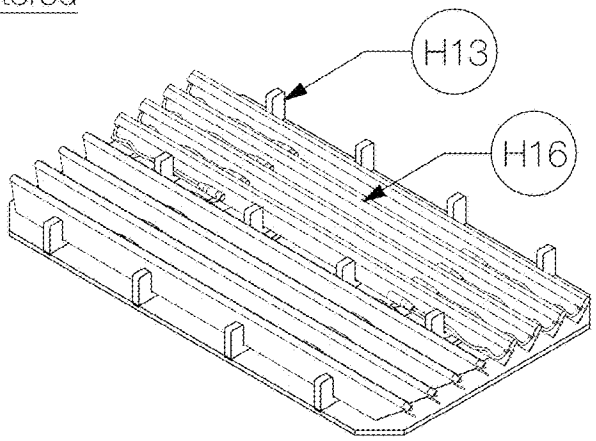
Fig. 60 Case Inset for Stage Units - Fixtures Stored
Scale: 3/4" = 1'-0"
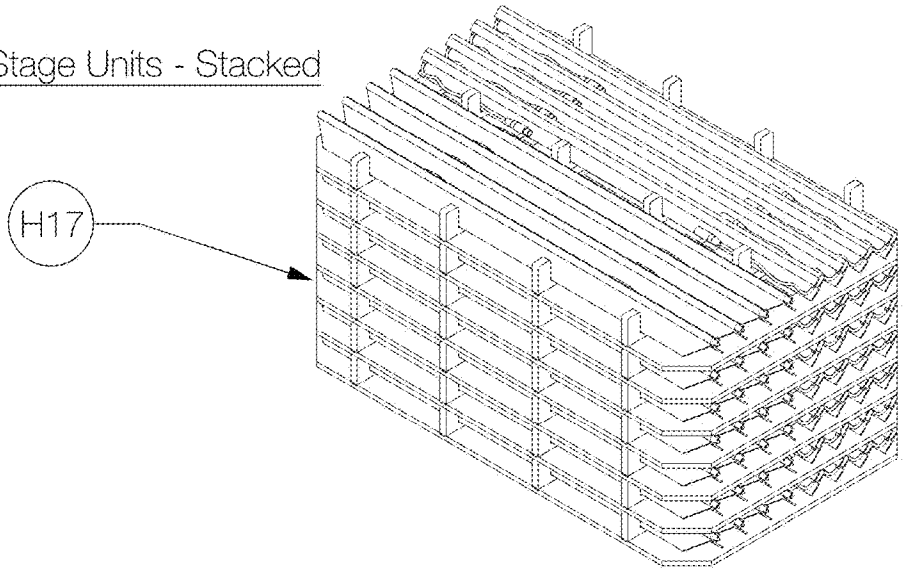
Fig. 61 Case Inserts for Stage Units - Stacked
Scale: 3/4" = 1'-0"

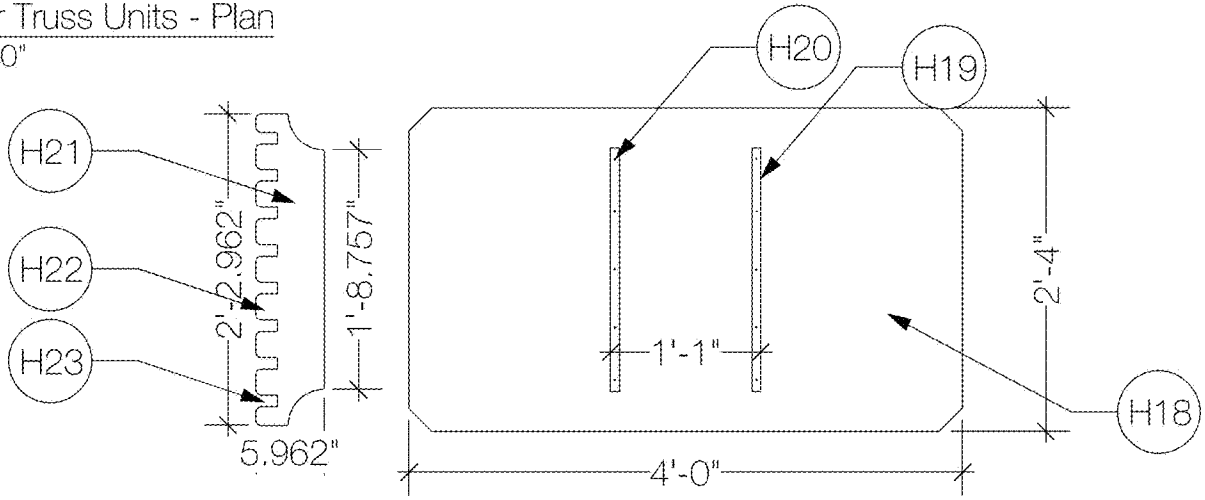
Fig. 62 Case Insert for Truss Units - Plan
Scale: 3/4" = 1'-0"
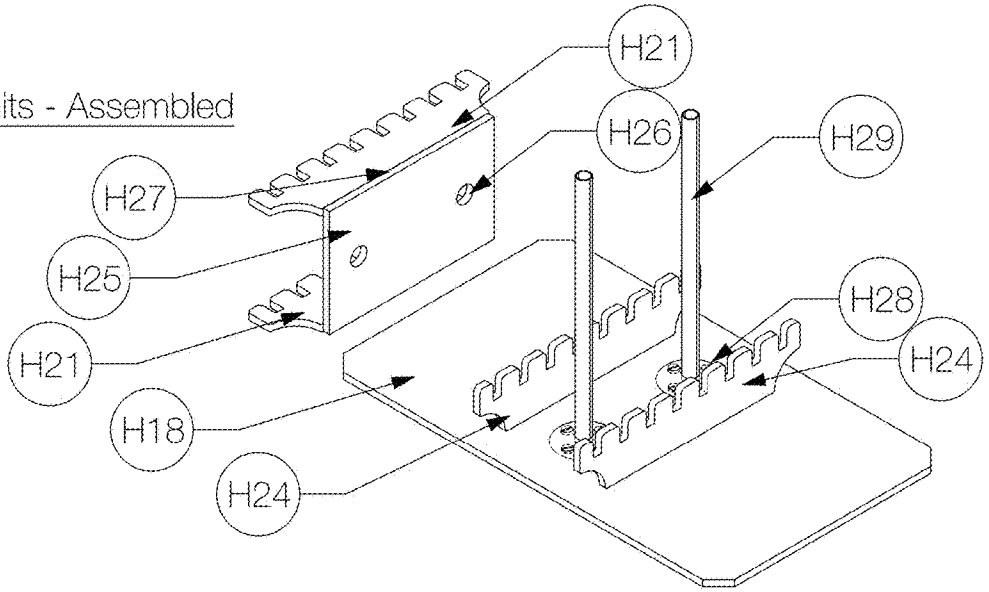
Fig. 63 Case Insert for Truss Units - Assembled
Scale: 3/4" = 1'-0"

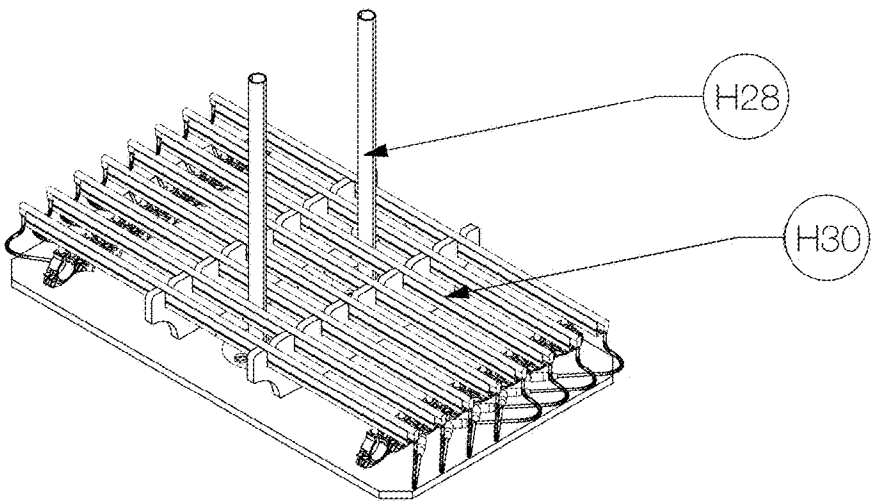
Fig. 64 Case Inset for Truss Units - Fixtures Stored
Scale: 3/4" = 1'-0"
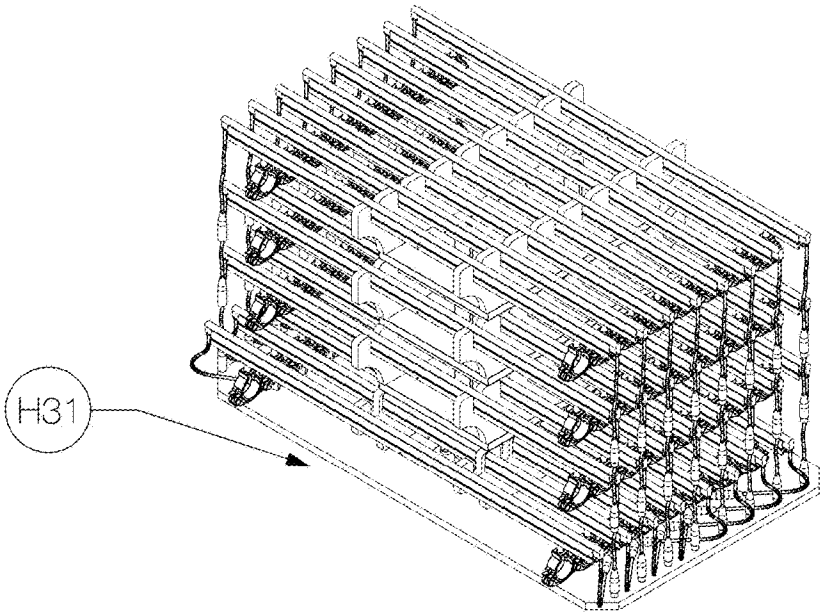
Fig. 65 Case Inserts - Stacked
Scale: 3/4" = 1'-0"

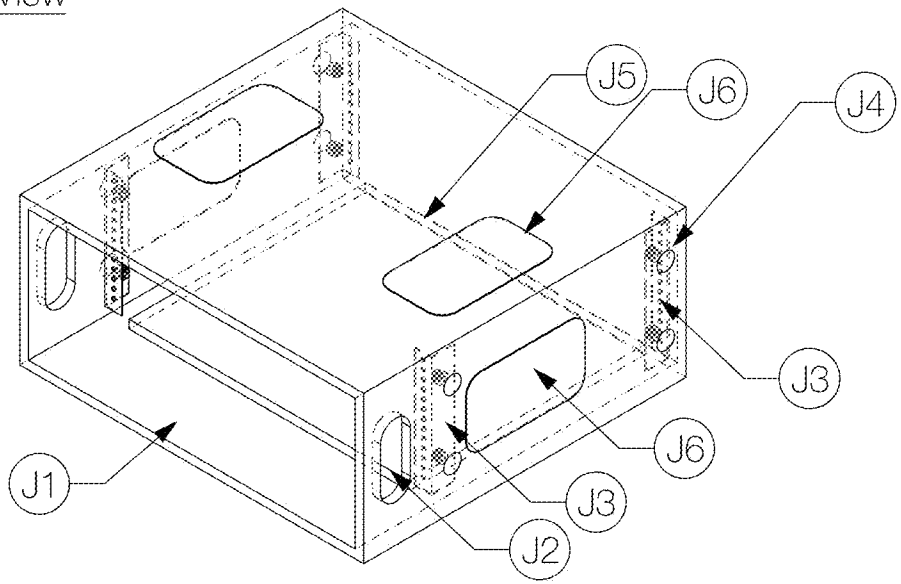
Fig. 66 Power Supply Rack Isometric View
Scale: 1 1/2" = 1'-0"
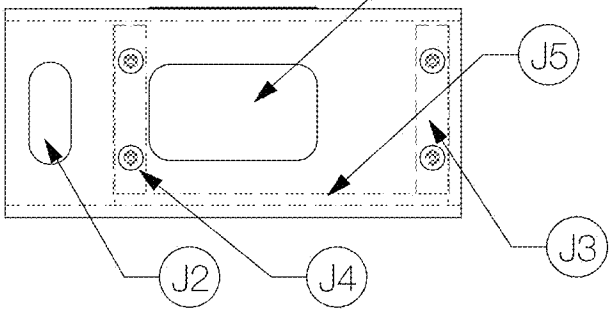
Fig. 68 Power Supply Rack Side View
Scale: 1 1/2" = 1'-0"
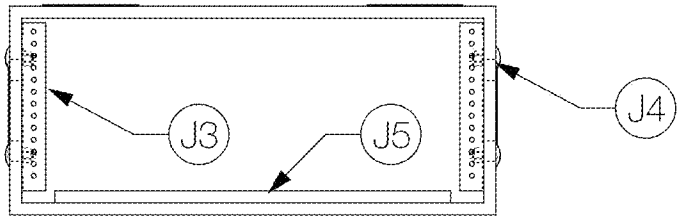
Fig. 67 Power Supply Rack Front View
Scale: 1 1/2" = 1'-0"

REMOVABLE MOUNTING DEVICE AND PACKAGING SYSTEM FOR LIGHTING PRODUCT

This application is a continuation of U.S. application Ser. No. 15/885,304, filed Jan. 31, 2018, which claims the benefit of and priority to U.S. Provisional Patent Application Ser. No. 62/452,640, filed Jan. 31, 2017. Both applications are incorporated by reference in their entireties for all purposes.

FIELD OF THE DISCLOSURE

The disclosure relates generally to stage lighting and particularly to lighting used for outlining a stage.

BACKGROUND

For many live event production and design projects there is a desire to outline stages with LED strip lighting to give a neon lighting appearance. In the past, these projects consisted of custom, one-off endeavors or using an off-the-shelf solution that was far less elegant.

The use of outline lining for many live, televised and filmed events is often a costly and time consuming process of purchasing single use LED product, determining an effective way to install it, consider how to power and drive the product. After the event, the product is typically thrown away rendering relatively expensive LED products as expendable materials.

Outlining of stages and staging structures with conventional linear LED products is a very popular design feature of many productions in live events, concerts, and television shows. The challenge is creating a linear LED source is a time-consuming, expensive, frustrating and often hit or miss situation. Because of this, conventional linear LED design elements are only available for higher budget productions.

The novel mounting device described below is addressed to overcome the shortcomings of current methods employed for using LED strip lighting to provide a neon-like lighting appearance.

SUMMARY OF THE DISCLOSURE

A novel modular system is disclosed and provides for a novel modular linear lighting solution. The system can generally comprise a bracket that is designed/configured to hold an LED lighting product and allows a user to mount the bracket with LED product to entertainment stages, platforms, risers, etc. relatively quickly and easily as compared to the conventional use of LED strip lighting products for providing outline lighting to a stage.

The lighting product, which in a non-limiting embodiment can be a conventional LED lighting strip, can be manufactured to any needed length and wiring installation needs. Preferably, connectors are soldered to the lighting product. The brackets can be constructed from metal or other rigid materials, and in one non-limiting embodiment, the bracket can be an aluminum extrusion that is then cut or welded to a specific configuration. Alternatively, a novel custom or specific extrusion or mold for the desired shaped bracket (as shown herein) can be provided and is also considered within the scope of the disclosure.

The aluminum extrusion/parts can be preferably powder coated.

A novel specifically designed shipping case is also disclosed and used for storing, housing and moving one or more of the novel brackets with lighting product secured thereto.

Though not limiting, the disclosed novel lighting product is preferably used for outlining staging and production structures with a high-quality, preferably LED light source in a relatively quick and relatively cost-effective and modular fashion.

The disclosed system allows an end user to simply and cleanly install edge lighting detail in a very low-profile, high output and elegant fashion. The preferred mounting hardware for the units can affix to most stage surfaces via a preferred 1" hook and loop fastener (i.e. "VELCRO" loop and/or hook component). Once the VELCRO fastener is preferably installed along the perimeter of the stage surface, the units housing the LED lighting containing mating VELCRO fasteners can be simply set down on the Velcro, effectively locking them in place along the edge of the staging. Fabric stage skirts can then be attached to the integrated VELCRO fasteners preferably on the face of the fixture to not only cover the front of the stage, but also conceal the cables for the disclosed lighting product. Thus, in a preferred embodiment, the audience at the event where the stage is outlined with the disclosed system preferably only sees the linear LED strips which can appear to be custom built into the stage.

Though not considered limiting, the units can be provided in the following preferred lengths: 1.2 m, 90 cm, 70 cm, 60 cm and 50 cm lengths. However, other lengths for the units can be used and are considered within the scope of the disclosure. Additionally, custom curved units can be provided. The units daisy-chain or otherwise connect together, preferably via a 4-pin XLR connectors at each end of the unit. Other connectors can also be used and are considered within the scope of the disclosure. Power supplies can be rack mounted and can be configured with preferably up to 16 DMX addressable outputs per single rack unit. Each output can preferably effectively drive 8 m of the disclosed lighting product.

In a preferred embodiment, each unit can be made up of two pieces of off-the-shelf aluminum, preferably welded together, with 45° corners. Holes can be drilled to allow the units to be suspended during a preferred powder-coating process and the ends milled to allow for cable egress. Other materials can be used and connecting/forming techniques used and all are considered within the scope of the disclosure. The LED lighting, which can be a FlexNeon LED product, can be preferably inserted within a channel of the formed unit. The channel can be preferably C-shaped in cross-sectional shape and the LED lighting can be pressed fitted into the channel. Other shapes for the channel and other insertion techniques can be used and are considered within the scope of the disclosure. A second version or custom stage unit can also be provided and can place the two pieces together into one custom extrusion, which in this embodiment eliminates the needs for welding and can also reduce the cost of powder coating during manufacture. The custom unit may also allow for simpler installation of the LED lighting product preferably by way of a series of set screws pushing against a preferred ½" aluminum strip which captures LED product.

In another embodiment, in either extrusion, the lighting product system can also be provided as a truss mount version. In this embodiment, the truss mount units can clamp to lighting and other production structures to allow for the use of linear LED lighting in overhead locations. In a first version of the truss mounted unit, the housing can be created from a pair of off-the-shelf aluminum extrusions that can be assembled together with a preferred ½" 3M VHB (very high bond) tape. The LED lighting, which can be a NeoFlex LED product, can be preferably inserted within a channel of the formed unit. The chancel can be preferably C-shaped in cross-section shape and the LED lighting can be press fitted into the channel. Clamp assemblies can be installed in a T-Track to allow the clamp assemblies to slide along the extrusion as required by end users. A second or custom version of the truss mounted unit can places the necessary elements/components in one unit allowing for installation of the LED lighting product (e.g. Flex Neon product, etc.) preferably by way of a series of set screws pushing against a preferred ½" aluminum strip which captures LED product. Two T-Slots can be available to allow mounting the clamp assemblies, both underneath or on the side of the unit. This second or custom extrusion version can include an inset along the side to protect installed labels from abrasion. Both the truss mounted extrusion versions can include an integrated safety cable to wrap around the supporting structure. Both truss mounted extrusion versions can be radiused into whatever curve shape an end user may require.

The disclosed lighting mounting product/system is ideal for the task of outlining staging and production structures with a high quality, LED light source in a modular fashion. The disclosed novel product allows the end user to simply and cleanly install edge lighting detail in a very low-profile, high output and elegant fashion. The mounting hardware of the units affixes to the stage surface preferably via 1" hook and/or loop fasteners (VELCRO). Though not considered limiting, the mounting product can come in 1.2 m, 90 cm, 70 cm, 60 cm and 50 cm lengths, as well as in curved length units. The novel mounting units can daisy-chain together preferably via 4-pin XLR connectors at each end of the unit. Power supplies can be rack mounted and can be preferably configured with up to 16 DMX addressable outputs per single rack unit. Each output can effectively drive 8 m of the product. The DMX profile for product can be a 16 bit RGB which allows for smooth crossfades and consistent output even when set at low intensities. The disclosed novel product provides for a "plug and play" lighting device or scenic element from the perspective of the end user. Power supplies and cable looms can be created and labeled for the system. The units can be installed relatively quickly and their impact in use can be immediate and stunning. Use of the disclosed novel LED lighting mounting system greatly reduces, if not eliminates, pixel "dots" in camera shots and bulky linear fixtures that have to be set on the stage. The use of LED tape products is also greatly reduced if not limited, as well as the hassles in wiring power supplies and implementing data control. The disclosed novel mounting system provided for a relatively quick, straightforward installation and intuitive integration Accordingly, the disclosed lighting products provide for a modular linear and curved lighting solutions that are easily installed and provided high quality stage outlining and other stage lighting capabilities, which can be reused and do not need to be discarded after use as is common with certain conventional stage LED outlining products.

BRIEF DESCRIPTION OF THE DRAWINGS

FIG. 1 illustrates a front view of a first embodiment for the light mounting bracket in accordance with the disclosed system;

FIG. 2 illustrates a front view of the light mounting bracket of FIG. 1 showing sleeving and connectors applied in accordance with the disclosed system;

FIG. 3 illustrates an isometric view of the light mounting bracket of FIG. 1;

FIG. 4 is a sectional view of a non-limiting embodiment for an extrusion member in accordance with the disclosed system;

FIG. 5 illustrates another view of the extrusion member with hook and loop fastening members shown attached thereto in accordance with the disclosed system;

FIG. 6 illustrates a top view of the extrusion member of FIG. 4;

FIG. 7 illustrates a front view of the extrusion member of FIG. 4;

FIG. 8 illustrates a rear isometric view of the extrusion member of FIG. 4;

FIG. 9 illustrates a front isometric view of the extrusion member of FIG. 4;

FIG. 10 illustrates a rear isometric view of the extrusion member of FIG. 4 with the light mounting bracket of FIG. 2 and lighting product secured therein;

FIG. 11 illustrates a front isometric view of the extrusion member of FIG. 1 with the light mounting bracket of FIG. 2 and lighting product secured therein;

FIG. 12 illustrates a top view of several non-limiting different size/length extrusion members that can be preferably used in accordance with the disclosed system;

FIG. 13 illustrates an isometric view of several non-limiting different size/length extrusion members that can be preferably used in accordance with the disclosed system;

FIG. 14 illustrates another embodiment for the extrusion member in accordance with the disclosed system;

FIG. 15 illustrates another view of the extrusion member embodiment of FIG. 14 with hook and loop fastening members shown attached thereto in accordance with the disclosed system;

FIG. 16 illustrates a top view of the extrusion member of FIG. 14;

FIG. 17 illustrates a front view of the extrusion member of FIG. 14;

FIG. 18 illustrates a rear isometric view of the extrusion member of FIG. 14;

FIG. 19 illustrates a front isometric view of the extrusion member of FIG. 14;

FIG. 20 illustrates a rear isometric view of the extrusion member of FIG. 14 with the light mounting bracket of FIG. 2 and lighting product secured therein;

FIG. 21 illustrates a front isometric view of the extrusion member of FIG. 14 with the light mounting bracket of FIG. 2 and lighting product secured therein;

FIG. 22 illustrates a top view of several non-limiting different size/length extrusion members that can be preferably used in accordance with the disclosed system;

FIG. 23 illustrates an isometric view of several non-limiting different size/length extrusion members that can be preferably used in accordance with the disclosed system;

FIG. 24 illustrates a first embodiment for a truss mount extrusion member in accordance with the disclosed system;

FIG. 25 illustrates another view of the truss mount extrusion member of FIG. 24 with a clamp secured thereto in accordance with the disclosed system;

FIG. 26 illustrates a top view of the truss mount extrusion member of FIG. 24;

FIG. 27 illustrates a front view of the truss mount extrusion member of FIG. 24;

FIG. 28 illustrates a rear isometric view of the truss mount extrusion member of FIG. 24;

FIG. 29 illustrates a front isometric view of the truss mount extrusion member of FIG. 24;

FIG. 30 illustrates a rear isometric view of the truss mount extrusion member of FIG. 24 with the light mounting bracket of FIG. 2 and lighting product secured therein;

FIG. 31 illustrates a front isometric view of the truss mount extrusion member of FIG. 24 with the light mounting bracket of FIG. 2 and lighting product secured therein;

FIG. 32 illustrates a top view of several non-limiting different size/length truss mount extrusion members that can be preferably used in accordance with the disclosed system;

FIG. 33 illustrates an isometric view of several non-limiting different size/length truss mount extrusion members that can be preferably used in accordance with the disclosed system;

FIG. 34 illustrates a second embodiment for a truss mount extrusion member in accordance with the disclosed system;

FIG. 35 illustrates another view of the truss mount extrusion member of FIG. 34 with a clamp secured thereto in accordance with the disclosed system;

FIG. 36 illustrates a top view of the truss mount extrusion member of FIG. 34;

FIG. 37 illustrates a front view of the truss mount extrusion member of FIG. 34;

FIG. 38 illustrates a rear isometric view of the truss mount extrusion member of FIG. 34;

FIG. 39 illustrates a front isometric view of the truss mount extrusion member of FIG. 34;

FIG. 40 illustrates a rear isometric view of the truss mount extrusion member of FIG. 34 with the light mounting bracket of FIG. 2 and lighting product secured therein;

FIG. 41 illustrates a front isometric view of the truss mount extrusion member of FIG. 34 with the light mounting bracket of FIG. 2 and lighting product secured therein;

FIG. 42 illustrates a top view of several non-limiting different size/length truss mount extrusion members that can be preferably used in accordance with the disclosed system;

FIG. 43 illustrates an isometric view of several non-limiting different size/length truss mount extrusion members that can be preferably used in accordance with the disclosed system;

FIG. 44 illustrates an isometric view of a first portion of a locating pin assembly for the truss mount extrusion member of FIG. 34;

FIG. 45 illustrates an isometric view of a second portion of a locating pin assembly for the truss mount extrusion member of FIG. 34;

FIG. 46 it a top view of a curved embodiment for the extrusion member in accordance with the disclosed system;

FIG. 47 is a front view of the curved extrusion embodiment of FIG. 46;

FIG. 48 illustrates a rear isometric view of the curved extrusion member of FIG. 46;

FIG. 49 illustrates a front isometric view of the curved extrusion member of FIG. 46;

FIG. 50 illustrates a rear isometric view of the curved extrusion member of FIG. 46 with the light mounting bracket of FIG. 2 and lighting product secured therein;

FIG. 51 illustrates a front isometric view of the curved extrusion member of FIG. 46 with the light mounting bracket of FIG. 2 and lighting product secured therein;

FIG. 52 illustrates an isometric view of a stage being prepared to have one or more of the disclosed embodiments for light mounting bracket and/or extrusion members installed thereto;

FIG. 53 illustrates an isometric view of one embodiment of the disclosed novel system installed on a stage, such as, but not limited to, the stage shown in FIG. 52;

FIG. 54 illustrates an isometric view of one-embodiment of the disclosed novel system installed on a truss structure;

FIG. 55 illustrates an isometric view of another embodiment of the disclosed novel system installed on a truss structure;

FIG. 56 illustrates an isometric view of one embodiment for a preferred transport case for the components of the disclosed novel system and shown in a closed position;

FIG. 57 illustrates an isometric view of the transport case of FIG. 56 shown in an open position;

FIG. 58 is a plan view of a preferred non-limiting case insert for stage units that are preferably housed within the transport case;

FIG. 59 is an isometric view of the case insert of FIG. 58 shown in an assembled configuration;

FIG. 60 is an isometric view of the assembled stage case insert shown holding or storing certain fixtures or components of the disclosed novel system;

FIG. 61 is an isometric view of several stage case inserts shown stacked together;

FIG. 62 is a plan view of a preferred non-limiting case insert for truss units that are preferably housed within the transport case;

FIG. 63 is an isometric view of the case insert of FIG. 62 shown in an assembled configuration;

FIG. 64 is an isometric view of the assembled truss case insert shown holding or storing certain fixtures or components of the disclosed novel system;

FIG. 65 is an isometric view of several truss case inserts shown stacked together;

FIG. 66 is an isometric view of a preferred non-limiting power supply rack for use with the disclosed novel system;

FIG. 67 is a front view of the power supply rack of FIG. 66; and

FIG. 68 is a side view of the power supply rack of FIG. 66.

DETAILED DESCRIPTION

As seen in the drawings a novel mounting bracket for a lighting product is shown and described below. The mounting bracket preferably serves as a novel mounting device for a lighting product and preferably a lighting strip product, such as, but not limited to a light emitting diode (LED) product. Preferably, though not limiting, the lighting strip can be flexible to allow the strip to be used in straight/linear and/or curved/bended configurations. In one non-limiting embodiment, the lighting product can be a red, green, blue LED light strip product, which can be used in one non-limiting example for outlining entertainment stages and trusses, scenic pieces and other entertainment and non-entertainment based designs and structures in much the same way that one would use neon lighting for similar purposes. Use of the novel mounting bracket, helps to simplify the process of outlining entertainment structures and also allows the LED/lighting products to be reused as opposed to discarded after initial use as often is the case with current LED products.

The use of lighting product, such as LED lighting strip product, in connection with the disclosed novel mounting bracket embodiments provides for a modular, easy to deploy, cost-effective and re-usable system.

In one non-limiting preferred embodiment, the novel mounting bracket is used with a flexible LED product, such as, a lighting product marketed under the brand 270 Degree Flex Neon RGB. Preferably, the LED product can be provided in various desired specified lengths and can have control leads emanating from both ends that can be preferably directly or hang downward of the product (See FIG. 1). In one non-limiting embodiment, the control leads can be injected molded and 1 meter in length, though other dimensions/values can be used and are also considered within the scope of the disclosure. As seen in FIG. 1, the lighting product can be provided with a white or four-wire cable A4, which in a non-limiting embodiment, can be 3 meters in length, that is injected molded into the housing of the light product and can exit from the bottom of the housing of the light product preferably at each end. As also seen in FIG. 1, bare wires for connections to red, green, blue (though other colors can be used and are considered within the scope of the disclosure) and common circuits can be provided on each of the meter leads.

In one embodiment, the leads can be cut to a specific overall length, such as, but not limited to 12", resulting in cables A8 (FIG. 2). Alternatively, the lighting product can be provided initially with the leads being at the required length. As seen in FIG. 2, sleeving A9, such as, but not limited to, ¼" polyester sleeving can be installed over the control leads and affixed with a piece of heat shrink tubing that can be 1" in length. The heat shrink can be installed for strain relief and can capture the plastic/polyester sleeving at each end. Preferably, a Neutrik NC4MX 4-pin XLR connector or other first electrical connector, can be installed on one lead which can be used to feed 24 volt power into the LED product and preferably, a Neutrik NCFX 4-pin XLR connector or other second electrical connector, can be installed on the opposing lead which can then be used to feed 24 volt power back out of the lighting product. The first connector 7 can be a 4-pin male XLR connector that is preferably soldered to the wires on a first end of the lighting product for inputting the preferred 24V signal. The second connector can be a 4-pin female XLR connector that is preferably soldered to the bare wires on the opposite end of the lighting product for outputting the preferred 24V signal. It is also within the scope of the disclosure to reverse the roles and connection points of the connectors.

The novel mounting bracket/housing for the lighting product, can be constructed from various known materials, and in a preferred embodiment, can be constructed from aluminum. As seen in FIGS. 6, 7, 8 and 9, in one embodiment, the bracket can generally comprise a "C" channel member B1, such as, but not limited to, a ¾"×34" aluminum "C" channel welded or otherwise secured to a "L" shaped member B2, such as a 2"×2" aluminum "L" shaped "equal leg" extrusion. The C-Channel can be used capture the LED lighting product which can be press fit inside the C-shaped channel of member B1.

C-channel member B1 can be inset or set back from the ends of the L shaped extrusion, such as, but not limited to, by ¾" to allow for egress or pass through of the injection molded cables of the LED product. However, such is not limiting and the C-shaped member B1 can also extend to the end of L-shaped extrusion B2. Though not required, the top ends of the L shaped extrusion B2 can be cut back, such as, but not limited to, by 45°, to allow for a mitered corner installation of up to 90°.

Some or preferably the entire aluminum assembly can then be powder coated for a finished appearance. In one non-limiting embodiment, the powder coating for the product can be gloss black or white, though any color and any finish detail can be used and are considered within the scope of the disclosure. Holes, such as, but not limited to ⅛" holes, can be drilled on each of L-shaped extrusion B2 for hanging or suspending the extrusion during powder coating and possible cable strain relief.

The underside of the L shaped extrusion B2 can be finished or provided with an adhesive strip, such as, but not limited to a 1¾" hook and/or loop fastener (VELCRO) adhesive strip 14, which allows for attaching the mounting bracket housing a lighting product to a stage, riser, platform, etc. or other surface. Preferably, in one non-limiting embodiment, the mounting bracket can be installed or secured to horizontal stage surfaces. The facing side of L-shaped extrusion B2 can be finished or provided with an adhesive strip, such as, but not limited to a 1" hook and/or loop fastener (VELCRO) adhesive strip below the C-channel member portion, which allows for the installation of fabric "stage skirts" or stage skirting material to finish off the overall stage design/presentation. (See FIG. 5).

Preferably, in one non-limiting embodiment, after the sleeving, heat shrink and connectors have been installed to the lighting product, the LED product can be inserted into the C-channel of member B1. An identifying label can be installed on the back side of the L-shaped extrusion B2 and the product is then ready for use and installation on a stage, riser, platform, etc. The installation on staging and other structures can comprise installing a piece of adhesive material, such as, but not limited to an adhesive 1" hook and/or loop fastener (VELCRO) material, along the perimeter where the mounting bracket housing the light product is desired. The mounting bracket is laid into place by mating the adhesive material on the stage with the adhesive material secured to the L-shaped member B2 (i.e. using the adhesion/mating of the respective hook to loop material).

By preferably using Neutrik NC4MX and NC4Fx connectors for the electrical connectors, the installed product may be "daisy-chained" from one unit to another up to preferably 10 meters in length. However, such length is not considered limiting and other lengths, smaller and larger, can be chosen and are considered within the scope of the disclosure. 24V power can also be ingested into the LED product 1 via a connector, which can be a 4-pin Neutrik connector, which subsequently feeds all units connected downstream.

As non-limiting options, the end product can be offered in 1.2 meter, 90 cm, 70 cm, 60 cm and 50 cm straight lengths (see FIGS. 12 and 13). However, other smaller and larger lengths can be selected, and all are considered within the scope of the disclosure and the disclosure is not limited to any specific length or range of lengths.

As the lighting product may be flexible in nature, such as the preferred, but not limiting, 270 Degree Flex Neon RGB lighting product, a curved or "radiused" housings can be built to accommodate curvilinear and round staging. In one non-limiting embodiment, these housing can be comprised of the ¾" radiused C-channel member F1 and 2" mounting tabs F2, F3, F4 and one non-limiting embodiment is shown in FIGS. 46, 47, 48 and 49. Thus, various radiused housings can be provided to accommodate many different stage designs including round and curvilinear forms. Though not limiting, the mounting tabs can be 2" in width. The mounting tabs can be preferably welded or otherwise secured to the radiused C-channel member F1. The number of mounting tabs provided is not limited to any particular number of mounting tabs and can vary and can be chosen based on the overall length of radiused C-channel member F1. An adhesive material, such as, but not limited to 1¾" adhesive hook and/or loop fastener (VELCRO) material can be installed on the underside top of one or more of the mounting tabs to allow for installing on stage surfaces, such as, but not limited to, horizontal stage surfaces, risers, platforms, etc.

Housing, transporting, storing and/or packaging of the mounting brackets with lighting products secured within can be achieved through one or more custom road cases (See FIGS. 56 and 57). In one non-limiting embodiment the case can be 30"×50"×30" overall and on four casters and containing an opening lid. Novel divider boards and/or inserts can be provided and in one non-limiting embodiment can be fabricated from ½" plywood and 1"×4" ribs to create a "container" for up to six mounting brackets/lighting products, though such is not considered limiting. The divider boards can be stacked up to 6 units high in case, in one non-limiting configuration, to allow for safe and easy transportation of up to 36 mounting brackets with lighting products secured thereto. The lid or top of the case can be provided with a recessed label dish H1, recessed stacking caster dishes and recessed handles H3.

FIG. 1 shows a flexible lighting product, such as the 270° Domed FlexNeon RGB (red, green, blue) product, which preferably becomes the linear LED (light emitting diode) light source for the disclosed novel housing/mounting systems. The LED engines can be located in the Lower Housing portion (A3) and the light from the lighting product can be emitted along the length of the Upper Dome portion (A2). A four-wire (A4) cable can be injection molded into the bottom of the Lower Housing (A3) at each end to provide a pathway for 24 volt dc power (or other voltage amount) to be applied to the diodes and to exit the other end allowing for connection to additional units, preferably up to a total of 8 meters in length, though the length and total number of units are not considered limited to any number, value or dimension.

In FIG. 2 the four-wire cable (A4) can be cut to 12" length or other desired length. A preferred 1" piece of heat shrink (A7) can be applied to the exit point of the four-wire cable and a preferred 11" length of ¼" flexible black sleeving (A9) can be applied over the cable. The heat shrink provides protection against cable damage and also captures the flexible sleeving. A connector, such as, but not limited to, a Neutrik NC4MX 4-pin male XLR (A10) connector can be soldered or otherwise secured to bare wires (A6) for inputting 24 v signal into the lighting product (A1). A connector, such as, but not limited to, a Neutrik NC4FX 4-pin female XLR connector can be soldered to bare wires (A6) for outputting 24 v signal to allow for "daisy-chaining" of additional units.

In FIG. 3 an isometric view of the lighting product housed within a first mounting system embodiment is shown containing a lighting product therein. The overall shape of the upper dome (A2) from which light emanates can be seen. The mounting product and/or the lighting product can be flexible allowing for the creating of various curvilinear forms. Though not considered limiting, the lower housing can be constructed from a vinyl material or be a vinyl substrate in one embodiment. Other preferably flexible materials can also be used and are considered within the scope of the disclosure. The upper dome (A2) can be made from a translucent, transparent, clear, silicon, plastic, etc. materials, as well as any other material(s) the permit the LED light to be seen or emanate for its intended purpose, while also diffusing the light so the pixels are preferably not seen, so that the LED lighting provides a neon appearance.

FIGS. 4 and 5 provide section views of the extrusions that can form the first embodiment of the disclosed novel mounting bracket/system and how they are assembled for mounting the lighting product contained within the lower housing portion and emanating light through the upper dome portion of the novel light housing. The first embodiment can be preferably to mount the lighting product disposed with the novel disclosed light housing to a stage, riser, platform, etc. Thus, the first embodiment mount allows for a quick and re-usable installation of the 270° Domed FlexNeon RGB (lighting product) on a variety of stage or other flat surfaces.

The preferred ¾"×¾" aluminum C-Channel/shaped member (B1) can be welded to a preferred 2"×2" L-Channel/shaped member (B2). Both the C-Channel member and L-Channel member can be conventional products. The C-Channel member forms an opening (i.e. substantially C-shaped in cross sectional) into which the Lower Housing (A3) containing the 270° Domed FlexNeon RGB product can be press fitted allowing the Upper Dome portion (A2) to sit above and be visible. The upper part of the 2"×2" L-Channel member (B2) can form a "shelf" for placing on a stage surface. A preferred 1.75" piece of adhesive hook and/or loop fastener (VELCRO) (B8) can be applied to the underside surface of the 2"×2" L-channel "shelf" and is used to lock the mounting fixture to a deck/stage surface, where a piece of 1" mating adhesive hook and/or loop fastener (VELCRO) has been applied to the surface. A preferred 1" piece of adhesive hook and/or loop fastener (VELCRO) (B7) can be applied to the lower face of the 2"×2" L-Channel (B2) which is also preferably underneath the ¾"×¾' C-Channel member (B1) to allow for the installation of fabric stage curtains to be applied thereby covering the stage structure and also preferably covering some, most or all cable connections for the disclosed novel mounting system.

FIGS. 6, 7, 8 and 9 depict different views of the first embodiment for the disclosed novel stage mount. These units can be powder coated gloss black, white or any color desired. The ends of the 2"×2" L-Channel member (B2) can be cut at or about 45° (B9) preferably on both ends to allow the end user to place the units at right angles to each other as one would at the corners of a staging deck. The ends of the interior of the ¾"×¾" C-Channel can be cut with a ½" miter bit 1 1/16" (B6) to allow egress for injection molded cables (A4) of the 270° Domed FlexNeon RGB product. Holes, such as, but not limited to, 3/16" holes can also be provided to allow for suspension or hanging of the unit during the powder coating process.

FIGS. 10 and 11 depict the first stage mount embodiment with the novel lighting product contained within the C-channel (i.e. lighting product installed), which can be considered a first "completed" stage mount embodiment. As also 1 This is a completed Prototype Stage Mount Unit. The Upper Dome (A2) protruding above the C-channel (B1) is also seen in these figures.

FIGS. 12 and 13 show that the mounts can be provided in various lengths and are not limited to any specific length. In a preferred, though not limiting, configuration, the mounts can be provided in 1.2 meters lengths, as well as, 90 cm, 70 cm, 60 cm, and 50 cm lengths to accommodate various end-user design requirements.

FIGS. 14 and 15 shows section views of a second embodiment for a novel stage mount and preferably is used for similar purposes of the first stage mount embodiment. However, where the first embodiment preferably comprised two extrusions during fabrication/manufacture, the second embodiment incorporates the two extrusions of the first embodiment into a single extrusion. The second embodiment also provides for a different method of installing and removing the light/light housing product. In the second embodiment, an opening (C4) can be provided to capture the Lower Housing (A3) of the lighting/light housing product. A slot (C8) can be included in the opening (C4) to facilitate placement of an aluminum retainer bar (C5). A series of ¼" long by 3/16" diameter set screws (C6) can be inserted into 3/16" threaded holes cut into the face of the extrusion (C7). These set screws press against the aluminum retainer bar which then provides even pressure against lower housing (A3) of the installed/inserted light/light housing product to provide a positive means to capture the light/light housing product without the necessity or undue effort associated with "press-fit" installation methods of the first embodiment. Similar to the first embodiment, the upper part of second embodiment stage mount extrusion forms a "shelf" (C2) for placing on a stage surface. There is a 2" piece of adhesive hook and/or loop fastener (VELCRO) (B8) applied to the underside surface of the "shelf", which locks the fixture to a deck surface having a mating piece of 1" adhesive loop and/or hook fastener (VELCRO) applied to the surface. Also similar to the first embodiment, a 1" piece of adhesive hook and/or loop fastener (VELCRO) (C9) can be applied to the lower face of the extrusion to allow for the installation of fabric stage curtains for covering the stage structure and also covering some, most or all cable connections for the disclosed light/light housing products.

FIGS. 16, 17, 18 and 19 illustrate several views of the second embodiment stage mount. Similar to the first embodiment, these units can be powder coated gloss black, white or any other color desired. Also similar to the first embodiment, the ends of the Shelf (C2) can be cut at or about 45° on both ends (C13) to allow the end user to place the units at right angles to each other as one would at the corners of a staging deck. The ends of the interior of the Opening (C4) can be cut with a ½" miter bit 1 1/16" (C11) to allow egress for the injection molded cables (A4) of the disclosed novel light/light housing product. Holes, such as, but not limited to, 3/16" holes, can be provided to allow for suspension or hanging of the mounts during the powder coating process.

FIGS. 20 and 21 illustrate the second embodiment stage mount with the novel light/light housing product installed or otherwise contained therein and is considered "completed" second embodiment stage mount. The upper dome (A2) preferably protrudes above the second embodiment extrusion mount.

Similar to the first embodiment, FIGS. 22 and 23 show that the second embodiment mounts can be provided in various lengths and are not limited to any specific length. In a preferred, though not limiting, configuration, the second embodiment mounts can be provided in 1.2 meters lengths, as well as, 90 cm, 70 cm, 60 cm, and 50 cm lengths to accommodate various end-user design requirements.

It is also within the scope of the disclose to use first embodiment mounts and second embodiment mounts together for the entire stage outlining design.

FIGS. 24 and 25 illustrate section views of the extrusions used and how they are assembled for a first truss mount embodiment. This embodiment allows for relatively quick and re-usable installation of the novel lighting/light housing product on an entertainment or architectural overhead structure.

In this embodiment, an aluminum C-shaped channel member (D1) can be affixed to a T-shaped slot channel member (D2) by ½" 3M VHB Tape since that there is no sufficient physical space to weld these wo pieces together. Both the C-Channel and the T-Slot channel member can be conventional products. The C-Channel member form the opening into which the Lower Housing (A3) of the lighting/light housing product is press fitted allowing the Upper Dome (A2) to sit above to be visible, similar to as described in the first stage mount embodiment. The T-Slot is utilized to allow installation of two clamps, such as, but not limited to, black Mini QR360 Trigger Clamps (D10). The clamps affix to the T-slot by means of a grade 8¼"×1¼" long hex bolt, a split washer, three flat washers, a hex nut and a ½" long spacer. The hex nut slides into the T-Slot (D4). With this arrangement, the clamps can slide anywhere along the length of the completed fixture allowing the end user to situate the clamps where they require (i.e. hex nut is slidable along the length of the T-slot. The preferred Mini QR360 Trigger Clamps (D10) are suited to attach to 2" OD tubing which is often used in the entertainment industry for fabrication of truss structures. The ½" spacer allows for clearance to install other lighting fixtures along the same tubing.

FIGS. 26, 27, 28 and 29 depict the first truss mount embodiment from various different angles. An integrated ⅛" safety cable with snap hook (D16) can also be provided. FIGS. 30 and 31 show the first truss mount embodiment with the lighting/lighting housing product contained within the C-channel. Similar to the other embodiment, the upper dome (A2) preferably protrudes from the top of the C-channel.

Similar to the other embodiments, FIGS. 32 and 33 show that the first truss mount embodiment can be provided in various lengths and are not limited to any specific length. In a preferred, though not limiting, configuration, the first truss mount embodiment can be provided in 1.2 meters lengths, as well as, 90 cm, 70 cm, 60 cm, and 50 cm lengths to accommodate various end-user design requirements.

FIGS. 34 and 35 are section views of a second truss mount embodiment which be used for similar purposes as the first truss mount embodiment, but incorporates the two extrusions of the first truss mount embodiment into a single extrusion during fabrication/manufacture. The second truss mount embodiment, also uses a different method for installing and removing the lighting/light housing as compared to the first truss mount embodiment and allows for the mounting of clamp assemblies both to the bottom and the side of the extrusion for additional end-user deployment options. Additionally, the second truss mount embodiment extrusion can also be radiused to create curved installations.

An opening (E2) is provided to capture the lower housing (A3) of the lighting/light housing product. A slot (E6) is included in the opening (E2) to facilitate placement of an aluminum retainer bar (E3). A series of ¼" long by 3/16" diameter set screws (E4) can be inserted into 3/16" threaded holes cut into the face of the extrusion. These set screws press against the aluminum retainer bar which then provides even pressure against the lower housing (A3) of the installed lighting/light housing product to provide a positive means to capture the lighting/light housing without the undue effort associated with "press-fit" installation methods. The T-slot (E8) opening in the bottom of the extrusion serves the same function as the T-slot in the first truss mount embodiment. An additional T-slot (E7) on the side of the extrusion allows for different mounting options. Two holes (e9) at the bottom of the extrusion can be provided to allow for the insertion lot locating pins in one end of the unit. These locating pins then align with the holes on subsequent units to facilitate proper alignment of the units.

FIGS. 36, 37, 38 and 39 illustrate different views of the second truss mount embodiment. These units can be powder coated gloss black, white or any other color. The ends of the interior of the opening (E2) can be cut with a ½" miter bit 1 1/16" (E24) to allow egress for the injection molded cables (A4) of the lighting/light housing product. A hole(s), such as, but not limited to a 3/16" hole(s) can pass through the entire extrusion (E17) to allow for suspension during the powder coating process and for the installment of an integral ⅛" safety cable with snap-hook. One or more, and preferably two locating pins (E18) can be provided on one end of the extrusion.

FIGS. 40 and 41 show the second truss mount embodiment at various different angles and housing the novel lighting/light housing product. As with the other embodiments, the upper dome (A2) of the light housing protrudes from the top of the extrusion opening.

Similar to the other embodiments, FIGS. 42 and 43 show that the second truss mount embodiment can be provided in various lengths and are not limited to any specific length. In a preferred, though not limiting, configuration, the second truss mount embodiment can be provided in 1.2 meters lengths, as well as, 90 cm, 70 cm, 60 cm, and 50 cm lengths to accommodate various end-user design requirements.

FIGS. 44 and 45 illustrate locating assembly for the second truss mount embodiment and provide a closeup view of each end of the extrusion, having the lighting/light housing instated. The preferred ½" aluminum retaining bar (E3) can be seen bearing against the Lower Housing (A3) lighting/light housing product for a compression installation. The 1-16" milled slot (E24) in the extrusion for the egress of cables is also visible. The two locating pins (E18) on one end of the extrusion will insert into corresponding hole openings (E9) of the next unit so that multiple units will align properly in a linear fashion.

As mentioned above, preferably, the lighting and light housing can be flexible which permits curved installations to be created. As seen in FIGS. 46, 47, 48 and 49 to accommodate curved lighting configurations, series of curved stage mounts can be provided and preferably using a radiused ¾"×¾" aluminum c-channel (F1) to form the opening for press-fitting the curved lighting/light housing. This C-Channel can be curved to nearly any desired radius based on the requirements of the end user and all are considered within the scope of the disclosure. The C-channel can be supported by 2"×2" L-channel tabs (F2), welded to the c-channel. This L-Channel provides a "shelf" to attach to the perimeter of stages and other flat surfaces by use of VELCRO hook and loop fasteners, similar to as described for the other stage mount embodiments. FIGS. 50 and 51 show curved stage mounts with the lighting/light housing installed. The C-Channel member can be cut ¾" short on either end (F5) to allow for cable egress.

FIG. 52 depicts how any of the stage mount embodiment is installed to a stage, platform, riser, etc. For example purposes only, a 8'×8'×4' tall stage deck (G1) is shown. Preferably, around the perimeter 1" adhesive loop and/or hook fastener (VELCRO) (G2) can be installed. With the VELCRO fastener (G2) installed on the stage surface, a fixture/unit of one of the stage amount embodiments can be placed on the perimeter of the deck and pressed into VELCRO fastener (G2) to cause the hook and/or loop fastener (VELCRO) on the underside of the "shelf" (B8 and C10) of the fixture/unit to mate to VELCRO (G2) on the deck creating a reliable and secure installation. As seen in FIG. 53, the fixtures can be placed end to end to create a seamless linear appearance. Once installed, 24-volt dc power can be applied to the first unit via the Neutrik NC4MX 4-pin male XLR connector (G24). Additional units then "daisy-chain" (G4) up to a preferred, though not limiting, maximum continuous length of 8 meters. Once all connections are made, a fabric drape can be applied via VELCRO fastener to the face of the stage mount (B7, C9) as discussed above. This fabric drape can mask the support structure for the staging and can also hide some, most or all cabling connections for the lighting/light housing product.

FIG. 54 illustrates a typical truss-mounted installation utilizing one embodiment of the disclosed truss mounts. Clamps (G8) affix the truss mount units/fixtures to an existing truss structure. Once installed, 24-volt dc power can be applied to the first unit via the Neutrik NC4MX 4-pin male XLR connector (G5). Additional units can then "daisy-chain" (G4) up to a preferred maximum continuous length of 8 meters. An integral ⅛" wire rope safety cable with snap hook (G11) can then be wrapped around the truss structure.

FIG. 55 shows a truss-mounted installation using units/fixtures incorporating the second truss mount embodiment configuration. Clamps (G8) affix the second embodiment units to the existing truss structure. Once installed, 24-volt dc power can be applied to the first unit via the Neutrik NC4MX 4-pin male XLR connector (G5). Additional units can then "daisy-chain" (G4) up to a preferred maximum continuous length of 8 meters. An integral ⅛" wire rope safety cable with snap hook (G11) can then be wrapped around the truss structure. A top "chord" of the demonstration truss (G7) shows the second truss mount embodiment fixtures installed using the clamps in the bottom T-Slot (G13) causing the upper dome (A2) of the lighting/light housing product to be pointing straight out which can be considered a standard orientation. The bottom "chord" of the demonstration truss (G7) shows the second truss mount embodiment fixtures installed using the clamps in the side T-Slot (G14) causing the upper dome (A2) of the lighting/light housing product to be pointing straight up for additional design options.

FIGS. 56 and 57 show a novel packaging trunk for transporting and storing the various stage mount fixtures regardless of embodiment(s) selected. In one non-limiting embodiment, the trunk can be 50" long×30" wide×36" tall to provide for convenient packing of the fixtures in a truck or other vehicle. In one non-limiting embodiment, eight standard recessed handles (H3) (two on each side) and four heavy duty casters (H2) can be provided for ease of movement. Preferably, four recessed caster dishes (H4) can be provided on the top lid of the case to facilitate stacking of the cases in a truck. Preferably, in the center of the top can be a recessed label dish (H1) to allow for placing shipping labels or placards in a manner that will protect them from abrasion. Once the lid is opened, the backside of the label dish (H6) allows for neat installation of a contents placard.

FIGS. 58 and 59 depict a preferred storage method for the stage mount fixtures in either embodiment. A piece of ½" Birch plywood can be computer numerical control machine (CNC) routed to the preferred design (H7) to create a "pack board". The design can include hand holds (H9) for lifting the pack board in and out of the case, recessed slots and pilot holes for installing the fixture brackets (H12), and cutouts (H10) of wasted space to reduce weight). The fixture brackets (H12) can be CNC cut from ¾" birch plywood. Preferably, four fixture brackets can be installed on a single pack board using screws and wood glue.

As seen in FIGS. 60 and 61, once a backboard is completed, it can be placed in the bottom of a road case and preferably, though not limiting, eight stage mount fixture/unit embodiments can be set upon the eight "peaks" (H14) of the four fixture brackets. A second pack board is set inside the case on top of the first backboard supported by the fixture bracket Support Tabs (H13) and another eight-stage mount fixture/unit embodiment are inserted. The process can continue with preferably up to seven backboards for a total of fifty-six stage mount fixture embodiments stored and transported per case.

FIGS. 62 and 63 show a storage method for the truss mount embodiments. A single base board made from ¾" birch plywood CNC routed can be used for the bottom of the case. The base board can include recessed slots and pilot holes for installing the fixture bracket (H21). The Fixture brackets can be CNC cut from ¾" birch plywood. Preferably, two fixture brackets are installed onto the base board by screws and wood glue. Two 1.5" diameter flanges (H28) are installed into the base using ¾" bolts and T-Nuts. Two pieces of 1.5" tubing, 24" tall (H29) are threaded onto the flanges. Additional Fixture brackets are assembled to create a completed fixture bracket assembly. This assembly includes two fixture brackets (H21), and a ¾" plywood spanner board 13"×20" with two 2" holes drilled in the center to accommodate the two 1.5" tubes. The base board is lowered into the novel road cases and eight truss mount unit/fixture of either embodiment can then be placed into the slots of the first set of fixture brackets. A fixture bracket assembly is then placed over the two 1.5" tubes and rests on the fixture bracket below. An additional eight truss mount fixtures/units are then placed. This process can continue with a total of four fixture brackets installed for a preferred total of thirty-two truss mount units per case.

FIGS. 66, 67 and 68 show a novel storage and shipping case referred to herein as a "power supply rack" which can be used for power supply units of the system. The novel rack can be shipped in a standard Pelican Storm im2875 injection molded rolling case or other rolling case. The Power Supply Rack can be used to house the 24-volt dc power supply units employed to control all of the lighting/light housing products. The Power Supply Rack can be manufactured from ½" birch plywood and covered in tweed material, such as, but not limited to black tweed material. A hand hold (J2) can be cut into either side of the case for future usage. A recessed handle can be placed on each side of the unit for convenient carrying (J6) and two handles are placed on top to facilitate getting the Power Supply Rack into and out of a rolling case. The Power Supply Rack can include four standard equipment rack rails for mounting gear (J3) which are installed with carriage bolts (J4). There can be a piece of ½" plank foam installed on the bottom of the case (J5) to shock mount the electronics that will be mounted inside.

LIST OF REFERENCE NUMERALS

A1—Preferably 270 degree, flexible lighting product. Preferably a neon lighting product and preferably being a flexible red, green, blue 24 volt LED product that allows for diffused light emission from the "dome" to replicate the look of neon.

A2—the upper "dome".

A3—the lower "housing"

A4—3 meter white, 4 wire cable, injection molded into the lower housing and exiting the bottom of the housing (#A3) at each end A5—injection molding site at each end A6—bare wires for connection to red, green, blue and common circuits on each 3 meter lead at each end.

A7—1" long black heat shrink installed for strain relief and to capture the black plastic sleeving at each end (#A9)

A8—3-meter cable (#A4) preferably cut to 12" length at each end.

A9—¼" Black plastic flexible cable sleeving installed over white cable (#A4) at each end and held in place by the heat shrink (#A7) and the connector housings (#A10, #A11)

A10—4-pin male XLR connector preferably soldered to bare wires (#A6) for inputting 24v signal into the lighting product or flexible lighting product (#A1). In one non-limiting embodiment, the connector used is a NEUTRIK NC4MX 4-pin male XLR connector.

A11—4-pin female XLR connector soldered to bare wires (#A6) for outputting 24 v signal to allow "daisy-chaining" of additional units. In one non-limiting embodiment, the connector used is a NEUTRIK NC4FX 4-pin female XLR connector.

B1—¾"×34" Aluminum "C" channel extrusion from ⅛" stock material used for the insertion of the preferred 270 Degree Flex Neon lighting product. "C" channel (B1) is welded to "L" channel (B2), preferably for stage use.

B2—2"×2" Aluminum "L" channel extrusion from ⅛" stock material. This channel can be welded to "C" channel (#B1)—preferably for stage use.

B3—Aluminum "C" Channel (#B1) can be welded to aluminum "L" channel (#B2)—preferably for stage use B4—Opening in "C" Channel (#B1) to accept flexible neon lighting product B5— 3/16" hole for hanging during powder coating and possible cable strain relief.

B6—"C" Channel (#B1) has a milled slot cut in the bottom 1 1/16" with a ½" mill bit to allow for pass through of injection molded cables (#B11) at each end.

B7 1" Adhesive black hook and/or loop fastening (VELCRO) material installed on vertical face of "L" channel (#B2) to allow for installation of stage skirting material provided by others.

B8—1¾" Adhesive black hook and/or loop fastening (VELCRO) material installed on the underside top of the "L" channel (#B2) running the length of the extrusion to allow for installation on horizontal stage surfaces.

B9—Horizontal ends of "L" channel extrusion (#B2) can be cut at or about 45° angles to allow for installation of mitered at or about 90° corners.

B10—Completed flexible neon lighting product installed into the opening in the "C" channel (#B4).

B11 Complete flexible neon lighting cables exiting through milled slots (#B6) in the bottom of the "C" channel (#B11).

C1—Alternative design for aluminum extrusion preferably for stage use.

C2—2" wide×⅛" deep aluminum "Shelf" for mounting extrusion to stage. 2" adhesive-hook and loop fastening material (VELCRO) (#C10) adhered to underside of shelf C3—1" inset for installing 1" adhesive "hook and/or loop fastener" (VELCDRO) (#C9). Used for installing fabric stage skirts provided by others.

C4—Opening for installing domed flexible lighting product (#C14)

C5—½" tall by ⅛" thick Aluminum Retainer Bar that can run the length of the channel. Used for applying pressure against the base of the domed flexible lighting product (#C14) to lock it into the extrusion.

C6—3/16" diameter×¼" long set screws to apply pressure against the Aluminum Retainer Bar (#C5) located on 8" centers C7—3/16" diameter hole drilled into extrusion on 8" centers. Threaded to receive set screws (#C6) located on 8" centers.

C8—Slot in extrusion to accommodate the Aluminum Retainer Bar (#C5).

C9—1" adhesive hook and/or loop fastener (VELCRO) installed along the length of the extrusion (#C1). Used for installing fabric stage skirts C10—2" adhesive hook and/or loop fastener (VELCRO) installed along the length of the extrusion (#C1). Used for installing extrusion to staging structures C11—1 1/16"×1/2" milled slot cut into the ends of the of the opening (#C4) of the aluminum extrusion (#C1) to allow for pass through of injection molded cables (#C15) at each end C12—3/16" hole for hanging during powder coating.

C13—Horizontal ends of "Shelf" (#C2) are cut at or about 45° angles to allow for installation of mitered 90° corners.

C14—Completed neon lighting product installed into the opening (#C4) in the custom aluminum extrusion (#C1)

C15—Completed neon lighting product cables exiting through the milled slots (#C11) in the bottom of the extrusion (#C1).

D1—Aluminum "C" channel extrusion used for the insertion of the flexible neon lighting product. "C" channel is affixed to "T-Slot" extrusion (#D2) with 1/2" 3M brand VHB adhesive tape, compression fit for preferably 60 minutes. Preferably used for truss mounting.

D2—Aluminum "T-Slot" extrusion used for affixing clamps (#D10). "T-Slot" extrusion is affixed to "C" channel extrusion (#D1) preferably with 1/2" 3M brand VHB adhesive tape, compression fit for 60 minutes. The "T-Slot" allows for sliding the clamps (#D10) anywhere along the length of the fixture to accommodate end user mounting requirements D3—Opening for installing domed flexible lighting product (#D18)

D4—Opening for installing 1/4" bolt and nut sets in the "T-Slot" extrusion (#D2).

D5—1/4"×1 1/4" grade 8 hex bolt.

D6—1/4" split washer.

D7—1/4" flat washer.

D8—1/4" grade 8 hex nut.

D9—1/2" aluminum or steel spacer for setting the disclosed first truss mount fixture embodiment off of existing truss structures to accommodate the installation of additional lighting fixtures that may also be provided.

D10—Mini QR360 Trigger Clamp Black. Used to affix the first truss mount embodiment fixture to standard 2" outer diameter (OD) tubing or another sized tubing diameter used for the truss structure.

D11—3/16" hole passing through both sides of the T-Slot extrusion (#D2) for hanging during the preferred powder coating process and for installing a 1/4" wire rope safety cable assembly (#D16)

D12—3/16" hole in the bottom of the aluminum "C" channel (#D1) for hanging during the preferred powder coating process D13—1/8" wire rope safety cable black.

D14—1/8" Nicropress sleeve.

D15—5/16" snap hook black.

D16—Complete Safety Cable (#D13, #D14, #D15)

D17—Aluminum extrusions are cut at a length to allow 3/4" of the flexible neon lighting product (#D18) to extend past on either end to accommodate the injection molded cables (#D19).

D18—Completed flexible neon lighting product installed into the opening (#D3) in the "C" channel aluminum extrusion (#D1)

D19—Completed flexible neon lighting product cables exiting past the aluminum extrusions (#D17).

E1—alternative embodiment for the truss mountable aluminum extrusion used for the insertion of the flexible neon lighting product as well as two "T-Slots" to allow mounting of clamp assemblies (#E15) from either underneath or side positions E2—opening for installing domed flexible neon lighting product (#E25)

E3—1/2" tall by 1/8" thick Aluminum Retainer Bar that runs the length of the channel. Used for applying pressure against the base of the domed flexible lighting product (#E25) to lock it into the extrusion E4—3/16" diameter×1/4" long set screws to apply pressure against the Aluminum Retainer Bar (#E3) located on 8" centers E5—3/16" diameter hole drilled into extrusion on 8" centers. Threaded to receive set screws (#E4) located on 8" centers.

E6—Slot in extrusion to accommodate the Aluminum Retainer Bar (#E3).

E7—"T-Slot" opening for installing 1/4" bolt and nut sets for side mounting of clamps (#E15). The "T-Slot" allows for sliding the clamps (#E15) anywhere along the length of the fixture to accommodate end user mounting requirements.

E8—"T-Slot" opening for installing 1/4" bolt and nut sets for underneath mounting of clamps (#E15). The "T-Slot" allows for sliding the clamps (#E15) anywhere along the length of the fixture to accommodate end user mounting requirements.

E9—Two 0.17" diameter holes in custom aluminum extrusion to accept 1/8" locating pins (#E18) on one end and to become the female receptor for the locations pins (#E18) of another fixture.

E10—1/4"×1 1/2" grade 8 hex bolt.

E11—1/4" split washer

E12—1/4" flat washer.

E13—1/4" grade 8 hex nut.

E14—1/2" aluminum or steel spacer for setting the alternative embodiment for the truss mount fixture off of existing truss structures to accommodate the installation of additional lighting fixtures that they may be provided.

E15—Mini QR360 Trigger Clamp Black. Used to affix the alternative embodiment for the truss mount fixture to standard 2" OD tubing or another sized tubing diameter used for the truss structure.

E16—Inset in the alternative truss mount aluminum extrusion to allow for protected label location along the entire length of the extrusion (#E1).

E17—3/16" hole passing through both sides of the lower T-Slot (#E8) for hanging during the powder coating process and for installing a 1/4" wire rope safety cable assembly (#E23).

E18—Two 1/8" diameter locating pins installed with epoxy into the two holes (#E9) in the alternative embodiment for the truss mount aluminum extrusion (#E1).

E19—Two holes (#E9) in the alternative embodiment for the truss mount aluminum extrusion (#E1) to act as female receptors for the locating pins (#E9) from an adjacent fixture. This keeps the units in alignment when installing multiple fixtures.

E20—1/8" wire rope safety cable black.

E21—1/8" Nicropress sleeve.

E22—5/16" snap hook black.

E23—Complete Safety Cable (#E20, #E21, #E22)

E24—1 1/16"×1/2" milled slot cut into the ends of the of the opening (#E2) of the alternative embodiment for the truss mount aluminum extrusion (#E1) to allow for pass through of injection molded cables (#E26) at each end.

E25—Completed flexible neon lighting product installed into the opening (#E2) in the alternative embodiment for the truss mount aluminum extrusion (#E1)

E26—Completed flexible lighting product cables exiting through the milled slots (#E24) of the alternative embodiment for the truss mount aluminum extrusion (#E1).

F1—¾"×34" Aluminum "C" channel extrusion preferably from ⅛" stock material used for the insertion of the flexible neon lighting product (#F6). "C" channel (#F1) can be welded to "L" channel tabs (#F2). Aluminum "C" channel (#F1) can be radiused into any curve preferably down to a minimum 4" interior radius. Lengths can be cut 1½" shorter than the selected flexible neon lighting product (#F6) to allow for ¾" egress of the injection molded cables (#F7).

F2—2"×2" Aluminum "L" channel extrusion from ⅛" stock material cut into 2" widths to create mounting tabs. Mounting tabs can be welded to "C" channel (#F1). 10⅞" spacing of tabs is typical, however, spacing of tabs and number of tabs may vary depending the required overall length of the "C" channel (#F1)

F3—2"×1¾" Adhesive black hook and/or loop fastener material installed on the underside top of the "L" channel mounting tabs (#F2) to allow for installation on horizontal stage surfaces.

F4—3/16" hole drilled into aluminum tabs (#F2) to allow for suspension during the preferred powder coating process as well as allowing for mounting the tabs to a deck surface using wood screw fasteners if necessary.

F5—Aluminum extrusions are cut at a length of 1½" shorter than the flexible neon lighting product (#F6) to allow ¾" of the product to extend past on either end to accommodate the injection molded cables (#F7).

F6—Completed flexible neon lighting product installed into the "C" channel (#F1).

F7—Completed flexible neon lighting product cables exiting past the aluminum "C" channel (#F1).

G1—Typical or conventional staging riser

G2—1" Adhesive loop product applied to the edge of the staging deck to accept one embodiment of the disclosed mounting systems.

G3—Complete 1.2 m of one embodiment of the disclosed mounting system installed onto stage via hook and loop fasteners.

G4—several disclosed mounting units plug together via 4 pin Neutrik connectors up to 8 meters in length.

G5—24 volt dc power is ingested into the LED product via the 4-pin Neutrik connector and subsequently feeds all units connected downstream up to a maximum of 8 m total length.

G6—Fabric stage skirt can be affixed to the lower face of the disclosed novel mounting unit via the 1" adhesive hook and/or loop fastener (VELCRO) applied to the face of the mounting unit. Installing the fabric stage skirt then conceals all cable connections G7—Typical or conventional truss structure G8—Mini QR360 Trigger Clamp Black. Used to affix the one embodiment for the disclosed novel truss mount fixture to standard 2" OD tubing or another sized tubing diameter used for the truss structure.

G9—½" aluminum or steel spacer for setting a disclosed novel truss mount fixture embodiment off of existing truss structures to accommodate the installation of additional lighting fixtures that may be provided G10—24 volt dc power is fed out of the flexible neon lighting product to "daisy-chain" additional novel mounting units preferably up to a maximum of 8 m in length.

G11—⅛" safety cable installed around truss chord.

G12—1.2 m of complete novel truss mount embodiment with lighting installed.

G13—1.2 m of complete novel truss mount embodiment installed with clamps in the bottom T-Slot allowing the fixture to point straight out.

G14—1.2 m of complete novel truss mount embodiment installed with the clamps in the side T-Slot allowing the fixture to point straight up.

G15—Two ⅛" diameter locating pins installed with epoxy into the two holes (#E9) in the custom aluminum extrusion H1—an inset label dish on the top/lid of the novel disclosed transport case preferably for installing event labels.

H2—four heavy duty casters

H3—Two recessed handles on each side of the case. Eight total.

H4—Recessed caster dishes on the lid to allow for stacking of cases

H5—case lid opened

H6—Content labels placed on backside of the externally mounted label dish (#H1)

H7—Insert base CNC routed ½" birch plywood—preferably used as inserts for storing and transporting disclosed novel floor/stage units H8—Inset groove 0.125" deep H9—Two hand holds to allow technicians and other individual to lift the Insert base (#H7)

H10—Openings in the Insert base (#H7) to significantly reduce overall weight.

H11—Pilot holes for fixture bracket (#H10)

H12—fixture bracket CNC routed from ¾" birch plywood

H13—Support tabs on the fixture bracket (#H12) to support staging of multiple completed inserts (#H11)

H14—Eight "peaks" along the width of the fixture bracket (#H12) to support stage mount units H15—Completed insert with four fixture brackets #(H10) installed on Insert plywood base (#H7) with glue and wood screws.

H16—Eight 1.2 m stage mount units pack on one completed insert (#H11)

H17—Seven loaded (#H12) inserts can stack inside of a 50"×30"×36" custom road case for a total of 56 stage mount novel units.

H18—Insert base CNC routed ¾" birch plywood—preferably used as inserts for storing and transporting disclosed novel truss units H19—Inset groove 0.125" deep H20—Pilot holes for fixture bracket (#H20)

H21—fixture bracket CNC routed ¾" birch plywood

H22—Support Tabs on fixture bracket

H23—Fixture retaining slot

H24—Fixture bracket (#H21) installed in Insert Base (#H18) with glue and wood screws H25—¾" plywood Spanner to couple two Fixture brackets (H21) on 13" centers H26—2" holes cut into Spanner (#H25) to allow for insertion over 1.5" OD pipes (#H28)

H27—Completed Fixture bracket assembly which sets down over the 1.5" steel pipes (#H29) to allow stacking of truss units.

H28—Two Steel flanges bolted to the Insert base (#H18)

H29—Two 1.5" OD steel pipe threaded into the Steel flanges (#H27). 24" tall

H30—Eight novel truss mount fixtures installed on fixture Brackets (#H24)

H31—Three additional Fixture Bracket Assemblies (#H27) stack utilizing the two 1.5" OD steel pipe allowing for a total of 24 units to be stored inside a 50"×30"×36" road case.

J1—Custom novel power supply rack unit 20¼" wide× 19" deep×8.7" tall. Manufactured from ½" birch plywood and covered in black tweed fabric.

J2—Hand hold cut into side of rack (J1) 4.25" tall×1.75" wide.

J3—7" tall standard rack mount rail. Four total

J4—¼"×1" carriage bolt with nylock nut to install 7" standard rack rail (#J3) 2 bolts per rail. Eight total J5—17"×14"×1.2" plank style foam glued to floor of rack (#J1) to provide support for a power supply unit J6—Installed standard retractable handles. Four total; two on top, one on each side It should be understood that the exemplary embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from their spirit and scope.

All components of the described system and their locations, channel shapes, electrical connector types, dimensions, amounts, numbers, sizes, lengths, configurations, positions, securement techniques and methods, light technology, values, materials, etc. discussed above or shown in the drawings, if any, are merely by way of example and are not considered limiting and other component(s) and their locations, channel shapes, securement techniques and methods, electrical connector types, dimensions, amounts, numbers, sizes, lengths, configurations, positions, light technology, values, materials, etc. can be chosen and used and all are considered within the scope of the disclosure.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

The benefits, advantages, solutions to problems, and any element(s) that may cause any benefit, advantage, or solution to occur or become more pronounced are not to be construed or considered as a critical, required, or essential features or elements of any or all the claims.

While the novel mounting bracket and packaging system have been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. A mount used as part of a modular system for holding a lighting strip that is used for temporarily outlining a stage or similar structure with lighting, the lighting strip having a lower housing one or more light bulbs and electrical circuitry, and an upper portion where light from the one or more light bulbs emanates, the lighting strip having a first cable extending out of the lower housing at a first end of the lower housing and a second cable extending out of the lower housing at a second end of the lower housing, the first cable and the second cable in electrical communication with the electrical circuitry, comprising:

a substantially "C"-shaped member having an outer wall, inner wall and a bottom portion and having first end and a second end and a channel extending from the first end of the "C" shaped member to the second end of the "C" shaped member, in use for outlining a stage or similar structure with light from the lighting strip, the channel is adapted for receipt of the lower member of the lighting strip such that the lower member contacts the bottom portion of the substantially "C"-shaped member and the upper portion of the lighting strip is positioned above the "C" shaped member and such that light emanating out of the upper portion is visible, and the first cable extends downward at the first end of the "C"-shaped member and the second cable extends downward at the second end of the "C"-shaped member; and means for temporarily mounting the "C" shaped member to the stage or other structure such that the "C" shaped member and lighting strip are reusable after removal;

wherein the inner wall, the outer wall and the bottom portion are curved to form a curved "C" shaped-channel member;

wherein the means for temporarily mounting comprises:

a substantially "L" shaped member having a first leg having an outer surface and an inner surface and a second leg having an outer surface and an inner surface, the outer surface of the first leg substantially aligned with an upper surface of the inner wall of the "C"-shaped member and the outer surface of the inner wall of the "C"-shaped member is in contact with an outer surface portion of the second leg;

a first hook and loop fastening portion disposed on an inner surface portion of the first leg; and a second hook and loop fastening portion disposed at an outer edge area of the stage or similar structure having an outer planar surface area;

wherein the first hook and loop fastening portion mates with the second hook and loop fastening portion to removably lock the "C" shaped member and the "L" shaped member to the stage or similar structure such that the lighting strip housed within the channel is positioned along the edge of the stage or similar structure.

2. The mount of claim 1 wherein the "C" shaped member and the "L" shaped member are welded together to form a one-piece member.

3. The mount of claim 1 wherein the "C" shaped member and "L" shaped are constructed together as a one-piece member during fabrication.

4. The mount of claim 1 wherein the channel having a top opening sized to receive the lower housing of the lighting strip tightly such that the lower housing of the lighting strip is pressed fitted within the channel.

5. The mount of claim 1 wherein the outer wall of the "C"-shaped member defining an opening therethrough from an outer surface to and an inner surface and a slot at the inner surface extending from a first end of the outer wall to the second end of the outer wall; wherein the mount further comprising a retainer bar disposed within the outer wall slot and a screw disposed within the outer wall opening; wherein while in operation the lower housing of the lighting strip is received within the channel and the tightening of the screw causes the screw to contact the retainer bar and move the retainer bar towards the lower housing to create a tight and secure fit of the lower housing within the channel.

6. The mount of claim 5 wherein the means for temporary mounting comprising a plurality of substantially "L" shaped mounting tabs secured to and along an outer surface of the inner wall at a spaced apart distance from each other, each mounting tab of the plurality of mounting tabs having a first leg having an outer surface and an inner surface and a second leg having an outer surface and an inner surface, the outer surface of the first leg substantially aligned with an upper surface of the inner wall of the curved "C"-shaped member and a top portion of the second leg in contact with the outer surface of the inner wall.

7. The mount of claim 1 further comprising a third hook and loop fastening portion disposed on an outer surface of the second leg underneath the bottom portion of the "C"-shaped member and a fourth hook and loop fastening portion disposed on a stage skirt, drapes or similar structure; wherein mating of the fourth hook and loop fastening portion to the third hook and loop fastening portion causes the stage skirt, drapes or similar structure to hang downward from the "L" shaped member.

8. The mount of claim 1 wherein a first male or female electrical connector is secured at an end of the first cable and a second male or female electrical connector is secured at an end of the second cable, wherein a connector gender selected for the first electrical connector is opposite to a connector gender selected for the second electrical connector to allow multiple lighting strips contained in corresponding mounts to be electrically daisy chained together and outline at least a substantial edge portion of the stage or other structure with outline lighting.

9. The mount of claim 1 wherein the lighting strip having a plurality of LED light bulbs.

10. The mount of claim 1 wherein the means for temporary mounting comprising a plurality of substantially "L" shaped mounting tabs secured to and along an outer surface of the inner wall at a spaced apart distance from each other, each mounting tab of the plurality of mounting tabs having a first leg having an outer surface and an inner surface and a second leg having an outer surface and an inner surface, the outer surface of the first leg substantially aligned with an upper surface of the inner wall of the curved "C"-shaped channel member and a top portion of the second leg in contact with the outer surface of the inner wall.

11. The mount of claim 10 wherein the means for temporary mounting further comprising:

a plurality of first hook and loop fastening portions, a corresponding one of the plurality of first hook and loop fastening portions disposed on an inner surface portion of a first leg of a corresponding one of the plurality of mounting tabs; and a plurality of second hook and loop fastening portion disposed at spaced apart location at an outer edge area of the stage or similar structure having an outer planar surface area;

wherein each of the plurality of first hook and loop fastening portions mates with a corresponding one of the plurality of second hook and loop fastening portions to removably lock the "C" shaped member and the mounting tabs to the stage or similar structure such that the lighting strip housed within the channel is positioned along the edge of the stage or similar structure.

12. A mount used as part of a modular system for holding a lighting strip that is used for temporarily outlining a stage or similar structure with lighting, the lighting strip having a lower housing one or more light bulbs and electrical circuitry, and an upper portion where light from the one or more light bulbs emanates, the lighting strip having a first cable extending out of the lower housing at a first end of the lower housing and a second cable extending out of the lower housing at a second end of the lower housing, the first cable and the second cable in electrical communication with the electrical circuitry, comprising:

a substantially "C"-shaped member having an outer wall, inner wall and a bottom portion and having first end and a second end and a channel extending from the first end of the "C" shaped member to the second end of the "C" shaped member, in use for outlining a stage or similar structure with light from the lighting strip, the channel is adapted for receipt of the lower member of the lighting strip such that the lower member contacts the bottom portion of the substantially "C"-shaped member and the upper portion of the lighting strip is positioned above the "C" shaped member and such that light emanating out of the upper portion is visible, and the first cable extends downward at the first end of the "C"-shaped member and the second cable extends downward at the second end of the "C"-shaped member; and means for temporarily mounting the "C" shaped member to the stage or similar structure such that the "C" shaped member and lighting strip are reusable after removal;

wherein the means for temporary mounting comprising:

a plurality of substantially "L" shaped mounting tabs secured to and along an outer surface of the inner wall at a spaced apart distance from each other, each mounting tab of the plurality of mounting tabs having a first leg having an outer surface and an inner surface and a second leg having an outer surface and an inner surface, the outer surface of the first leg substantially aligned with an upper surface of the inner wall of the "C"-shaped member and a top portion of the second leg in contact with the outer surface of the inner wall;

wherein the "C"-shaped member is curved.

13. The mount of claim 12 wherein the means for temporary mounting further comprising a plurality of first hook and loop fastening portions, a corresponding one of the plurality of first hook and loop fastening portions disposed on an inner surface portion of a first leg of a corresponding one of the plurality of mounting tabs; and a plurality of second hook and loop fastening portion disposed at spaced apart location at an outer edge area of the stage or similar structure having an outer planar surface area;

wherein each of the plurality of first hook and loop fastening portions mates with a corresponding one of the plurality of second hook and loop fastening portions to removably lock the "C" shaped member and the mounting tabs to the stage or similar structure such that the lighting strip housed within the channel is positioned along the edge of the stage or similar structure.

14. A modular system for temporarily outlining a stage or similar structure with lighting comprising:

a lighting strip having a lower housing, one or more light bulbs and electrical circuitry, and an upper portion where light from the one or more light bulbs emanates, the lighting strip having a first cable extending out of the lower housing at a first end of the lower housing and a second cable extending out of the lower housing at a second end of the lower housing, the first cable and the second cable in electrical communication with the electrical circuitry;

a lighting strip mount comprising:

a substantially "C"-shaped member having an outer wall, inner wall and a bottom portion and having first end and a second end and a channel extending from the first end of the "C" shaped member to the second end of the "C" shaped member, in use for outlining a stage or similar structure with light from the lighting strip, the channel is adapted for receipt of the lower member of the lighting strip such that the lower member contacts the bottom portion of the substantially "C"-shaped member and the upper portion of the lighting strip is positioned above the "C" shaped member and such that light emanating out of the upper portion is visible, and the first cable extends downward at the first end of the "C"-shaped member and the second cable extends downward at the second end of the "C"-shaped member; and means for temporarily mounting the "C" shaped member to the stage or other structure such that the "C" shaped member and lighting strip are reusable after removal;

wherein the means for temporary mounting comprising a plurality of substantially "L" shaped mounting tabs secured to and along an outer surface of the inner wall at a spaced apart distance from each other, each mounting tab of the plurality of mounting tabs having a first leg having an outer surface and an inner surface and a second leg having an outer surface and an inner surface, the outer surface of the first leg substantially aligned with an upper surface of the inner wall of the "C"-shaped member and a top portion of the second leg in contact with the outer surface of the inner wall; wherein the "C"-shaped member is curved.

15. The modular system of claim 14 wherein the inner wall, the outer wall and the bottom portion are curved to form a curved "C" shaped channel member.

16. The modular system of claim 14 wherein the means for temporary mounting further comprising:

a plurality of first hook and loop fastening portions, a corresponding one of the plurality of first hook and loop fastening portions disposed on an inner surface portion of a first leg of a corresponding one of the plurality of mounting tabs; and a plurality of second hook and loop fastening portion disposed at spaced apart location at an outer edge area of the stage or similar structure having an outer planar surface area;

wherein each of the plurality of first hook and loop fastening portions mates with a corresponding one of the plurality of second hook and loop fastening portions to removably lock the "C" shaped member and the mounting tabs to the stage or similar structure such that the lighting strip housed within the channel is positioned along the edge of the stage or similar structure.

17. The modular system of claim 14 wherein the means for temporary mounting further comprising:

a plurality of first hook and loop fastening portions, a corresponding one of the plurality of first hook and loop fastening portions disposed on an inner surface portion of a first leg of a corresponding one of the plurality of mounting tabs; and a plurality of second hook and loop fastening portion disposed at spaced apart location at an outer edge area of the stage or similar structure having an outer planar surface area;

wherein each of the plurality of first hook and loop fastening portions mates with a corresponding one of the plurality of second hook and loop fastening portions to removably lock the "C" shaped member and the mounting tabs to the stage or similar structure such that the lighting strip housed within the channel is positioned along the edge of the stage or similar structure.

* * * * *